US009957627B2

(12) United States Patent
Liu et al.

(10) Patent No.: US 9,957,627 B2
(45) Date of Patent: May 1, 2018

(54) SYSTEMS AND METHODS OF PROTECTING ELECTROLYSIS CELL SIDEWALLS

(71) Applicant: ALCOA INC., Pittsburgh, PA (US)

(72) Inventors: Xinghua Liu, Murrysville, PA (US); Robert A. DiMilia, Greensburg, PA (US); Joseph M. Dynys, New Kensington, PA (US); Jeffrey S. Martello, Murrysville, PA (US)

(73) Assignee: Alcoa USA Corp., Pittsburgh, PA (US)

( * ) Notice: Subject to any disclaimer, the term of this patent is extended or adjusted under 35 U.S.C. 154(b) by 183 days.

(21) Appl. No.: 14/847,926

(22) Filed: Sep. 8, 2015

(65) Prior Publication Data

US 2016/0068980 A1 Mar. 10, 2016

Related U.S. Application Data

(60) Provisional application No. 62/048,375, filed on Sep. 10, 2014.

(51) Int. Cl.

| | |
|---|---|
| ***C25C 3/20*** | (2006.01) |
| ***C25C 3/08*** | (2006.01) |
| ***C25C 3/14*** | (2006.01) |

(52) U.S. Cl.

CPC ..... *C25C 3/20* (2013.01); *C25C 3/08* (2013.01); *C25C 3/14* (2013.01)

(58) Field of Classification Search

CPC ..... C25C 7/005; C25C 3/14

See application file for complete search history.

(56) References Cited

U.S. PATENT DOCUMENTS

| | | | | |
|---|---|---|---|---|
| 4,322,282 | A * | 3/1982 | Jemec | C25C 3/08 204/247.5 |
| 4,495,047 | A | 1/1985 | Gesing et al. | |
| 4,877,507 | A * | 10/1989 | Hudson | C25C 3/085 204/247.4 |
| 4,999,097 | A * | 3/1991 | Sadoway | C25C 3/08 204/247.3 |
| 5,254,232 | A | 10/1993 | Sadoway | |
| 5,378,326 | A * | 1/1995 | Kumpulainen | C25C 3/14 204/245 |
| 6,358,393 | B1 * | 3/2002 | Berclaz | C25C 3/08 204/244 |
| 6,811,676 | B2 * | 11/2004 | Bradford | C25C 3/08 204/244 |
| 8,025,785 | B2 * | 9/2011 | De Nora | C25C 3/08 204/237 |

(Continued)

FOREIGN PATENT DOCUMENTS

WO 2007105124 A2 9/2007

OTHER PUBLICATIONS

R. Etzion, Degradation mechanisms and development of silicon carbide refractories, thesis from the University of Auckland, 2008 (no month available), p. 1-212.*

(Continued)

*Primary Examiner* — Harry D Wilkins, III

(74) *Attorney, Agent, or Firm* — Greenberg Traurig, LLP

(57) ABSTRACT

Broadly, the present disclosure relates to sidewall features (e.g. inner sidewall or hot face) of an electrolysis cell, which protect the sidewall from the electrolytic bath while the cell is in operation (e.g. producing metal in the electrolytic cell).

16 Claims, 44 Drawing Sheets

(56) References Cited

U.S. PATENT DOCUMENTS

| | | | | |
|---|---|---|---|---|
| 8,206,560 | B2 * | 6/2012 | Feng | C25C 3/08 204/243.1 |
| 2004/0011660 | A1 | 1/2004 | Bradford et al. | |
| 2006/0054499 | A1 | 3/2006 | De Nora | |
| 2014/0262807 | A1 * | 9/2014 | Liu | C25C 3/08 205/367 |
| 2014/0262808 | A1 * | 9/2014 | Liu | C25C 7/06 205/367 |
| 2016/0068979 | A1 * | 3/2016 | Liu | C25C 3/20 204/245 |
| 2016/0068980 | A1 * | 3/2016 | Liu | C25C 3/20 205/367 |

OTHER PUBLICATIONS

Gudbrandsen et al, Cathodic Dissolution of Carbon in Cryolitic Melts, Light Metals, Mar. 1992, pp. 521-528.*

International Search Report dated Oct. 28, 2015 issued in corresponding International Application No. PCT/US2015/048903.

Written Opinion of the International Searching Authority dated Oct. 28, 2015 issued in corresponding International Application No. PCT/US2015/048903.

* cited by examiner

SYSTEMS AND METHODS OF PROTECTING ELECTROLYSIS CELL SIDEWALLS

CROSS-REFERENCE TO RELATED APPLICATIONS

This patent application is a non-provisional of and claims priority to U.S. Patent Application No. 62/048,375 filed Sep. 10, 2014 which is incorporated herein by reference in its entirety.

FIELD OF THE INVENTION

Broadly, the present disclosure relates to sidewall features (e.g. inner sidewall or hot face) of an electrolysis cell, which protect the sidewall from the electrolytic bath while the cell is in operation (e.g. producing metal in the electrolytic cell). More specifically, in one or more embodiments of the instant disclosure, the inner sidewall features provide for direct contact with the metal, bath, and/or vapor in an electrolytic cell in the absence of the frozen ledge along the entire or a portion of inner sidewall.

BACKGROUND

Traditionally, sidewalls of an electrolysis cell are constructed of thermally conductive materials to form a frozen ledge along the entire sidewall (and upper surface of the bath) to maintain cell integrity. Through the various embodiments of the instant disclosure, the sidewall is replaced, at least in part, by one or more sidewall embodiments of the instant disclosure.

SUMMARY OF THE DISCLOSURE

In some embodiments, a stable sidewall material is provided, which is stable (e.g. substantially non-reactive) in the molten electrolyte (e.g. the cell bath) by maintaining one or more components in the bath chemistry at a certain percentage of saturation. In some embodiments, the bath chemistry is maintained via at least one feeding device in the cell (e.g. located along the sidewall), which provides a feed material into the cell (e.g. which is retained as a protecting deposit located adjacent to the sidewall of the cell). In some embodiments, the protecting depict supplies at least one bath component (e.g. alumina) to the bath (e.g. to the bath immediately adjacent to the sidewall). As a non-limiting example, as the protecting deposit is slowly dissolved, the bath chemistry adjacent to the sidewall is at or near saturation for that bath component, thus protecting the sidewall from dissolving (e.g. solubilizing/corroding) by interacting with the molten electrolyte/bath. In some embodiments, the percent saturation of the bath for a particular bath component (e.g. alumina) is a function of the feed material concentration (e.g. alumina) at cell operating conditions (e.g. temperature, bath ratio, and bath chemistry, and/or content).

In some embodiments, a polarized sidewall (e.g. anodically polarized sidewall and/or cathodically polarized sidewall) actively assists in conducting current into or out of the wall, where such polarized materials are resistant to: the vapor phase, the bath/air interface, the bath, the bath/metal interface, the metal pad, and combinations thereof.

In some embodiments, a frozen ledge device and/or thermal conductor (e.g. insulating material) comprises at least a portion of the sidewall and is configured to extract heat from the bath at a specific location to define a localized frozen ledge along a portion of the sidewall. In some embodiments, the localized frozen edge is configured as an electrical insulator between oppositely polarized sidewall portions and/or interfaces (e.g. bath-vapor interface or metal-bath interface). In some embodiments, the frozen ledge device and/or thermal conductor materials are utilized in conjunction with at least one of (a) a non-reactive sidewall material (also called a stable sidewall material) and/or (b) a polarized sidewall material. In some embodiments, the frozen ledge device is adjustable, repositionable and/or removable. In some embodiments, the frozen ledge device is integral (e.g. part of) the sidewall.

In some embodiments, the sidewalls of the instant disclosure provide for an energy savings of: at least about 5%; at least about 10%; at least about 15%; at least about 20%; at least about 25%; or at least about 30% over the traditional thermally conductive material package.

In some embodiments, the heat flux (i.e. heat lost through the sidewall of the cell during cell operation) is: not greater than about 8 $kW/m^2$; not greater than about 4 $kW/m^2$; not greater than about 3 $kW/m^2$; not greater than about 2 $kW/m^2$; not greater than about 1 $kW/m^2$; not greater than about 0.75 $kW/m^2$.

In some embodiments, the heat flux (i.e. heat lost through the sidewall of the cell during cell operation) is: at least about 8 $kW/m^2$; at least about 4 $kW/m^2$; at least about 3 $kW/m^2$; at least about 2 $kW/m^2$; at least about 1 $kW/m^2$; at least about 0.75 $kW/m^2$.

In stark contrast, commercial Hall cells operate with a heat flux through the sidewall of between about 8-15 $kW/m^2$.

In one or more embodiments of the instant disclosure, active/dynamic side/end walls for metal electrolytic cells are provided, wherein the inside portion (inner wall) of the sidewall is positively polarized, negatively polarized, or combined (positively and negatively polarized—with an insulator between the positive and negative sidewall portions). In one or more embodiments of the instant disclosure, the middle portion (insulator) is built with thermal and electrical insulation materials to prevent heat loss. In one or more embodiments, the outside of the sidewall is a shell (e.g. steel) for structural stability. In some embodiments, stable materials and/or localized freezing are utilized and specifically designed/configured to extend across the gap (e.g. seal and/or electrically insulate) in the dynamic (active) side/end walls.

In one aspect of the instant disclosure, an electrolysis cell is provided, comprising: an anode; a cathode in spaced relation from the anode; a molten electrolyte bath in liquid communication with the anode and the cathode; a cell body comprising a sidewall and a bottom, wherein the cell body is configured to retain the molten electrolyte bath; wherein the sidewall comprises: a polarized sidewall portion, wherein the polarized sidewall portion comprises not greater than 95% of the sidewall and is in liquid communication with the molten electrolyte bath, wherein the sidewall is from 5 mm thick to 500 mm thick.

In some embodiments, the polarized sidewall portion is one of: an anodically polarized sidewall, a cathodically polarized sidewall, and combinations thereof.

In some embodiments, the polarized sidewall portion comprises: a cathodically polarized sidewall, wherein the cathodically polarized sidewall is positioned below the bath-vapor interface and adjacent to the bottom of the cell body such that the cathodically polarized sidewall is in liquid communication with the bottom of the cell.

In some embodiments, the polarized sidewall portion comprises: at least 50% of surface of the inner sidewall.

In some embodiments, the apparatus includes: a non-polarized sidewall portion, wherein both the polarized sidewall portion and the non-polarized sidewall portion are adjacent to each other and in liquid communication with the molten electrolyte bath.

In some embodiments, the non-polarized sidewall portion is positioned above the cathodically polarized sidewall and is in communication with the bath-air interface.

In some embodiments, the non-polarized sidewall portion is selected from the group consisting of: a thermal conductor; a stable material; a frozen ledge device, and combinations thereof.

In some embodiments, the non-polarized sidewall is configured to extend from the cell bottom to a height above a metal-to-bath interface, further wherein the non-polarized sidewall portion is configured adjacent to and in communication with the anodically polarized sidewall.

In some embodiments, the polarized sidewall portion comprises: an anodically polarized sidewall, wherein the anodically polarized sidewall is positioned above the bottom of the cell body and adjacent to the bath-vapor interface, such that the anodically polarized sidewall is in communication with the bath-vapor interface.

In one aspect of the instant disclosure, an electrolysis cell is provided, comprising: a cell body having a bottom and at least one sidewall, wherein the cell body is configured to retain a molten electrolyte bath, wherein the sidewall comprises: a first sidewall portion, configured to fit onto a thermal insulation package of the sidewall and retain the electrolyte, the first sidewall portion comprising an anodically polarized sidewall portion; and a second sidewall portion configured to extend up from the bottom of the cell body, wherein the second sidewall portion is longitudinally spaced from the first sidewall portion, such that the first sidewall portion, the second sidewall portion, and a base between the first portion and the second sidewall portion define a trough the trough having a width of 10 mm to not greater than 500 mm; wherein the trough is configured to receive a protecting deposit and retain the protecting deposit separate from the cell bottom.

In some embodiments, the second sidewall portion comprises a cathodically polarized sidewall.

In some embodiments, the second sidewall portion comprises a non-polarized sidewall including a stable material, wherein the stable material which includes a component of the bath chemistry further wherein, via the bath chemistry and percent saturation of the non-reactive material in the bath, the sidewall is substantially non-reactive in the molten salt electrolyte.

In some embodiments, the cell comprises a directing member, wherein the directing member is positioned between the anodically polarized sidewall and the second sidewall portion, further wherein the directing member is laterally spaced above the base of the trough, such that the directing member is configured to direct a feed material into the trough, to be retained therein as protecting deposit in the trough.

In some embodiments, the directing member comprises: an anodically polarized material; a stable material; a cathodically polarized material; and combinations thereof.

In one aspect of the instant disclosure, an assembly is provided, comprising: a cell body having a bottom and at least one sidewall, wherein the cell body is configured to retain a molten electrolyte bath, wherein the sidewall comprises: a first sidewall portion comprising an anodically polarized sidewall, wherein the anodically polarized sidewall is configured to fit onto a thermal insulation package of the sidewall and retain the electrolyte; and a second sidewall portion comprising a cathodically polarized sidewall, the cathodically polarized sidewall configured to extend up from the bottom of the cell body, wherein the cathodically polarized sidewall is longitudinally spaced from the anodically polarized sidewall, such that the anodically polarized sidewall and the cathodically polarized sidewall define a gap there between; and a non-polarized sidewall portion configured to fit in the gap between the anodically polarized sidewall and the cathodically polarized sidewall, wherein via the non-polarized sidewall portion, the anodically polarized sidewall is insulated from the cathodically polarized sidewall.

In one aspect, a method is provided, comprising: passing current from an anode through a molten electrolyte bath to a cathode in an electrolysis cell; feeding a feed material into the electrolysis cell at a location adjacent to a cell wall, such that the feed material is retained in a trough defined adjacent to the sidewall; and via the feeding step, maintaining the sidewall in the molten electrolyte during cell operation, wherein the sidewall is constructed of at least one component which is within about 95% of saturation in the molten electrolyte bath.

In some embodiments, the method includes: concomitant to the first step, maintaining the bath at a temperature not exceeding 980° C., wherein the sidewalls of the cells are substantially free of a frozen ledge.

In some embodiments, the method includes: consuming the protecting deposit such that via consumption of the protecting deposit, metal ions are supplied to the molten electrolyte bath.

In some embodiments, the method includes producing a metal product from the at least one bath component.

In one aspect of the instant disclosure, an electrolysis cell is provided, comprising: an anode; a cathode in spaced relation from the anode; a molten electrolyte bath in liquid communication with the anode and the cathode; a cell body comprising a sidewall and a bottom, wherein the cell body is configured to retain the molten electrolyte bath; wherein the sidewall comprises: a polarized sidewall portion wherein the polarized sidewall portion is in liquid communication with the molten electrolyte bath.

In one aspect of the instant disclosure, an electrolysis cell wall is provided, comprising: a cell body comprising a sidewall and a bottom, wherein the cell body is configured to retain a molten electrolyte bath; wherein the sidewall comprises: a polarized sidewall portion, wherein the polarized sidewall portion is configured to be in liquid communication with the molten electrolyte bath.

In one aspect of the instant disclosure, an electrolysis cell is provided, comprising: an anode; a cathode in spaced relation from the anode; a molten electrolyte bath in liquid communication with the anode and the cathode; a cell body comprising a sidewall and a bottom, wherein the cell body is configured to retain the molten electrolyte bath; wherein the sidewall comprises: a polarized sidewall portion and a non-polarized sidewall portion, wherein both the polarized sidewall portion and the non-polarized sidewall portion are adjacent to each other and in liquid communication with the molten electrolyte bath.

In one aspect of the instant disclosure, an electrolysis cell is provided, comprising: an anode; a cathode in spaced relation from the anode; a molten electrolyte bath in liquid communication with the anode and the cathode; a cell body comprising a sidewall and a bottom, wherein the cell body is configured to retain the molten electrolyte bath; wherein the sidewall comprises: a polarized sidewall portion comprising at least about 50% of the sidewall and a non-polarized sidewall portion, wherein both the polarized sidewall portion and the non-polarized sidewall portion are adjacent to each other and in liquid communication with the molten electrolyte bath.

In one aspect of the instant disclosure, an electrolysis cell sidewall is provided, comprising: a cell body comprising a sidewall and a bottom, wherein the cell body is configured to retain a molten electrolyte bath; wherein the sidewall comprises: a polarized sidewall portion (e.g. comprising from about 1% to about 100% of the sidewall), wherein the polarized sidewall portion is configured to be in liquid communication with the molten electrolyte bath.

In some embodiments, the polarized sidewall portion is selected from: an anodically polarized sidewall, a cathodically polarized sidewall, and combinations thereof.

In some embodiments, the non-polarized sidewall portion is selected from the group consisting essentially of: a thermal conductor; a stable material (non-reactive material); a frozen ledge device, and combinations thereof.

In some embodiments, the polarized sidewall comprises: a cathodic sidewall, wherein the cathodically polarized sidewall portion is positioned adjacent to and in communication with the bottom of the cell body (e.g. below the bath-vapor interface); further wherein the non-polarized sidewall portion is positioned above the cathodically polarized sidewall portion and is in communication with the bath-air interface.

In some embodiments, the polarized sidewall comprises an anodically polarized sidewall portion, wherein the anodic sidewall is positioned adjacent to and in communication with the bath-vapor interface and above the bottom of the cell body (e.g. above the bath-metal interface; or out of direct contact with a cathode block or a cathodic cell bottom); further wherein the non-polarized sidewall portion is positioned below the anodically polarized sidewall portion and is in communication with at least one of: (a) the bath-metal interface and (b) the cell bottom.

In one aspect of the instant disclosure, an electrolysis cell sidewall is provided, comprising: a cell body comprising a sidewall and a bottom, wherein the cell body is configured to retain a molten electrolyte bath; wherein the sidewall comprises: a polarized sidewall portion and a non-polarized sidewall portion, wherein both the polarized sidewall portion and the non-polarized sidewall portion are adjacent to each other and in liquid communication with the molten electrolyte bath.

In one aspect of the instant disclosure, an electrolysis cell is provided, comprising: an anode; a cathode in spaced relation from the anode; a molten electrolyte bath in liquid communication with the anode and the cathode; a cell body including: at least one sidewall and a bottom, wherein the cell body is configured to retain the molten electrolyte bath; wherein the sidewall comprises: an anodic polarized sidewall portion in liquid communication with the electrolyte bath, wherein the anodic polarized sidewall is positioned above and remote from the bottom of the cell body and in communication with the bath-to-air/vapor interface; and a non-polarized sidewall material adjacent to the anodic polarized sidewall portion and in liquid communication with at least one of: (a) a metal pad and (b) a cell bottom.

In some embodiments, non-polarized sidewall is configured to extend from the cell bottom to a height above a metal pad-to-bath interface.

In one aspect of the instant disclosure, an electrolysis sidewall is provided, comprising: a cell body including: at least one sidewall and a bottom, wherein the cell body is configured to retain a molten electrolyte bath; wherein the sidewall comprises: an anodic polarized sidewall portion in liquid communication with the electrolyte bath, wherein the anodic polarized sidewall is positioned above and remote from the bottom of the cell body in communication with the bath-to-vapor interface; and a non-polarized sidewall material adjacent to the anodic polarized sidewall portion and in liquid communication with at least one of: (a) a metal pad and (b) a cell bottom.

In one aspect of the instant disclosure, an electrolysis cell is provided, comprising: an anode; a cathode in spaced relation from the anode; a molten electrolyte bath in liquid communication with the anode and the cathode; a cell body including: at least one sidewall and a bottom, wherein the cell body is configured to retain the molten electrolyte bath; wherein the sidewall comprises: an anodic polarized sidewall portion in liquid communication with the electrolyte bath, wherein the anodic polarized sidewall is positioned above and remote from the bottom of the cell body in communication with the bath-to-air interface; and a non-polarized sidewall material comprising a thermal conductor adjacent to the anodic polarized sidewall portion and in liquid communication with at least one of: (a) a metal pad and (b) a cell bottom, wherein the thermal conductor is configured to accept heat from the molten electrolyte bath adjacent to a thermal conductor contact point, wherein, via the thermal conductor, a frozen ledge (e.g. localized) is formed between the thermal conductor and molten electrolyte bath along a portion of the sidewall. As a non-limiting example, the thermal conductor is configured to insulate the anodically polarized sidewall portion from the cathodic portion (e.g. metal pad, cathode, or cell bottom).

In one aspect of the instant disclosure, an electrolysis sidewall is provided, comprising: a cell body including: at least one sidewall and a bottom, wherein the cell body is configured to retain a molten electrolyte bath; wherein the sidewall comprises: an anodic polarized sidewall portion in liquid communication with the electrolyte bath, wherein the anodic polarized sidewall is positioned above and remote from the bottom of the cell body in communication with the bath-to-air interface; and a non-polarized sidewall material comprising a thermal conductor adjacent to the anodic polarized sidewall portion and in liquid communication with a cell bottom, wherein the thermal conductor is configured to accept heat from the molten electrolyte bath adjacent to a thermal conductor contact point, wherein, via the thermal conductor, a frozen ledge is formed between the thermal conductor and molten electrolyte bath along a portion of the sidewall.

In some embodiments, the metal product is drained from cell bottom.

In one aspect of the instant disclosure, an electrolysis cell is provided, comprising: an anode; a cathode in spaced relation from the anode; a molten electrolyte bath in liquid communication with the anode and the cathode; a cell body including: at least one sidewall and a bottom, wherein the cell body is configured to retain the molten electrolyte bath; wherein the sidewall comprises: an anodic polarized sidewall portion in liquid communication with the electrolyte bath, wherein the anodic polarized sidewall is positioned above and remote from the bottom of the cell body in communication with the bath-to-vapor interface; and a non-polarized sidewall portion adjacent to the anodic polarized sidewall portion and in liquid communication with at least one of: (a) a metal pad and (b) a cell bottom, wherein the non-polarized sidewall comprises a non-reactive material which is a component of the bath chemistry; further wherein, via the bath chemistry and percent saturation of the non-reactive material in the bath, the sidewall is substantially non-reactive with the molten salt electrolyte (e.g. during cell operation).

In one aspect of the instant disclosure, an electrolysis sidewall is provided, comprising: a cell body including: at least one sidewall and a bottom, wherein the cell body is configured to retain a molten electrolyte bath; wherein the sidewall comprises: an anodic polarized sidewall portion in liquid communication with the electrolyte bath, wherein the anodic polarized sidewall is positioned above and remote from the bottom of the cell body in communication with the bath-to-air interface; and a non-polarized sidewall portion adjacent to the anodic polarized sidewall portion and in liquid communication with at least one of: (a) a metal pad and (b) a cell bottom, wherein the non-polarized sidewall comprises a non-reactive material which is a component of the bath chemistry; further wherein, via the bath chemistry and percent saturation of the non-reactive material in the bath, the sidewall is substantially non-reactive with the molten salt electrolyte (e.g. during cell operation).

In some embodiments, the non-polarized sidewall portion (e.g. stable sidewall) is configured to extend out from the sidewall (e.g. sidewall profile) and provide a stepped configuration. In some embodiments, the cell is configured with a feeder, which provides a feed into the bath, which is retained along at least a portion of (e.g. along the top and/or side) of the stepped out portion of stable sidewall material. In some embodiments, the stable sidewall material is located adjacent to and in communication with the anodically polarized sidewall portion (i.e. such that the anodically polarized sidewall portion extends the entire length of the thermal insulation package, and the stable sidewall material is configured to fit over a portion of the anodically polarized sidewall portion in proximity to the metal pad and/or bath-metal pad interface). In some embodiments, the top surface of the stable sidewall material is flat. In some embodiments, the top portion/surface of the stable sidewall is sloped (e.g. towards the anodically polarized sidewall). In some embodiments, the sloped stable sidewall together with the anodically polarized sidewall to define a trough, which is configured to retain a protecting deposit therein. In some embodiments, the sloped stable sidewall is sloped towards the center of the cell/metal pad (away from the sidewall).

In one aspect, an electrolysis cell is provided, comprising: an anode; a cathode; a molten electrolyte bath in liquid communication with the anode and the cathode; a cell body including: at least one sidewall and a bottom, wherein the cell body is configured to retain the molten electrolyte bath; wherein the sidewall comprises: an anodic polarized sidewall portion in liquid communication with the electrolyte bath, wherein the anodic polarized sidewall is positioned above and remote from the bottom of the cell body in communication with the bath-to-air interface; and a non-polarized sidewall portion adjacent to the anodic polarized sidewall portion and in communication with at least one of: (a) a metal pad and (b) a cell bottom, wherein the non-polarized sidewall comprises a frozen ledge device: wherein, via the frozen ledge device, heat is extracted from the molten salt bath adjacent to the frozen ledge device to define a frozen ledge along a portion of the sidewall adjacent to the frozen ledge device.

In one aspect of the instant disclosure, an electrolysis sidewall is provided, comprising: a cell body including: at least one sidewall and a bottom, wherein the cell body is configured to retain a molten electrolyte bath; wherein the sidewall comprises: an anodic polarized sidewall portion in liquid communication with the electrolyte bath, wherein the anodic polarized sidewall is positioned above and remote from the bottom of the cell body in communication with the bath-to-vapor interface; and a non-polarized sidewall portion adjacent to the anodic polarized sidewall portion and in communication with a cell bottom, wherein the non-polarized sidewall comprises a frozen ledge device: wherein, via the frozen ledge device, heat is extracted from the molten salt bath adjacent to the frozen ledge device to define a frozen ledge along a portion of the sidewall adjacent to the frozen ledge device.

In some embodiments, the metal product is drained from cell.

In some embodiments, the frozen ledge device comprises: a body having an inlet and an outlet; a heat exchanger channel, wherein the heat exchanger channel extends along the inside of the body and in liquid communication with the inlet and the outlet; and a coolant, wherein the coolant travels along a flow path defined by the heat exchanger channel, the inlet, and the outlet.

In some embodiments, the channel comprises a plurality of expanded areas along the outer body wall, wherein the expanded areas are configured to provide increased surface area for heat transfer from the molten electrolyte bath into the coolant.

In some embodiments, the coolant is selected from: argon, nitrogen, and air.

In some embodiments, the expanded area further comprises a plurality of fins.

In some embodiments, the frozen ledge device extracts at least about 5 $kW/m^2$ heat flux from the electrolysis cell.

In some embodiments, the frozen ledge device further comprises a heat exchanger attached to the coolant outlet.

In some embodiments, the non-polarized sidewall portion is configured to maintain heat loss across the non-polarized sidewall portion to not greater than about 8 $KW/m^2$.

In one aspect of the instant disclosure, an electrolysis cell is provided, comprising: an anode; a cathode in spaced relation from the anode; a molten electrolyte bath in liquid communication with the anode and the cathode; a cell body having a bottom and at least one sidewall, wherein the cell body is configured to retain the molten electrolyte bath, wherein the sidewall comprises: a first sidewall portion, configured to fit onto a thermal insulation package of the sidewall and retain the electrolyte, the first sidewall portion comprising an anodic polarized sidewall portion; and a second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough; wherein the trough is configured to receive a protecting deposit and retain the protecting deposit separately from the cell bottom (e.g. metal pad).

In one aspect of the instant disclosure, an electrolysis cell sidewall is provided, comprising: a cell body having a bottom and at least one sidewall, wherein the cell body is configured to retain a molten electrolyte bath, wherein the sidewall comprises: a first sidewall portion, configured to fit onto a thermal insulation package of the sidewall and retain the electrolyte, the first sidewall portion comprising an anodic polarized sidewall portion; and a second sidewall portion configured to extend up from the bottom of the cell body, wherein the second sidewall portion is longitudinally spaced from the first sidewall portion, such that the first sidewall portion, the second sidewall portion, and a base between the first portion and the second sidewall portion define a trough; wherein the trough is configured to receive a protecting deposit and retain the protecting deposit separate from the cell bottom (e.g. metal pad).

In one aspect of the instant disclosure, an electrolysis cell is provided, comprising: an anode; a cathode in spaced relation from the anode; a molten electrolyte bath in liquid communication with the anode and the cathode; a cell body having a bottom and at least one sidewall, wherein the cell body is configured to retain the molten electrolyte bath, wherein the sidewall comprises: a first sidewall portion including an anodic polarized sidewall portion, configured to fit onto a thermal insulation package of the sidewall and retain the electrolyte; a second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough; wherein the trough is configured to receive a protecting deposit and retain the protecting deposit separate from the cell bottom (e.g. metal pad); and a directing member, wherein the directing member is positioned between the anodic sidewall portion and the second sidewall portion, further wherein the directing member is laterally spaced above the base of the trough, such that the directing member is configured to direct the protecting deposit into the trough.

In some embodiments, the directing member comprises an anodically polarized material. In some embodiments, the directing member comprises a non-reactive (e.g. stable) material. In some embodiments, the directing member comprises a cathodically polarized material.

In one aspect of the instant disclosure, an electrolysis cell is provided, comprising: an anode; a cathode in spaced relation from the anode; a molten electrolyte bath in liquid communication with the anode and the cathode; a cell body having a bottom and at least one sidewall, wherein the cell body is configured to retain the molten electrolyte bath, wherein the sidewall comprises: a first sidewall portion comprising an anodic polarized sidewall portion, configured to fit onto a thermal insulation package of the sidewall and retain the electrolyte; a second sidewall portion configured to extend up from the bottom of the cell body, wherein the second sidewall portion is longitudinally spaced from the first sidewall portion, such that the first sidewall portion and the second sidewall portion define a gap; and a thermal conductor configured to fit in the gap and extend between the first sidewall portion and the second sidewall portion; wherein thermal conductor is configured to accept heat from the molten electrolyte bath, wherein, via a heat transfer from the molten electrolyte bath through the sidewall from the thermal conductor, a frozen ledge is formed between the thermal conductor and molten electrolyte, which spans the gap between the first sidewall portion and the second sidewall portion.

In one aspect of the instant disclosure, an electrolysis cell assembly is provided, comprising: a cell body having a bottom and at least one sidewall, wherein the cell body is configured to retain a molten electrolyte bath, wherein the sidewall comprises: a first sidewall portion comprising an anodic polarized sidewall portion, configured to fit onto a thermal insulation package of the sidewall and retain the electrolyte; a second sidewall portion configured to extend up from the bottom of the cell body, wherein the second sidewall portion is longitudinally spaced from the first sidewall portion, such that the first sidewall portion and the second sidewall portion define a gap; and a thermal conductor configured to fit in the gap and extend between the first sidewall portion and the second sidewall portion; wherein the thermal conductor is configured to accept heat from the molten electrolyte bath, wherein, via a heat transfer from the molten electrolyte bath through the sidewall from the thermal conductor, a frozen ledge is formed between the thermal conductor and molten electrolyte, which spans the gap between the first sidewall portion and the second sidewall portion.

In one aspect of the instant disclosure, an electrolysis cell is provided, comprising: an anode; a cathode in spaced relation from the anode; a molten electrolyte bath in liquid communication with the anode and the cathode; a cell body having a bottom and at least one sidewall, wherein the cell body is configured to retain the molten electrolyte bath, wherein the sidewall comprises: a first sidewall portion comprising an anodic polarized sidewall portion, configured to fit onto a thermal insulation package of the sidewall and retain the electrolyte; a second sidewall portion configured to extend up from the bottom of the cell body, wherein the second sidewall portion is longitudinally spaced from the first sidewall portion, such that the first sidewall portion and the second sidewall portion define a gap; and a frozen ledge device configured to fit in the gap between the first sidewall portion and the second sidewall portion, wherein via the frozen ledge device, heat is extracted from the molten electrolyte bath to define a frozen ledge along the frozen ledge device extending between the first sidewall portion and the second sidewall portion.

In one aspect of the instant disclosure, an electrolysis cell assembly is provided, comprising: a cell body having a bottom and at least one sidewall, wherein the cell body is configured to retain a molten electrolyte bath, wherein the sidewall comprises: a first sidewall portion comprising an anodic polarized sidewall portion, configured to fit onto a thermal insulation package of the sidewall and retain the electrolyte; a second sidewall portion configured to extend up from the bottom of the cell body, wherein the second sidewall portion is longitudinally spaced from the first sidewall portion, such that the first sidewall portion and the second sidewall portion define a gap; and a frozen ledge device configured to fit in the gap between the first sidewall portion and the second sidewall portion, wherein via the frozen ledge device, heat is extracted from the molten electrolyte bath to define a frozen ledge along the frozen ledge device extending between the first sidewall portion and the second sidewall portion.

In one aspect of the instant disclosure, an electrolysis cell is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom; wherein the sidewall comprises: a cathodically polarized sidewall portion in liquid communication with the molten electrolyte, wherein the cathodically polarized sidewall is positioned adjacent to and in communication with the bottom of the cell body (e.g. across the bath-metal interface) and extends above the bath-vapor interface. In this embodiment, the cathodic sidewall has a localized frozen ledge where the cathodic sidewall portion extends above the bath-vapor interface.

In one aspect of the instant disclosure, an electrolysis cell is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom;

wherein the sidewall comprises: a cathodically polarized sidewall portion in liquid communication with the molten electrolyte, wherein the cathodically polarized sidewall is positioned adjacent to and in communication with the bottom of the cell body (e.g. across the bath-metal interface); and a non-polarized sidewall portion adjacent to and in communication with the cathodically polarized sidewall portion, wherein the non-polarized sidewall portion is located adjacent to and in communication with the bath-air interface.

In some embodiments, the sidewall comprises a portion of thermally conductive material along the bath-to-air interface to remove heat from the bath and/or create a frozen portion along the bath-to-air interface.

In some embodiments, the sidewall comprises a portion of refractory wall adjacent to/on top of the thermally conductive material.

In one aspect of the instant disclosure, an electrolysis cell assembly is provided, comprising: a cell body configured to retain a molten electrolyte bath, wherein the cell body comprises: at least one sidewall and a bottom; wherein the sidewall comprises: a cathodically polarized sidewall portion in liquid communication with the molten electrolyte, wherein the cathodically polarized sidewall is positioned adjacent to and in communication with the bottom of the cell body (e.g. across the bath-metal interface); and a non-polarized sidewall portion adjacent to and in communication with the cathodically polarized sidewall portion, wherein the non-polarized sidewall portion is located adjacent to and in communication with the bath-vapor interface.

In one aspect of the instant disclosure, an electrolysis cell is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom; wherein the sidewall comprises: a cathodically polarized sidewall portion in liquid communication with the molten electrolyte bath, wherein the cathodically polarized sidewall is positioned adjacent to and in communication with the bottom of the cell body (e.g. across the bath-metal interface); and a non-polarized sidewall portion adjacent to and in communication with the cathodically polarized sidewall portion, wherein the non-polarized sidewall portion is located adjacent to and in communication with the bath-air interface, wherein the non-polarized sidewall comprises a non-reactive material which is a component of the bath chemistry further wherein, via the bath chemistry and percent saturation of the non-reactive material in the bath, the sidewall is substantially non-reactive with the molten salt electrolyte (e.g. during cell operation).

In some embodiments, the non-polarized sidewall (stable sidewall/first sidewall portion) extends the entire length of the thermal insulation package (i.e. to the cell bottom) and the cathodic sidewall is configured to attach immediately adjacent to and in communication with the stable sidewall material, such that the cathodic sidewall is in liquid communication with at least one of (1) the metal pad; and (2) the bath-metal pad interface. In some embodiments, the cathodic sidewall has a flat top portion. In some embodiments, the cathodic sidewall has a sloped top portion (i.e. sloped towards the stable sidewall to define a recessed area/trough therein). In some embodiments, the cathodic sidewall has a sloped top portion (i.e. sloped towards the metal pad/canter of the cell (to assist in draining metal product to the bottom of the cell). In some embodiments, the cell further comprises a feeder, which is configured to provide a feed to the cell, which is retained in the sloped top portion of the cathodic sidewall as a protecting deposit.

In one aspect of the instant disclosure, an electrolysis cell assembly is provided, comprising: a cell body configured to retain a molten electrolyte bath, wherein the cell body comprises: at least one sidewall and a bottom; wherein the sidewall comprises: a cathodically polarized sidewall portion in liquid communication with the molten electrolyte bath, wherein the cathodically polarized sidewall is positioned adjacent to and in communication with the bottom of the cell body (e.g. across the bath-metal interface); and a non-polarized sidewall portion adjacent to and in communication with the cathodically polarized sidewall portion, wherein the non-polarized sidewall portion is located adjacent to and in communication with the bath-vapor interface, wherein the non-polarized sidewall comprises a non-reactive material which is a component of the bath chemistry further wherein, via the bath chemistry and percent saturation of the non-reactive material in the bath, the sidewall is substantially non-reactive with the molten salt electrolyte (e.g. during cell operation).

In one aspect of the instant disclosure, an electrolysis cell is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom; wherein the sidewall comprises: a cathodically polarized sidewall portion in liquid communication with the electrolyte bath, wherein the cathodically polarized sidewall is positioned adjacent to and in communication with the bottom of the cell body (e.g. across the bath-metal interface); and a non-polarized sidewall portion adjacent to and in communication with the cathodically polarized sidewall portion, wherein the non-polarized sidewall portion is located adjacent to and in communication with the bath-air interface, wherein the non-polarized sidewall comprises a frozen ledge device, wherein, via the frozen ledge device, heat is extracted from the molten salt bath adjacent to the frozen ledge device to define a frozen ledge along a portion of the sidewall adjacent to the frozen ledge device.

In one aspect of the instant disclosure, an assembly is provided, comprising: a cell body configured to retain a molten electrolyte bath, wherein the cell body comprises: at least one sidewall and a bottom; wherein the sidewall comprises: a cathodically polarized sidewall portion in liquid communication with the electrolyte bath, wherein the cathodically polarized sidewall is positioned adjacent to and in communication with the bottom of the cell body (e.g. across the bath-metal interface); and a non-polarized sidewall portion adjacent to and in communication with the cathodically polarized sidewall portion, wherein the non-polarized sidewall portion is located adjacent to and in communication with the bath-air interface, wherein the non-polarized sidewall comprises a frozen ledge device, wherein, via the frozen ledge device, heat is extracted from the molten salt bath adjacent to the frozen ledge device to define a frozen ledge along a portion of the sidewall adjacent to the frozen ledge device.

In one aspect of the instant disclosure, an electrolysis cell is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom; wherein the sidewall comprises: a cathodically polarized sidewall portion in liquid communication with the electrolyte bath, wherein the cathodically polarized sidewall is positioned adjacent to and in communication with the bottom of the cell body (e.g. across the bath-metal interface, in communication with the metal pad); and a non-polarized sidewall portion adjacent to and in communication with the cathodically polarized sidewall portion, wherein the non-polarized sidewall portion is located adjacent to and in communication with the bath-air interface, wherein the non-polarized sidewall comprises a thermal conductor adjacent to the cathodically polarized sidewall portion and in communication with the bath-air interface, wherein the thermal conductor is configured to transfer heat from the molten electrolyte bath wherein, via the thermal conductor, a frozen ledge is defined along the thermal conductor portion of the sidewall.

In one aspect of the instant disclosure, an assembly is provided, comprising: a cell body configured to retain a molten electrolyte bath, wherein the cell body comprises: at least one sidewall and a bottom; wherein the sidewall comprises: a cathodically polarized sidewall portion in liquid communication with the electrolyte bath, wherein the cathodically polarized sidewall is positioned adjacent to and in communication with the bottom of the cell body (e.g. across the bath-metal interface, in communication with the metal pad); and a non-polarized sidewall portion adjacent to and in communication with the cathodically polarized sidewall portion, wherein the non-polarized sidewall portion is located adjacent to and in communication with the bath-air interface, wherein the non-polarized sidewall comprises a thermal conductor adjacent to the cathodically polarized sidewall portion and in communication with the bath-air interface, wherein the thermal conductor is configured to transfer heat from the molten electrolyte bath wherein, via the thermal conductor, a frozen ledge is defined along the thermal conductor portion of the sidewall.

In one aspect of the instant disclosure, an electrolysis cell is provided, comprising: an anode; a cathode in spaced relation from the anode; an electrolyte bath in liquid communication with the anode and the cathode; a cell body having a bottom and at least one sidewall, wherein the cell body is configured to retain the molten electrolyte bath, wherein the sidewall comprises: a first sidewall portion, configured to fit onto a thermal insulation package of the sidewall and retain the electrolyte, the first sidewall portion comprising non-polarized sidewall portion; and a second sidewall portion comprising a cathodically polarized sidewall, the second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough; wherein the trough is configured to receive a protecting deposit and retain the protecting deposit separately from the cell bottom (e.g. metal pad).

In one aspect of the instant disclosure, an assembly is provided, comprising: a cell body having a bottom and at least one sidewall, wherein the cell body is configured to retain a molten electrolyte bath, wherein the sidewall comprises: a first sidewall portion, configured to fit onto a thermal insulation package of the sidewall and retain the electrolyte, the first sidewall portion comprising non-polarized sidewall portion; and a second sidewall portion comprising a cathodically polarized sidewall, the second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough; wherein the trough is configured to receive a protecting deposit and retain the protecting deposit separately from the cell bottom (e.g. metal pad).

In one aspect of the instant disclosure, an electrolysis cell is provided, comprising: an anode; a cathode in spaced relation from the anode; an electrolyte bath in liquid communication with the anode and the cathode; a cell body having a bottom and at least one sidewall, wherein the cell body is configured to retain the molten electrolyte bath, wherein the sidewall comprises: a first sidewall portion, configured to fit onto a thermal insulation package of the sidewall and retain the electrolyte, the first sidewall portion comprising a non-polarized sidewall portion; and a second sidewall portion comprising a cathodically polarized sidewall, the second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough; wherein the trough is configured to receive a protecting deposit and retain the protecting deposit separate from the bottom of the cell body (e.g. metal pad); and a directing member, wherein the directing member is positioned between the second sidewall portion (e.g. cathodic sidewall portion) and the first sidewall portion (e.g. non-polarized sidewall portion), further wherein the directing member is laterally spaced above the base of the trough, such that the directing member is configured to direct the protecting deposit into the trough.

In one aspect of the instant disclosure, an assembly is provided, comprising: a cell body having a bottom and at least one sidewall, wherein the cell body is configured to retain a molten electrolyte bath, wherein the sidewall comprises: a first sidewall portion, configured to fit onto a thermal insulation package of the sidewall and retain the electrolyte, the first sidewall portion comprising a non-polarized sidewall portion; and a second sidewall portion comprising a cathodically polarized sidewall, the second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough; wherein the trough is configured to receive a protecting deposit and retain the protecting deposit separate from the bottom of the cell body (e.g. metal pad); and a directing member, wherein the directing member is positioned between the second sidewall portion (e.g. cathodic sidewall portion) and the first sidewall portion (e.g. non-polarized sidewall portion), further wherein the directing member is laterally spaced above the base of the trough, such that the directing member is configured to direct the protecting deposit into the trough.

In one aspect of the instant disclosure, an electrolysis cell is provided, comprising: an anode; a cathode in spaced relation from the anode; an electrolyte bath in liquid communication with the anode and the cathode; a cell body having a bottom and at least one sidewall, wherein the cell body is configured to retain the molten electrolyte bath, wherein the sidewall comprises: a first sidewall portion, configured to fit onto a thermal insulation package of the sidewall and retain the electrolyte, the first sidewall portion comprising a non-polarized sidewall portion; and a second sidewall portion comprising a cathodically polarized sidewall, the second sidewall portion configured to extend up from the bottom of the cell body, wherein the second sidewall portion is longitudinally spaced from the first sidewall portion, such that the first sidewall portion and the second sidewall portion define a gap; and a thermal conductor configured to fit in the gap and extend between the first sidewall portion and the second sidewall portion; wherein thermal conductor is configured to transfer heat from the molten electrolyte bath to define via the thermal conductor, a frozen ledge between the first sidewall portion and the second sidewall portion along the thermal conductor.

In one aspect of the instant disclosure, an assembly is provided, comprising: a cell body having a bottom and at least one sidewall, wherein the cell body is configured to retain the molten electrolyte bath, wherein the sidewall comprises: a first sidewall portion, configured to fit onto a thermal insulation package of the sidewall and retain the electrolyte, the first sidewall portion comprising a non-polarized sidewall portion; and a second sidewall portion comprising a cathodically polarized sidewall, the second sidewall portion configured to extend up from the bottom of the cell body, wherein the second sidewall portion is longitudinally spaced from the first sidewall portion, such that the first sidewall portion and the second sidewall portion define a gap; and a thermal conductor configured to fit in the gap and extend between the first sidewall portion and the second sidewall portion; wherein thermal conductor is configured to transfer heat from the molten electrolyte bath to define via the thermal conductor, a frozen ledge between the first sidewall portion and the second sidewall portion along the thermal conductor.

In one aspect of the instant disclosure, an electrolysis cell is provided, comprising: an anode; a cathode in spaced relation from the anode; a molten electrolyte bath in liquid communication with the anode and the cathode; a cell body having a bottom and at least one sidewall, wherein the cell body is configured to retain the molten electrolyte bath, wherein the sidewall comprises: a first sidewall portion, configured to fit onto a thermal insulation package of the sidewall and retain the electrolyte, the first sidewall portion comprising a non-polarized sidewall portion; a second sidewall portion comprising a cathodically polarized sidewall, the second sidewall portion configured to extend up from the bottom of the cell body, wherein the second sidewall portion is longitudinally spaced from the first sidewall portion, such that the first sidewall portion and the second sidewall portion define a gap; and a frozen ledge device configured to fit in the gap between the first sidewall portion and the second sidewall portion, wherein via the frozen ledge device, heat is extracted from the molten salt bath adjacent to the frozen ledge device to define a frozen ledge along a portion of the sidewall between the first sidewall portion and the second sidewall portion.

In one aspect of the instant disclosure, an assembly is provided, comprising: a cell body having a bottom and at least one sidewall, wherein the cell body is configured to retain a molten electrolyte bath, wherein the sidewall comprises: a first sidewall portion, configured to fit onto a thermal insulation package of the sidewall and retain the electrolyte, the first sidewall portion comprising a non-polarized sidewall portion; a second sidewall portion comprising a cathodically polarized sidewall, the second sidewall portion configured to extend up from the bottom of the cell body, wherein the second sidewall portion is longitudinally spaced from the first sidewall portion, such that the first sidewall portion and the second sidewall portion define a gap; and a frozen ledge device configured to fit in the gap between the first sidewall portion and the second sidewall portion, wherein via the frozen ledge device, heat is extracted from the molten salt bath adjacent to the frozen ledge device to define a frozen ledge along a portion of the sidewall between the first sidewall portion and the second sidewall portion.

In one aspect of the instant disclosure, an electrolysis cell is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom; wherein the sidewall comprises: an anodically polarized sidewall portion positioned at or above the metal pad-to-bath interface; a cathodically polarized sidewall portion positioned at or below the metal-to-bath interface; and a portion of non-polarized sidewall portion extending between the anodically polarized sidewall portion and the cathodically polarized sidewall portion, wherein the non-polarized sidewall portion comprises an insulator configured to electrically insulate the anodic sidewall from the cathodic sidewall.

In one aspect of the instant disclosure, an assembly is provided, comprising: a cell body configured to retain a molten electrolyte bath, wherein the cell body comprises: at least one sidewall and a bottom; wherein the sidewall comprises: an anodically polarized sidewall portion positioned at or above the metal pad-to-bath interface; a cathodically polarized sidewall portion positioned at or below the metal-to-bath interface; and a portion of non-polarized sidewall portion extending between the anodically polarized sidewall portion and the cathodically polarized sidewall portion, wherein the non-polarized sidewall portion comprises an insulator configured to electrically insulate the anodic sidewall from the cathodic sidewall.

In one aspect of the instant disclosure, an electrolysis cell is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom; wherein the side comprises: an anodically polarized sidewall portion positioned across the vapor-to-bath interface; a cathodically polarized sidewall portion positioned below the vapor-to-bath interface (e.g. at the bath-to-metal interface); and a non-polarized sidewall portion extending between the anodically polarized sidewall portion and the cathodically polarized sidewall portion, wherein the non-polarized sidewall portion comprises an insulator.

In one aspect of the instant disclosure, an assembly is provided, comprising: a cell body configured to retain a molten electrolyte bath, wherein the cell body comprises: at least one sidewall and a bottom; wherein the side comprises: an anodically polarized sidewall portion positioned across the vapor-to-bath interface; a cathodically polarized sidewall portion positioned below the vapor-to-bath interface (e.g. at the bath-to-metal interface); and a non-polarized sidewall portion extending between the anodically polarized sidewall portion and the cathodically polarized sidewall portion, wherein the non-polarized sidewall portion comprises an insulator.

In one aspect of the instant disclosure, an electrolysis cell assembly is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom; wherein the side comprises: an anodically polarized sidewall portion positioned across the vapor-to-bath interface; a cathodically polarized sidewall portion positioned below the vapor-to-bath interface (e.g. at the bath-to-metal interface); and a non-polarized sidewall portion comprising a thermal conductor, wherein the thermal conductor is configured to extend between the anodically polarized sidewall portion and the cathodically polarized sidewall portion, wherein the thermal conductor is configured to transfer heat from the molten electrolyte bath wherein via the thermal conductor, a frozen ledge is formed between the anodically polarized sidewall and the cathodically polarized sidewall, adjacent to and along the surface of the thermal conductor.

In one aspect of the instant disclosure, an assembly is provided, comprising: a cell body configured to retain a molten electrolyte bath, wherein the cell body comprises: at least one sidewall and a bottom; wherein the side comprises: an anodically polarized sidewall portion positioned across the vapor-to-bath interface; a cathodically polarized sidewall portion positioned below the vapor-to-bath interface (e.g. at the bath-to-metal interface); and a non-polarized sidewall portion comprising a thermal conductor, wherein the thermal conductor is configured to extend between the anodically polarized sidewall portion and the cathodically polarized sidewall portion, wherein the thermal conductor is configured to transfer heat from the molten electrolyte bath wherein via the thermal conductor, a frozen ledge is formed between the anodically polarized sidewall and the cathodically polarized sidewall, adjacent to and along the surface of the thermal conductor.

In one aspect of the instant disclosure, an electrolysis cell is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom; wherein the side comprises: an anodically polarized sidewall portion positioned across the vapor-to-bath interface; a cathodically polarized sidewall portion positioned below the vapor-to-bath interface (e.g. at the bath-to-metal interface); and a non-polarized sidewall portion extending between the anodically polarized sidewall portion and the cathodically polarized sidewall portion, wherein the non-polarized sidewall comprises a frozen ledge device, wherein, via the frozen ledge device, heat is extracted from the molten electrolyte bath (e.g. adjacent to the frozen ledge device) wherein, via the frozen ledge device, a frozen ledge is defined between the anodically polarized sidewall portion and the cathodically polarized sidewall portion.

In one aspect of the instant disclosure, an assembly is provided, comprising: a cell body configured to retain a molten electrolyte bath, wherein the cell body comprises: at least one sidewall and a bottom; wherein the side comprises: an anodically polarized sidewall portion positioned across the vapor-to-bath interface; a cathodically polarized sidewall portion positioned below the vapor-to-bath interface (e.g. at the bath-to-metal interface); and a non-polarized sidewall portion extending between the anodically polarized sidewall portion and the cathodically polarized sidewall portion, wherein the non-polarized sidewall comprises a frozen ledge device, wherein, via the frozen ledge device, heat is extracted from the molten electrolyte bath (e.g. adjacent to the frozen ledge device) wherein, via the frozen ledge device, a frozen ledge is defined between the anodically polarized sidewall portion and the cathodically polarized sidewall portion.

In one aspect of the instant disclosure, an electrolysis cell is provided, comprising: an anode; a cathode in spaced relation from the anode; a molten electrolyte bath in liquid communication with the anode and the cathode; a cell body configured to retain the molten electrolyte bath, wherein the cell body comprises: at least one sidewall and a bottom; wherein the side comprises: an anodically polarized sidewall portion positioned across the vapor-to-bath interface; a cathodically polarized sidewall portion positioned below the vapor-to-bath interface (e.g. at the bath-to-metal interface); and a non-polarized sidewall portion extending between the anodically polarized sidewall portion and the cathodically polarized sidewall portion, wherein the non-polarized sidewall comprises a non-reactive sidewall material which is a component of the bath chemistry, further wherein, via the bath chemistry and percent saturation of the non-reactive material in the bath, the non-reactive sidewall material is substantially non-reactive with the molten salt electrolyte (e.g. during cell operation).

In one aspect of the instant disclosure, an assembly is provided, comprising: a cell body configured to retain a molten electrolyte bath, wherein the cell body comprises: at least one sidewall and a bottom; wherein the side comprises: an anodically polarized sidewall portion positioned across the air-to-bath interface; a cathodically polarized sidewall portion positioned below the air-to-bath interface (e.g. at the bath-to-metal interface); and a non-polarized sidewall portion extending between the anodically polarized sidewall portion and the cathodically polarized sidewall portion, wherein the non-polarized sidewall comprises a non-reactive sidewall material which is a component of the bath chemistry, further wherein, via the bath chemistry and percent saturation of the non-reactive material in the bath, the non-reactive sidewall material is substantially non-reactive with the molten salt electrolyte (e.g. during cell operation).

In one aspect of the instant disclosure, an electrolysis cell is provided, comprising: an anode; a cathode in spaced relation from the anode; an electrolyte bath in liquid communication with the anode and the cathode; a cell body having a bottom and at least one sidewall, wherein the cell body is configured to retain the molten electrolyte bath, wherein the sidewall comprises: a first sidewall portion comprising an anodic sidewall, wherein the anodic sidewall is configured to fit onto a thermal insulation package of the sidewall and retain the electrolyte; a second sidewall portion comprising a cathodic sidewall, the cathodic sidewall configured to extend up from the bottom of the cell body, wherein the cathodic sidewall is longitudinally spaced from the anodic sidewall, such that the anodic sidewall and the cathodic sidewall define a gap there between; and a non-polarized portion comprising an insulator located in the gap and extending between the anodic sidewall and the cathodic sidewall, wherein the insulator is configured to electrically insulate the anodic sidewall from the cathodic sidewall.

In one aspect of the instant disclosure, an assembly is provided, comprising: a cell body having a bottom and at least one sidewall, wherein the cell body is configured to retain a molten electrolyte bath, wherein the sidewall comprises: a first sidewall portion comprising an anodic sidewall, wherein the anodic sidewall is configured to fit onto a thermal insulation package of the sidewall and retain the electrolyte; a second sidewall portion comprising a cathodic sidewall, the cathodic sidewall configured to extend up from the bottom of the cell body, wherein the cathodic sidewall is longitudinally spaced from the anodic sidewall, such that the anodic sidewall and the cathodic sidewall define a gap there between; and a non-polarized portion comprising an insulator located in the gap and extending between the anodic sidewall and the cathodic sidewall, wherein the insulator is configured to electrically insulate the anodic sidewall from the cathodic sidewall.

In one aspect of the instant disclosure, an electrolysis cell is provided, comprising: an anode; a cathode in spaced relation from the anode; a molten electrolyte bath in liquid communication with the anode and the cathode; a cell body having a bottom and at least one sidewall, wherein the cell body is configured to retain the molten electrolyte bath, wherein the sidewall comprises: a first sidewall portion comprising an anodic sidewall, wherein the anodic sidewall is configured to fit onto a thermal insulation package of the sidewall and retain the electrolyte; and a second sidewall portion comprising a cathodic sidewall, the cathodic sidewall configured to extend up from the bottom of the cell body, wherein the cathodic sidewall is longitudinally spaced from the anodic sidewall, such that the anodic sidewall, the cathodic sidewall, and a base between the anodic sidewall and the cathodic sidewall define a trough; wherein the trough is configured to receive a protecting deposit and retain the protecting deposit separately from the cell bottom (e.g. metal pad).

In one aspect of the instant disclosure, an assembly is provided, comprising: a cell body having a bottom and at least one sidewall, wherein the cell body is configured to retain a molten electrolyte bath, wherein the sidewall comprises: a first sidewall portion comprising an anodic sidewall, wherein the anodic sidewall is configured to fit onto a thermal insulation package of the sidewall and retain the electrolyte; and a second sidewall portion comprising a cathodic sidewall, the cathodic sidewall configured to extend up from the bottom of the cell body, wherein the cathodic sidewall is longitudinally spaced from the anodic sidewall, such that the anodic sidewall, the cathodic sidewall, and a base between the anodic sidewall and the cathodic sidewall define a trough; wherein the trough is configured to receive a protecting deposit and retain the protecting deposit separately from the cell bottom (e.g. metal pad).

In one aspect of the instant disclosure, an electrolysis cell is provided, comprising: an anode; a cathode in spaced relation from the anode; a molten electrolyte bath in liquid communication with the anode and the cathode; a cell body having a bottom and at least one sidewall, wherein the cell body is configured to retain the molten electrolyte bath, wherein the sidewall comprises: a first sidewall portion comprising an anodic sidewall, wherein the anodic sidewall is configured to fit onto a thermal insulation package of the sidewall and retain the electrolyte; and a second sidewall portion comprising a cathodic sidewall, the cathodic sidewall configured to extend up from the bottom of the cell body, wherein the cathodic sidewall is longitudinally spaced from the anodic sidewall, such that the anodic sidewall, the cathodic sidewall, and a base between the anodic sidewall and the cathodic sidewall define a trough; wherein the trough is configured to receive a protecting deposit and retain the protecting deposit separately from the cell bottom (e.g. metal pad); and a directing member, wherein the directing member is positioned between the cathodic sidewall and the anodic sidewall, further wherein the directing member is laterally spaced above the base of the such that the directing member is configured to direct the protecting deposit into the trough.

In one aspect of the instant disclosure, an assembly is provided, comprising: a cell body having a bottom and at least one sidewall, wherein the cell body is configured to retain the molten electrolyte bath, wherein the sidewall comprises: a first sidewall portion comprising an anodic sidewall, wherein the anodic sidewall is configured to fit onto a thermal insulation package of the sidewall and retain the electrolyte; and a second sidewall portion comprising a cathodic sidewall, the cathodic sidewall configured to extend up from the bottom of the cell body, wherein the cathodic sidewall is longitudinally spaced from the anodic sidewall, such that the anodic sidewall, the cathodic sidewall, and a base between the anodic sidewall and the cathodic sidewall define a trough; wherein the trough is configured to receive a protecting deposit and retain the protecting deposit separately from the cell bottom (e.g. metal pad); and a directing member, wherein the directing member is positioned between the cathodic sidewall and the anodic sidewall, further wherein the directing member is laterally spaced above the base of the such that the directing member is configured to direct the protecting deposit into the trough.

In one aspect of the instant disclosure, an electrolysis cell is provided, comprising: an anode; a cathode in spaced relation from the anode; a molten electrolyte bath in liquid communication with the anode and the cathode; a cell body having a bottom and at least one sidewall, wherein the cell body is configured to retain the molten electrolyte bath, wherein the sidewall comprises: a first sidewall portion comprising an anodic sidewall, wherein the anodic sidewall is configured to fit onto a thermal insulation package of the sidewall and retain the electrolyte; and a second sidewall portion comprising a cathodic sidewall, the cathodic sidewall configured to extend up from the bottom of the cell body, wherein the cathodic sidewall is longitudinally spaced from the anodic sidewall, such that the anodic sidewall and the cathodic sidewall define a gap there between; and a non-polarized portion comprising a frozen ledge device located in the gap and extending between the anodic sidewall and the cathodic sidewall, wherein the frozen ledge device is configured to fit in the gap between the anodic sidewall and the cathodic sidewall, wherein via the frozen ledge device, heat is extracted from the molten salt bath to define a frozen ledge along the gap between the first sidewall portion and the second sidewall portion.

In one aspect of the instant disclosure, an assembly is provided, comprising: a cell body having a bottom and at least one sidewall, wherein the cell body is configured to retain a molten electrolyte bath, wherein the sidewall comprises: a first sidewall portion comprising an anodic sidewall, wherein the anodic sidewall is configured to fit onto a thermal insulation package of the sidewall and retain the electrolyte; and a second sidewall portion comprising a cathodic sidewall, the cathodic sidewall configured to extend up from the bottom of the cell body, wherein the cathodic sidewall is longitudinally spaced from the anodic sidewall, such that the anodic sidewall and the cathodic sidewall define a gap there between; and a non-polarized portion comprising a frozen ledge device located in the gap and extending between the anodic sidewall and the cathodic sidewall, wherein the frozen ledge device is configured to fit in the gap between the anodic sidewall and the cathodic sidewall, wherein via the frozen ledge device, heat is extracted from the molten salt bath to define a frozen ledge along the gap between the first sidewall portion and the second sidewall portion.

In one aspect of the instant disclosure, an electrolysis cell is provided, comprising: an anode; a cathode in spaced relation from the anode; a molten electrolyte bath in liquid communication with the anode and the cathode; a cell body having a bottom and at least one sidewall, wherein the cell body is configured to retain the molten electrolyte bath, wherein the sidewall comprises: a first sidewall portion comprising an anodic sidewall, wherein the anodic sidewall is configured to fit onto a thermal insulation package of the sidewall and retain the electrolyte; and a second sidewall portion comprising a cathodic sidewall, the cathodic sidewall configured to extend up from the bottom of the cell body, wherein the cathodic sidewall is longitudinally spaced from the anodic sidewall, such that the anodic sidewall and the cathodic sidewall define a gap there between; and a non-polarized portion comprising a thermal conductor, wherein the thermal conductor is configured to fit in the gap between the anodic sidewall and the cathodic sidewall, wherein via the thermal conductor, heat is extracted from the molten salt bath adjacent to the thermal conductor to define a frozen ledge along the gap between the anodic sidewall and the cathodic sidewall.

In one aspect of the instant disclosure, an assembly is provided, comprising: a cell body having a bottom and at least one sidewall, wherein the cell body is configured to retain a molten electrolyte bath, wherein the sidewall comprises: a first sidewall portion comprising an anodic sidewall, wherein the anodic sidewall is configured to fit onto a thermal insulation package of the sidewall and retain the electrolyte; and a second sidewall portion comprising a cathodic sidewall, the cathodic sidewall configured to extend up from the bottom of the cell body, wherein the cathodic sidewall is longitudinally spaced from the anodic sidewall, such that the anodic sidewall and the cathodic sidewall define a gap there between; and a non-polarized portion comprising a thermal conductor, wherein the thermal conductor is configured to fit in the gap between the anodic sidewall and the cathodic sidewall, wherein via the thermal conductor, heat is extracted from the molten salt bath adjacent to the thermal conductor to define a frozen ledge along the gap between the anodic sidewall and the cathodic sidewall.

In some embodiments, the bath comprises a feed material (e.g. alumina) at a content above its saturation limit (e.g. such that there is particulate present in the bath).

In some embodiments, the bath component (e.g. alumina) comprises an average bath content of: within about 2% of saturation; within about 1.5% of saturation; within about 1% of saturation; within about 0.5% of saturation; at saturation; or above saturation (e.g. undissolved particulate of the bath component is present in the bath).

In some embodiments, the saturation of the bath component is: at least about 95% of saturation; at least about 96% of saturation; at least about 97% of saturation; at least about 98% of saturation; at least about 99% of saturation; at 100% of saturation; or above saturation (e.g. undissolved particulate of the bath component is present in the bath).

In some embodiments, the saturation of the bath component is: not greater than about 95% of saturation; not greater than about 96% of saturation; not greater than about 97% of saturation; not greater than about 98% of saturation; not greater than about 99% of saturation; or not greater than 100% of saturation.

In some embodiments, the sidewall constituent comprises a percentage of saturation above a certain threshold of saturation in the electrolyte bath (e.g. with cell operating parameters).

In some embodiments (e.g. where the sidewall constituent is alumina), alumina saturation (i.e. average saturation %) is analytically determined via a LECO analysis. In some embodiments, (i.e. where the sidewall constituent is other than alumina, e.g. Li, Na, K, Rb, Cs, Be, Mg, Ca, Sr, Ba, Sc, Y, La, and Ce), the average saturation % is quantified by AA, ICP, XRF, and/or combinations thereof, along with other commonly accepted analytical methodologies. In some embodiments, the analytical methods of determining the saturation % of stable material includes a calibration error associated with the analytical method (e.g. LECO measurement has an error rate of generally +/−5%).

In some embodiments, the sidewall constituent is at present in the bath at an average % saturation content of: at least 70% of saturation; at least 75% of saturation; at least 80% of saturation; at least 85% of saturation; at least 90% of saturation, at least 95% of saturation, at least 100% of saturation (i.e. saturated); or at least 105% of saturation (i.e. above saturation).

In some embodiments, the sidewall constituent is at present in the bath at an average % saturation content of: not greater than 70% of saturation; not greater than 75% of saturation; 80% of saturation; not greater than 85% of saturation; not greater than 90% of saturation, not greater than 95% of saturation, not greater than 100% of saturation (i.e. saturated); or not greater than 105% of saturation (i.e. above saturation).

In some embodiments, the bath component comprises a bath content saturation percentage measured as an average throughout the cell. In some embodiments, the bath component comprises a bath content saturation percentage measured at a location adjacent to the sidewall (e.g. non-reactive/stable sidewall material).

In some embodiments, the location adjacent to the sidewall is the bath: touching the wall; not greater than about 1" from the wall; not greater than about 2" from the wall, not greater than about 4" from the wall; not greater than about 6" from the wall; not greater than about 8" from the wall; not greater than about 10" from the wall; not greater than about 12" from the wall; not greater than about 14" from the wall; not greater than about 16" from the wall; not greater than about 18" from the wall; not greater than about 20" from the wall; not greater than about 22" from the wall, or not greater than about 24" from the wall.

In some embodiments, the location adjacent to the sidewall is the bath: touching the wall; less than about 1" from the wall; less than about 2" from the wall, less than about 4" from the wall; less than about 6" from the wall; less than about 8" from the wall; less than about 10" from the wall; less than about 12" from the wall; less than about 14" from the wall; less than about 16" from the wall; less than about 18" from the wall; less than about 20" from the wall; less than about 22" from the wall, or less than about 24" from the wall.

In some embodiments, the protecting deposit comprises the at least one bath component. In some embodiments, the protecting deposit comprises at least two bath components.

In some embodiments, the protecting deposit extends from the trough and up to at least an upper surface of the electrolyte bath.

In some embodiments, the directing member is constructed of a material which is present in the bath chemistry, such that via the bath chemistry, the directing member is maintained in the molten salt electrolyte. In some embodiments, the directing member is composed of a stable material (e.g. non-reactive material in the bath and/or vapor phase).

In some embodiments, the base of the trough is defined by a feed block, wherein the feed block is constructed of a material selected from components in the bath chemistry, wherein via the bath chemistry, the feed block is maintained in the molten salt bath. In some embodiments, the feed block comprises a stable material (non-reactive material). In some embodiments, the feed block comprises alumina.

In some embodiments, the cell further comprises a feeder (e.g. feed device) configured to provide the protecting deposit in the trough.

In some embodiments, the feed device is attached to the cell body.

In one aspect of the instant disclosure, a method is provided, comprising: passing current from an anode through a molten electrolyte bath to a cathode in an electrolysis cell; feeding a feed material into the electrolysis cell at a location adjacent to a cell wall, such that the feed material is retained in a trough defined adjacent to the sidewall; and via the feeding step, maintaining the sidewall in the molten electrolyte during cell operation, wherein the sidewall is constructed of at least one component which is within about 95% of saturation in the molten electrolyte bath.

In some embodiments, the method includes: concomitant to the first step, maintaining the bath at a temperature not exceeding 980° C., wherein the sidewalls of the cells are substantially free of a frozen ledge.

In some embodiments, the method includes consuming the protecting deposit to supply metal ions to the electrolyte bath.

In some embodiments, the method includes producing a metal product from the at least one bath component.

Various ones of the inventive aspects noted hereinabove may be combined to yield apparatuses, assemblies, and methods related to primary metal production in electrolytic cells at low temperature (e.g. below 980° C.).

These and other aspects, advantages, and novel features of the invention are set forth in part in the description that follows and will become apparent to those skilled in the art upon examination of the following description and figures, or may be learned by practicing the invention.

BRIEF DESCRIPTION OF THE DRAWINGS

FIG. 34A depicts a transverse configuration, angled towards the center of the cell (to promote cell drain). FIG. 34B depicts a transverse configuration, angled towards the sidewall (to promote retention of the feed material in the protecting deposit). FIG. 34C depicts an angled configuration (e.g. pointed). FIG. 34D depicts a curved, or arcuate upper most region of the shelf or second sidewall portion.

DETAILED DESCRIPTION

Figure 1:
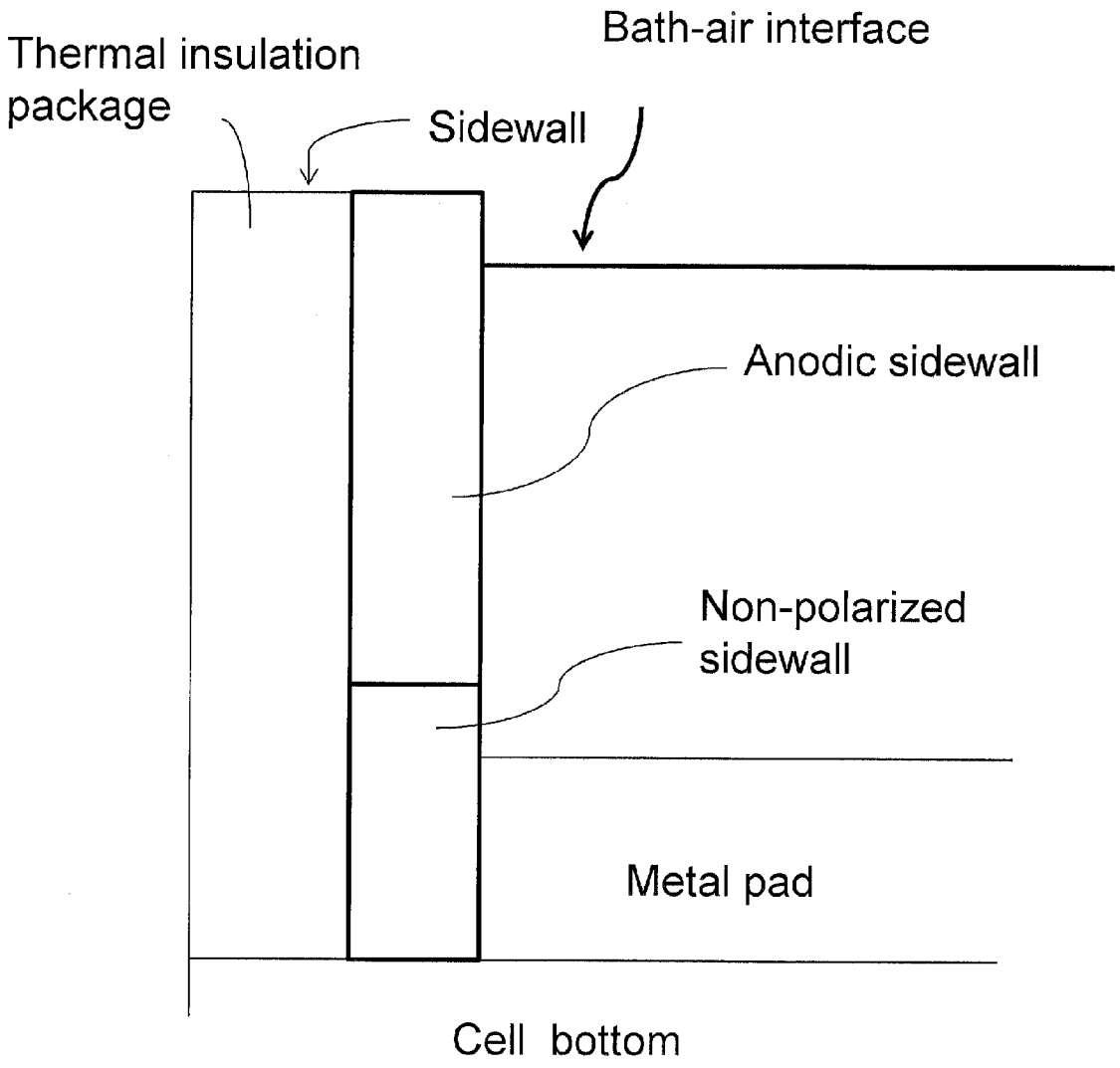
FIG. 1 depicts a partial cut-away side view of a cell body having an anodic sidewall and a non-polarized sidewall in accordance with the instant disclosure.
Figure 2:
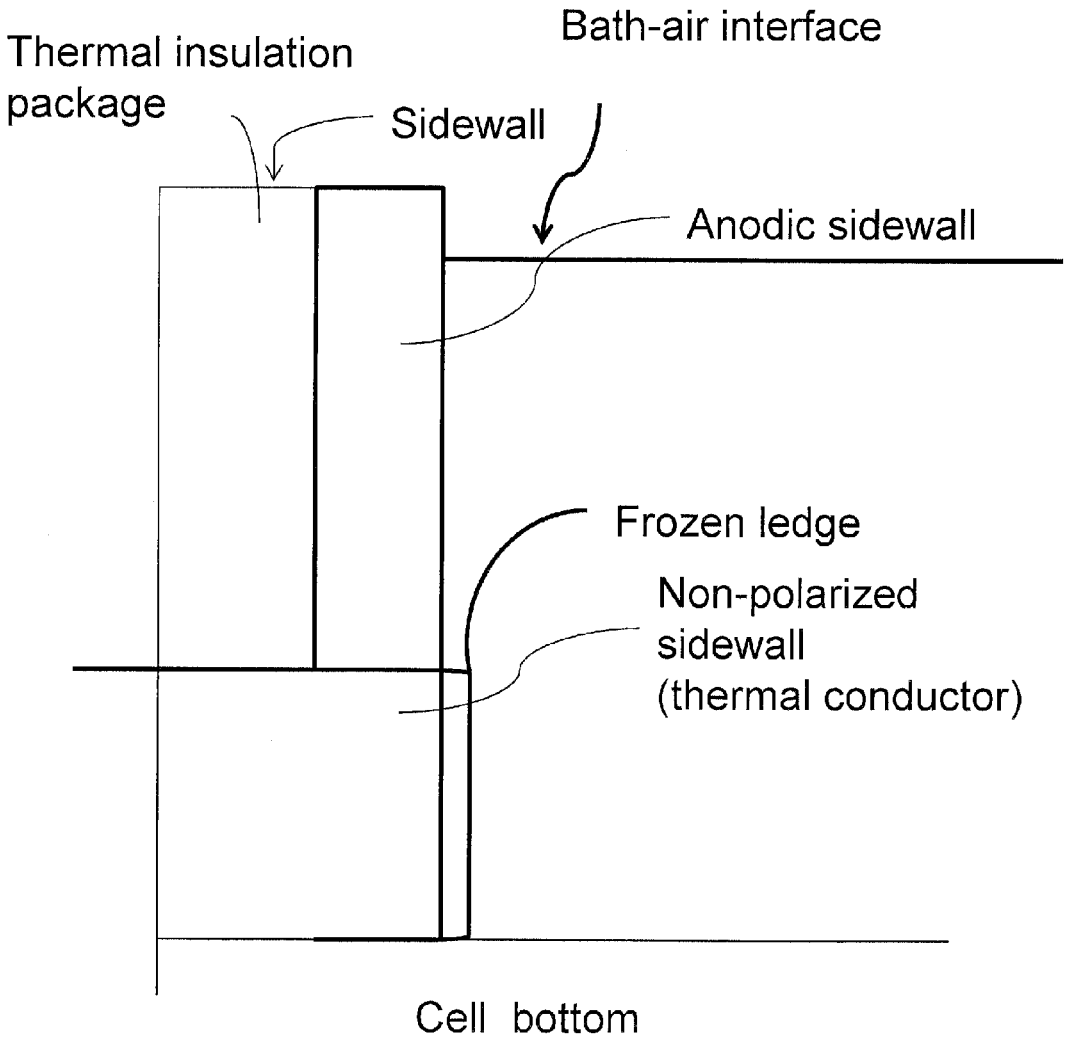
FIG. 2 depicts a partial cut-away side view of a cell body having an anodic sidewall and a non-polarized sidewall (thermal conductor with frozen ledge) in accordance with the instant disclosure.
Figure 3A:
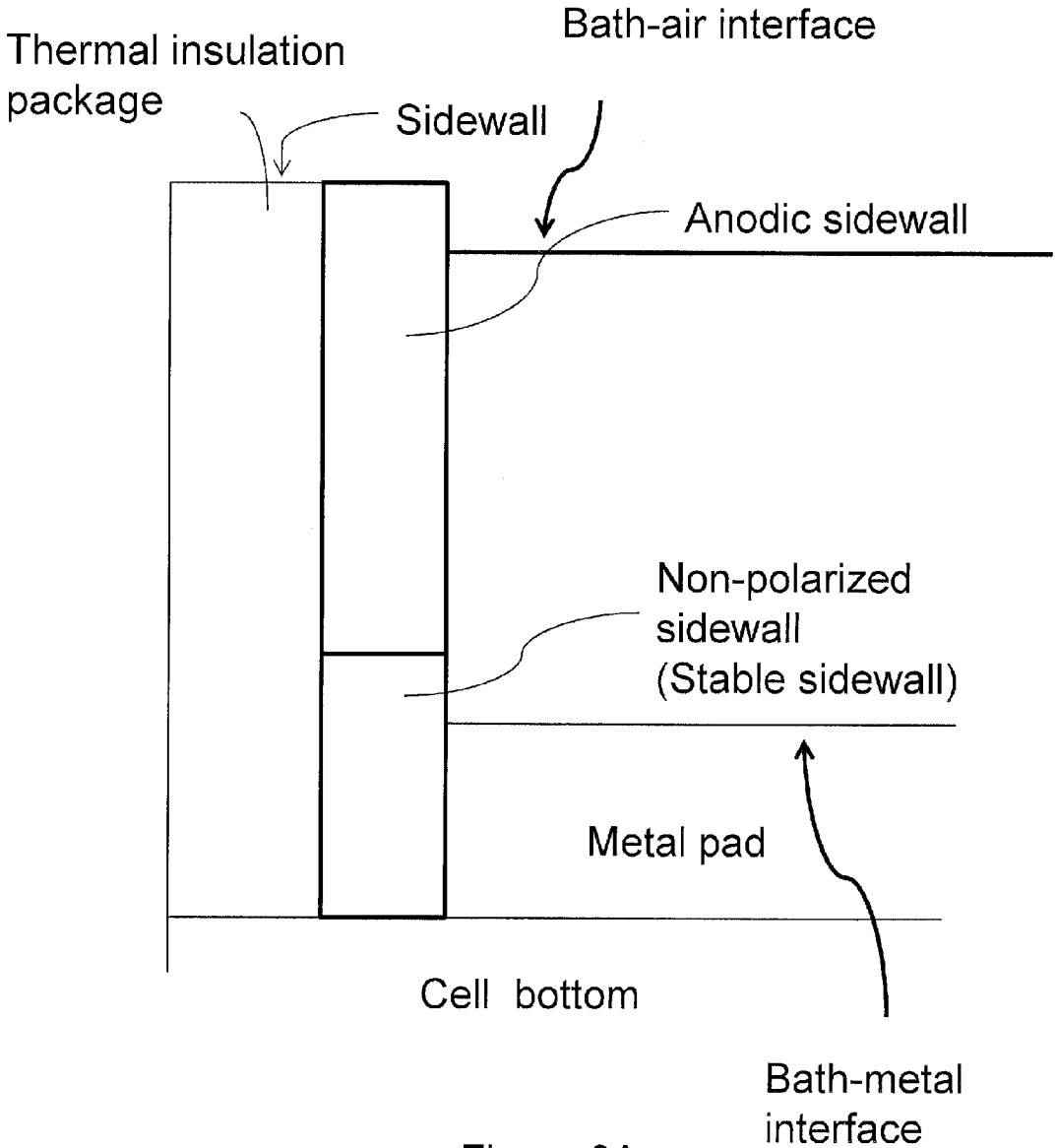
FIG. 3A depicts a partial cut-away side view of a cell body having an anodic sidewall and a non-polarized sidewall (stable sidewall/non-reactive material) in accordance with the instant disclosure.
Figure 3B:
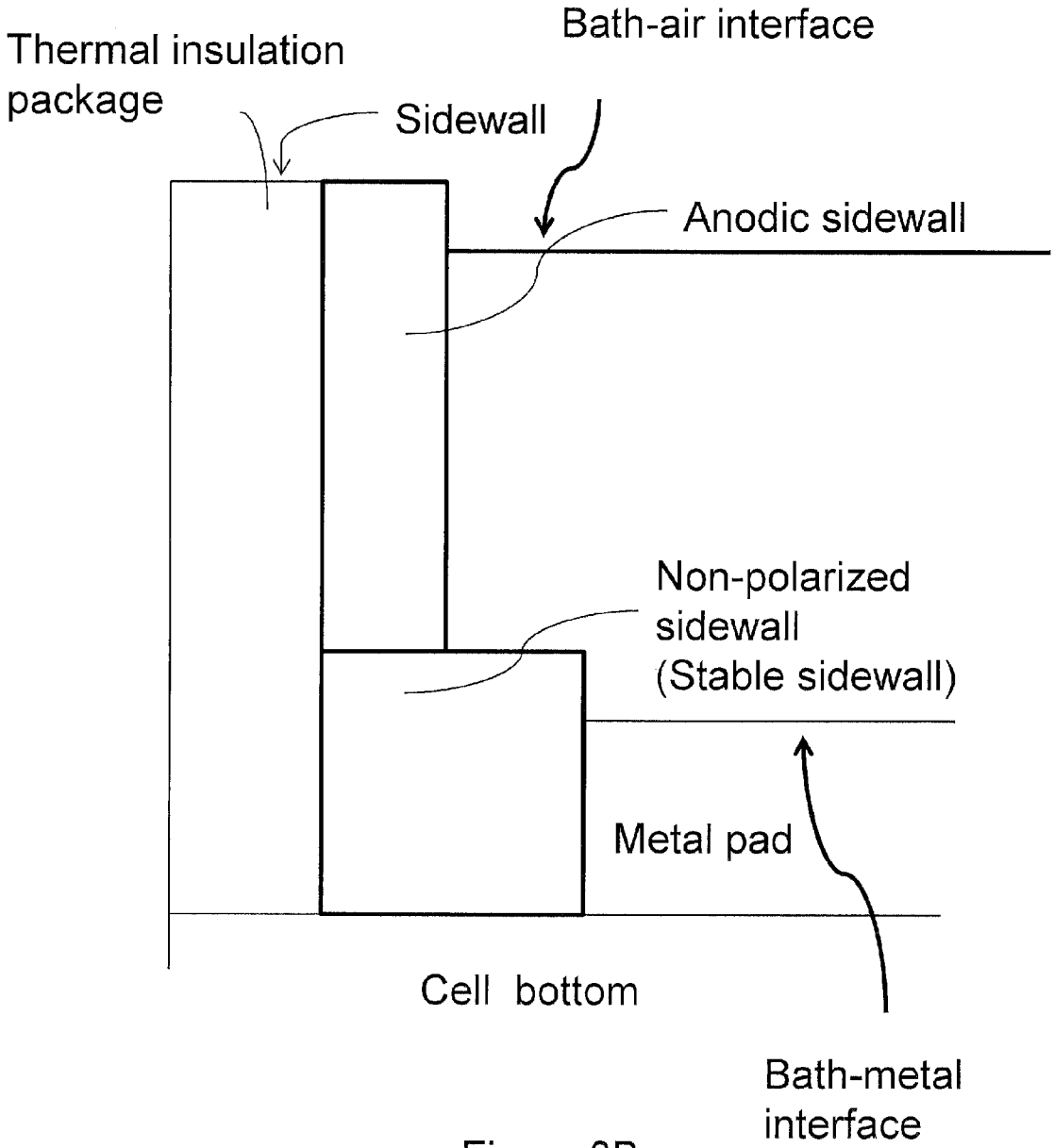
FIG. 3B depicts a partial cut-away side view of a cell body having an anodic sidewall and a non-polarized sidewall (stable sidewall in a stepped/extended configuration) in accordance with the instant disclosure.
Figure 3C:
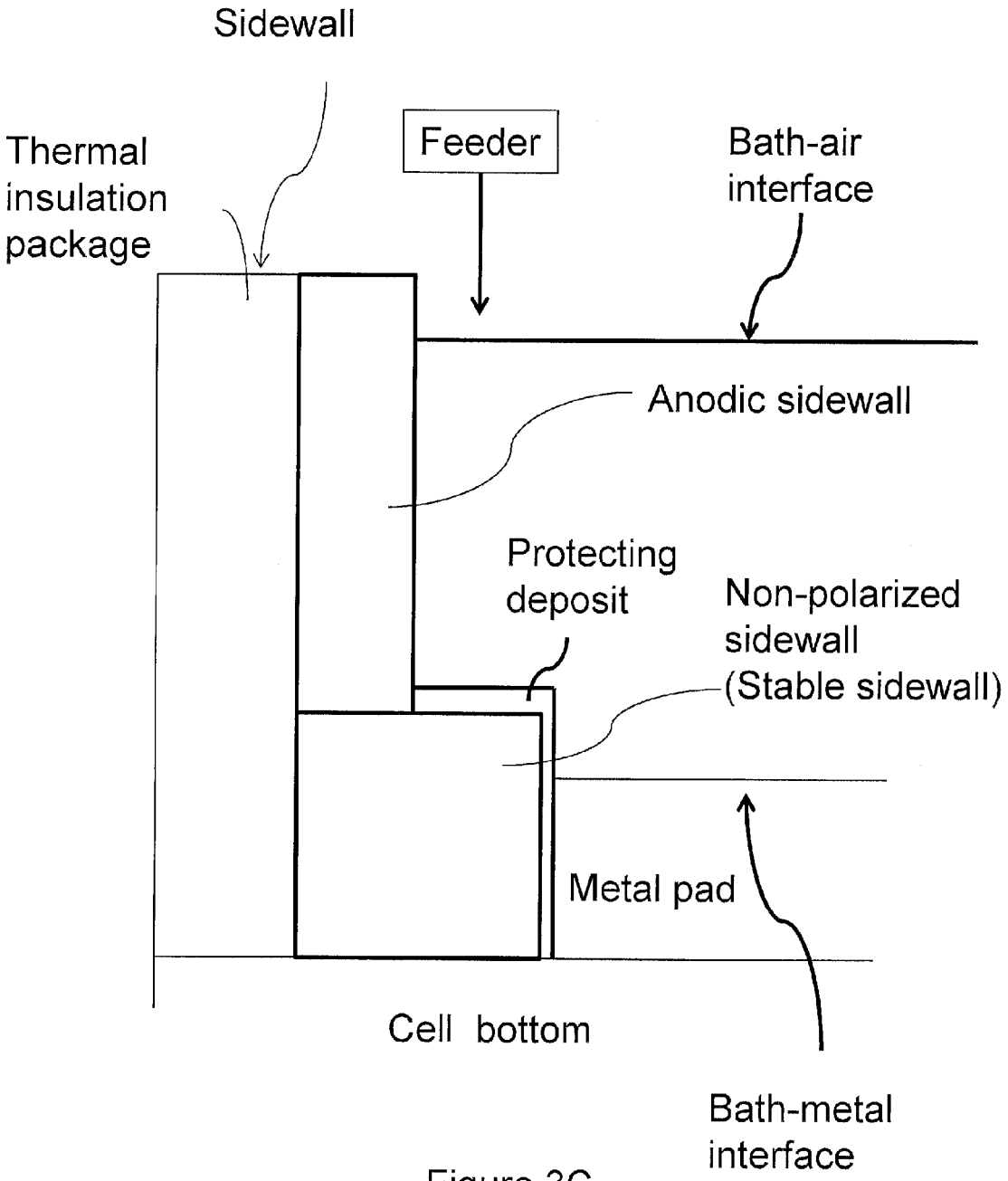
FIG. 3C depicts a partial cut-away side view of a cell body having an anodic sidewall and a non-polarized sidewall (stable sidewall in a stepped/extended configuration) having a feeder providing a protecting deposit to the non-polarized sidewall, in accordance with the instant disclosure.
Figure 3D:
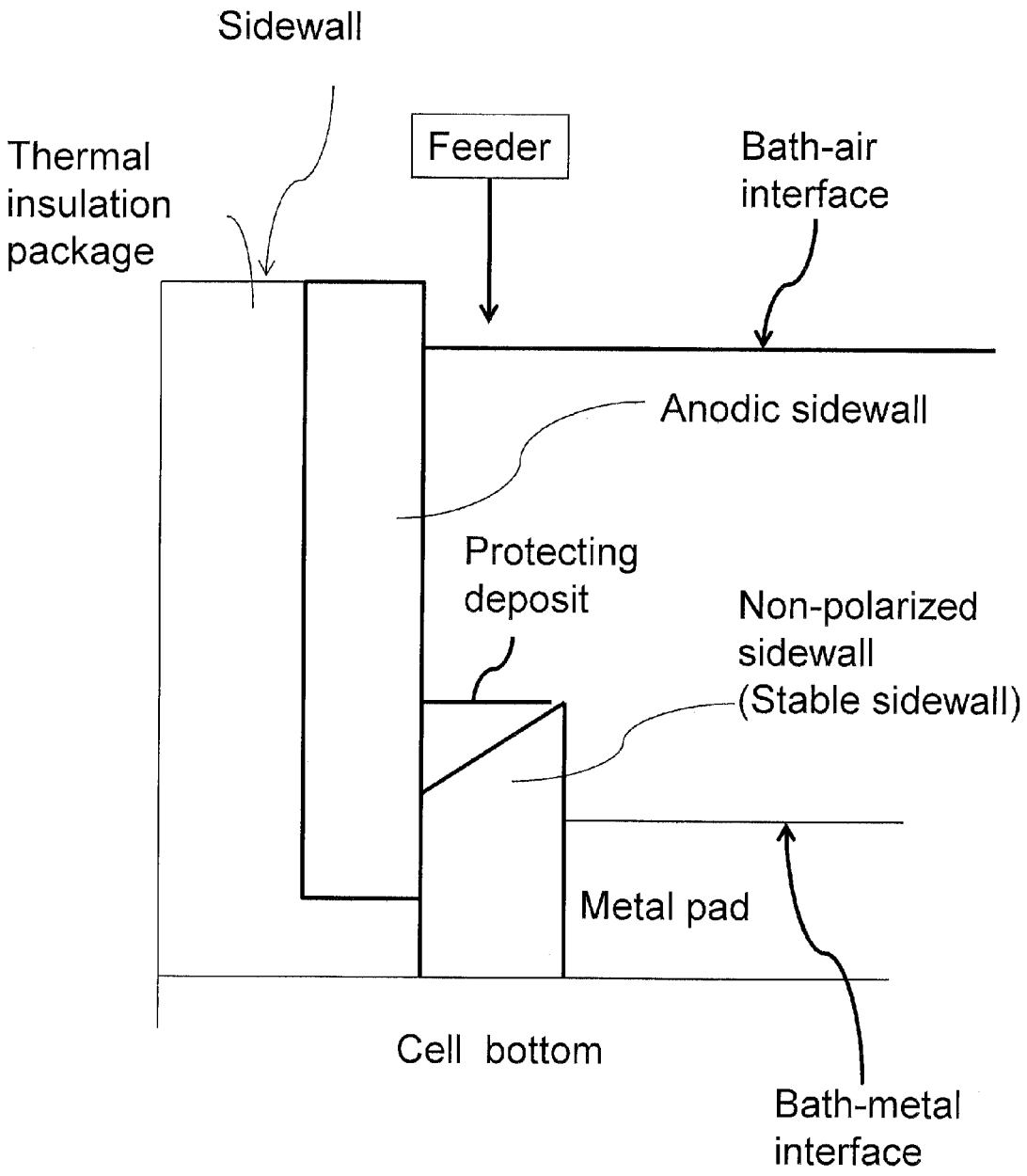
FIG. 3D depicts another embodiment of a partial cut-away side view of a cell body having an anodic sidewall and a non-polarized sidewall (stable sidewall in a stepped/extended configuration) having a feeder providing a protecting deposit to the non-polarized sidewall, in accordance with the instant disclosure.
Figure 3E:
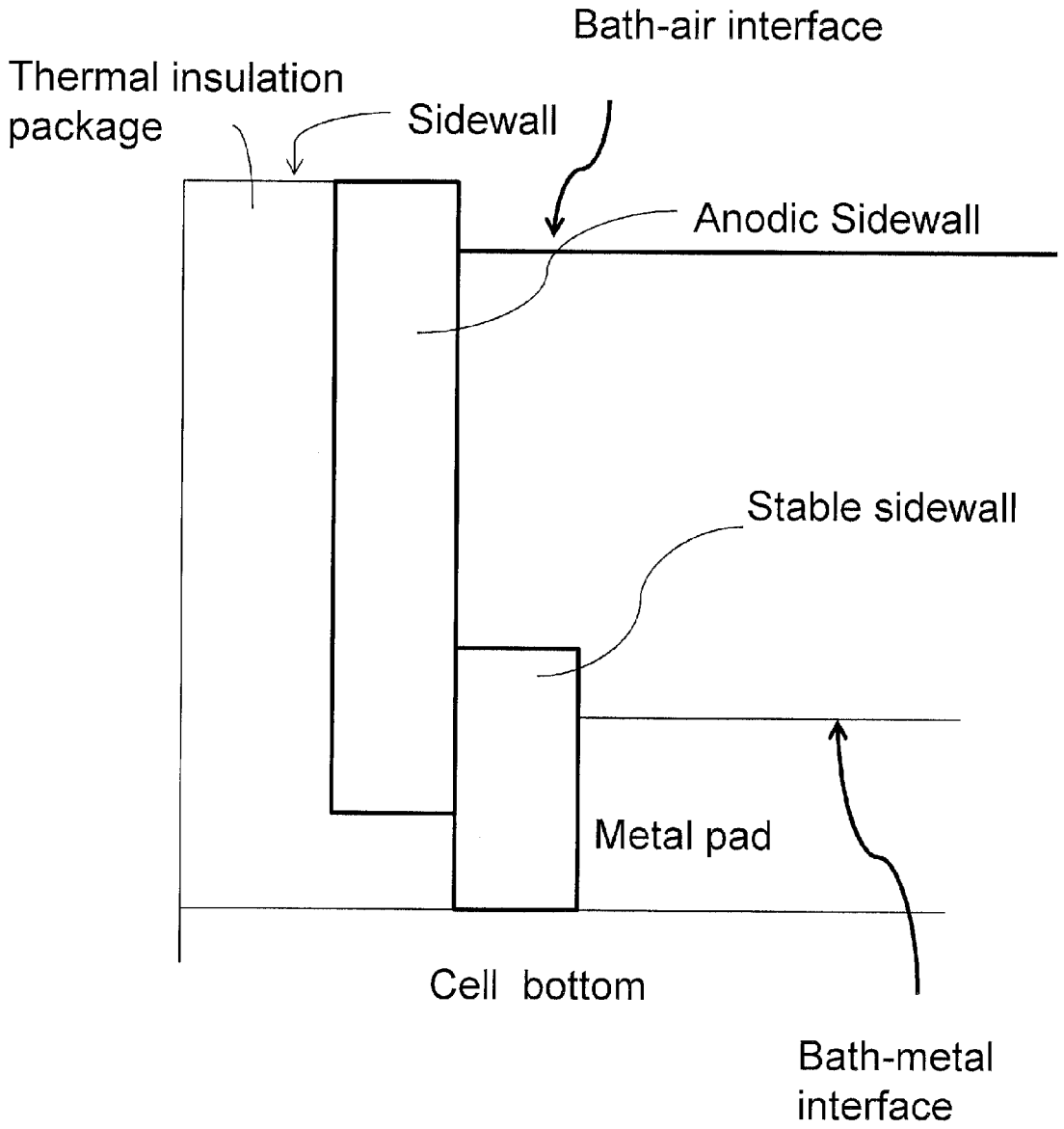
FIG. 3E depicts a partial cut-away side view of a cell body having an anodic sidewall and second sidewall portion including a non-polarized sidewall (stable sidewall in a stepped/extended configuration).
Figure 3F:
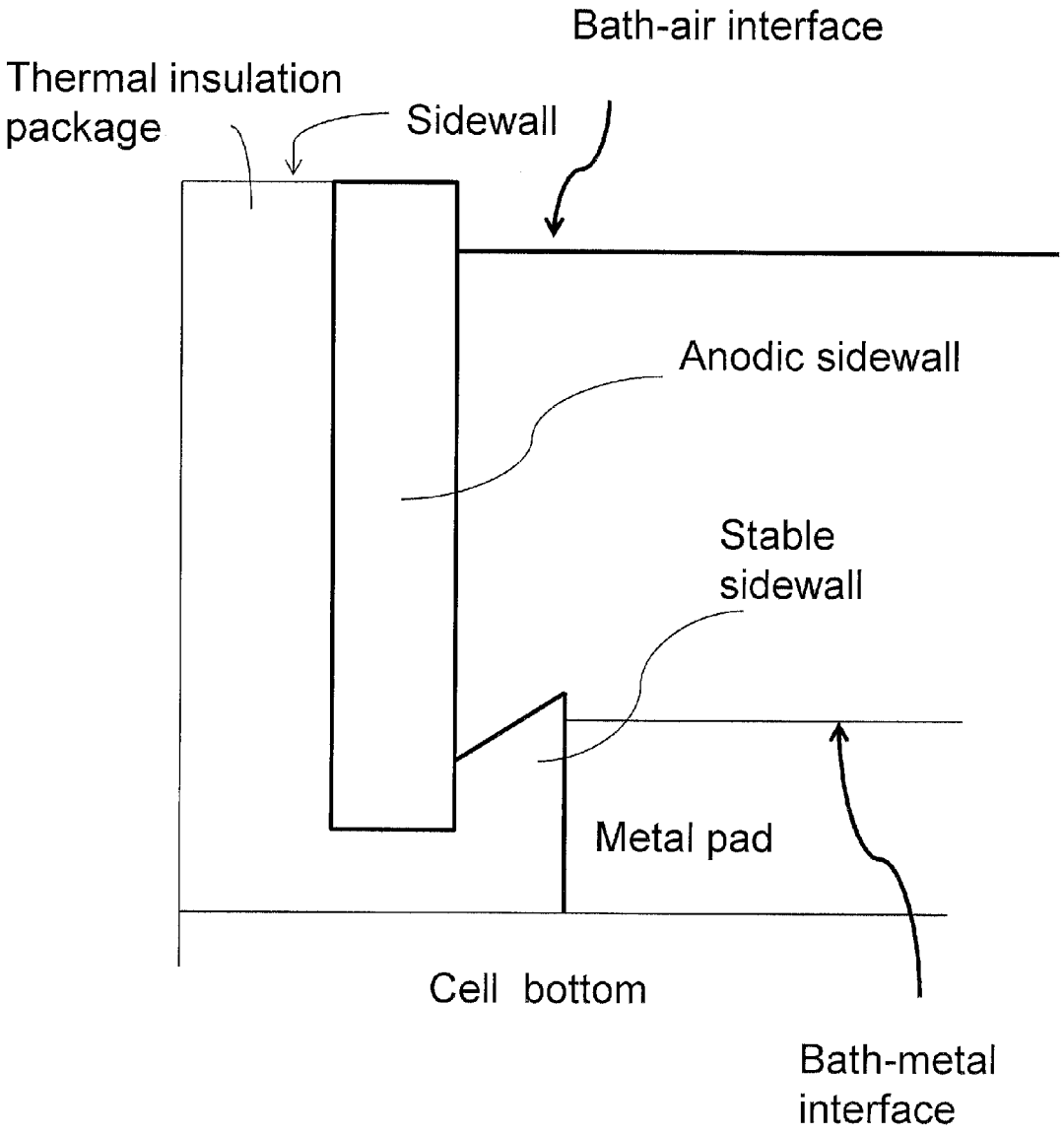
FIG. 3F depicts another embodiment of a partial cut-away side view of a cell body having an anodic sidewall and second sidewall portion including a non-polarized sidewall (stable sidewall in a stepped/extended configuration).
Figure 4:
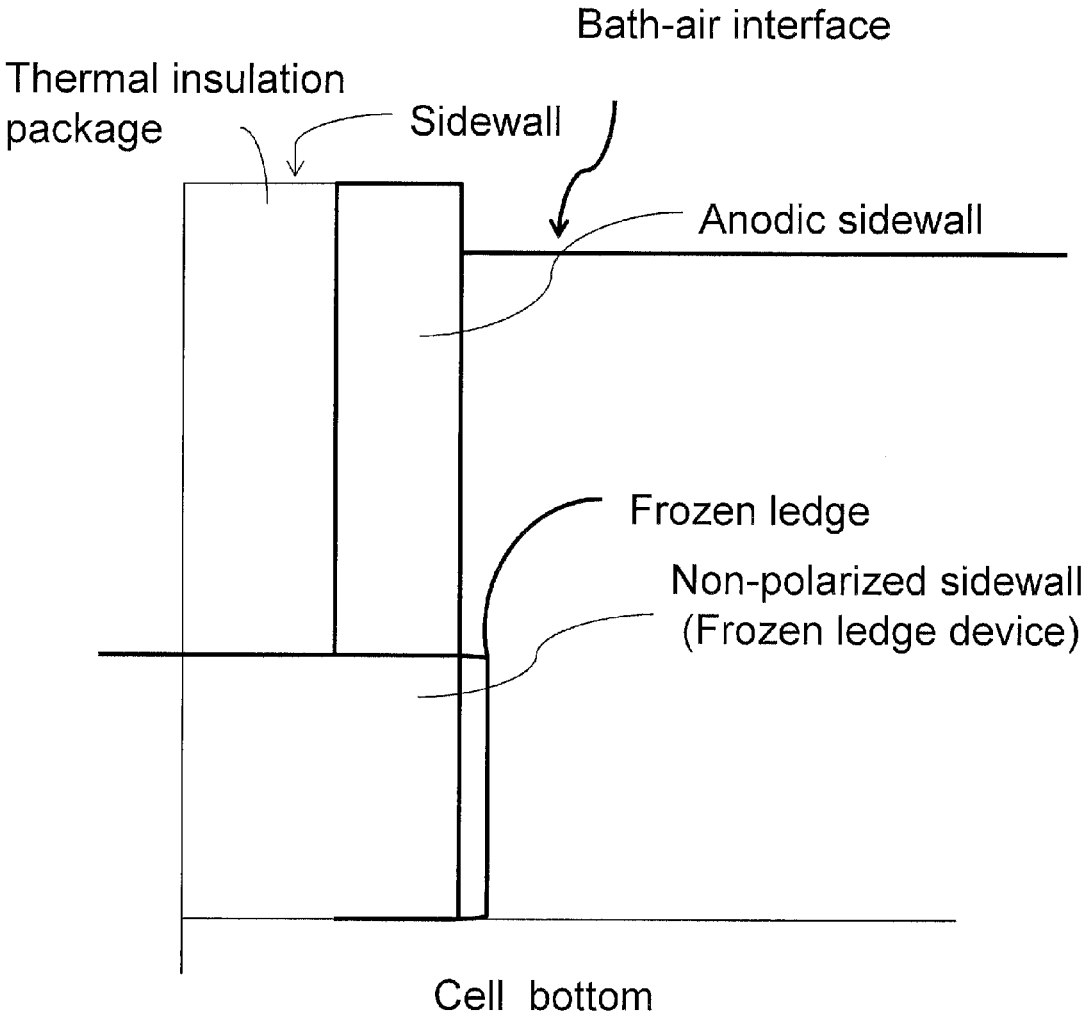
FIG. 4 depicts a partial cut-away side view of a cell body having an anodic sidewall and a non-polarized sidewall (frozen ledge device with a frozen ledge) in accordance with the instant disclosure.
Figure 5:
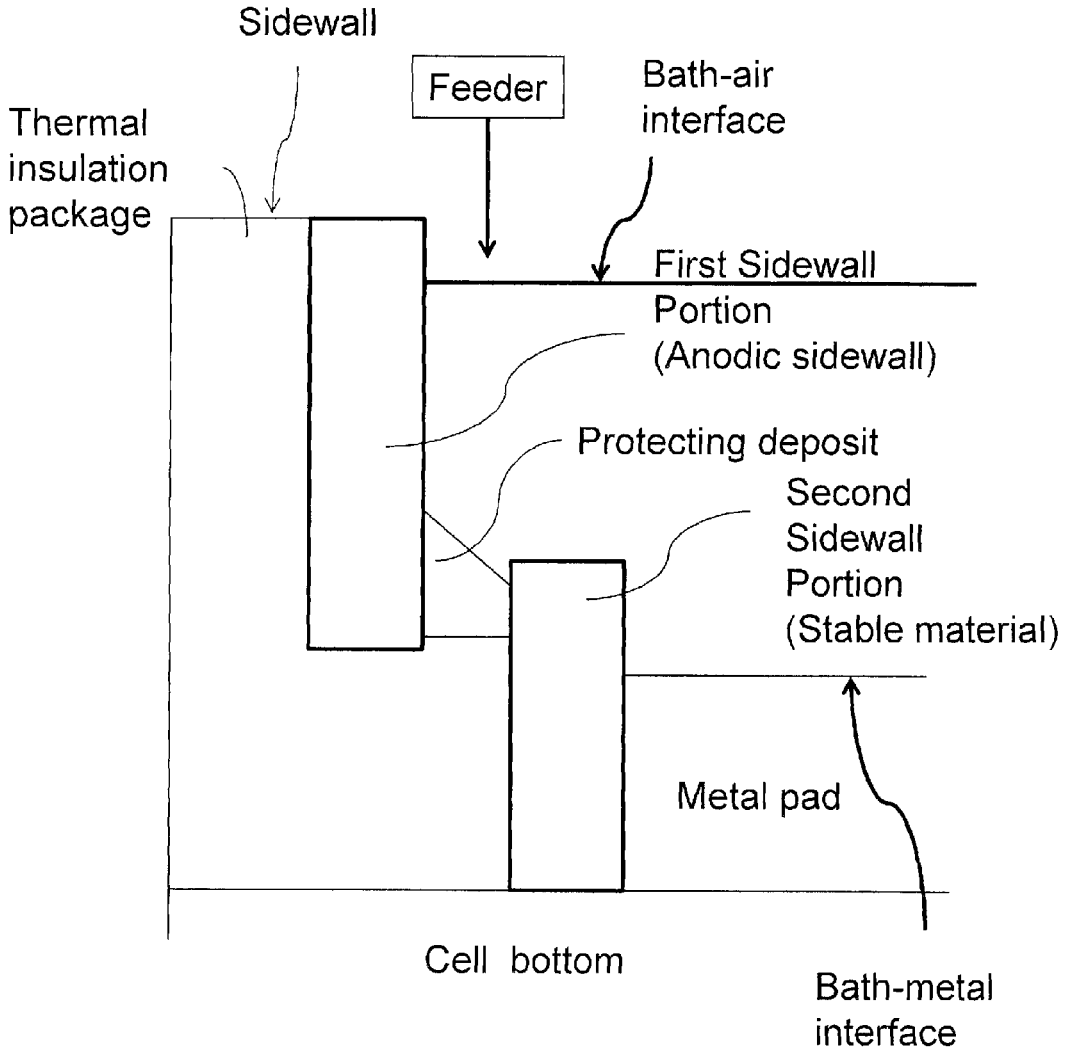
FIG. 5 depicts a partial cut-away side view of a cell body having an anodic sidewall and a second sidewall portion which is a non-polarized sidewall (stable material), including a feeder providing a protecting deposit, in accordance with the instant disclosure.
Figure 6:
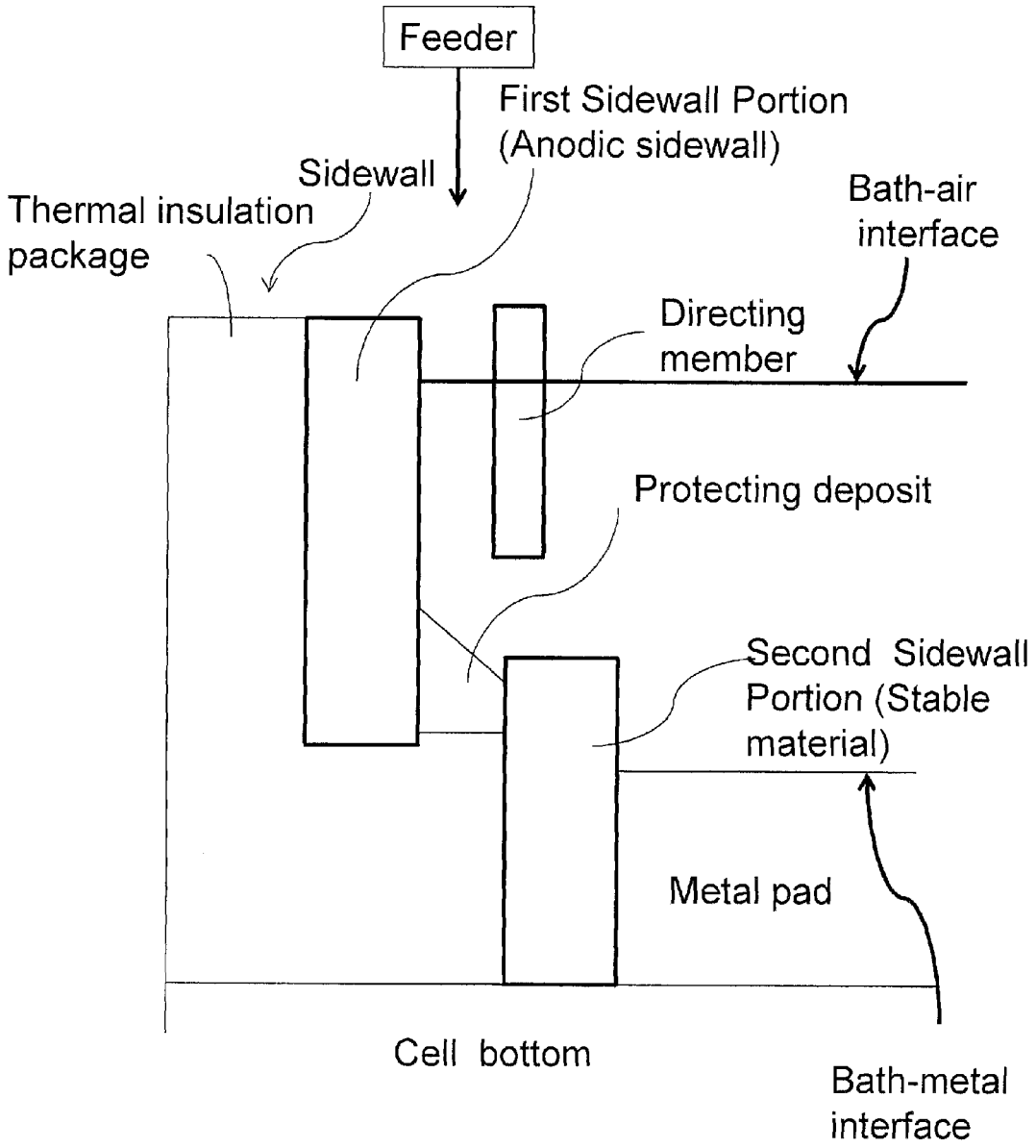
FIG. 6 depicts a partial cut-away side view of a cell body having an anodic sidewall and a second sidewall portion which is a non-polarized sidewall (stable material), including a feeder providing a protecting deposit and a directing member, in accordance with the instant disclosure.
Figure 7:
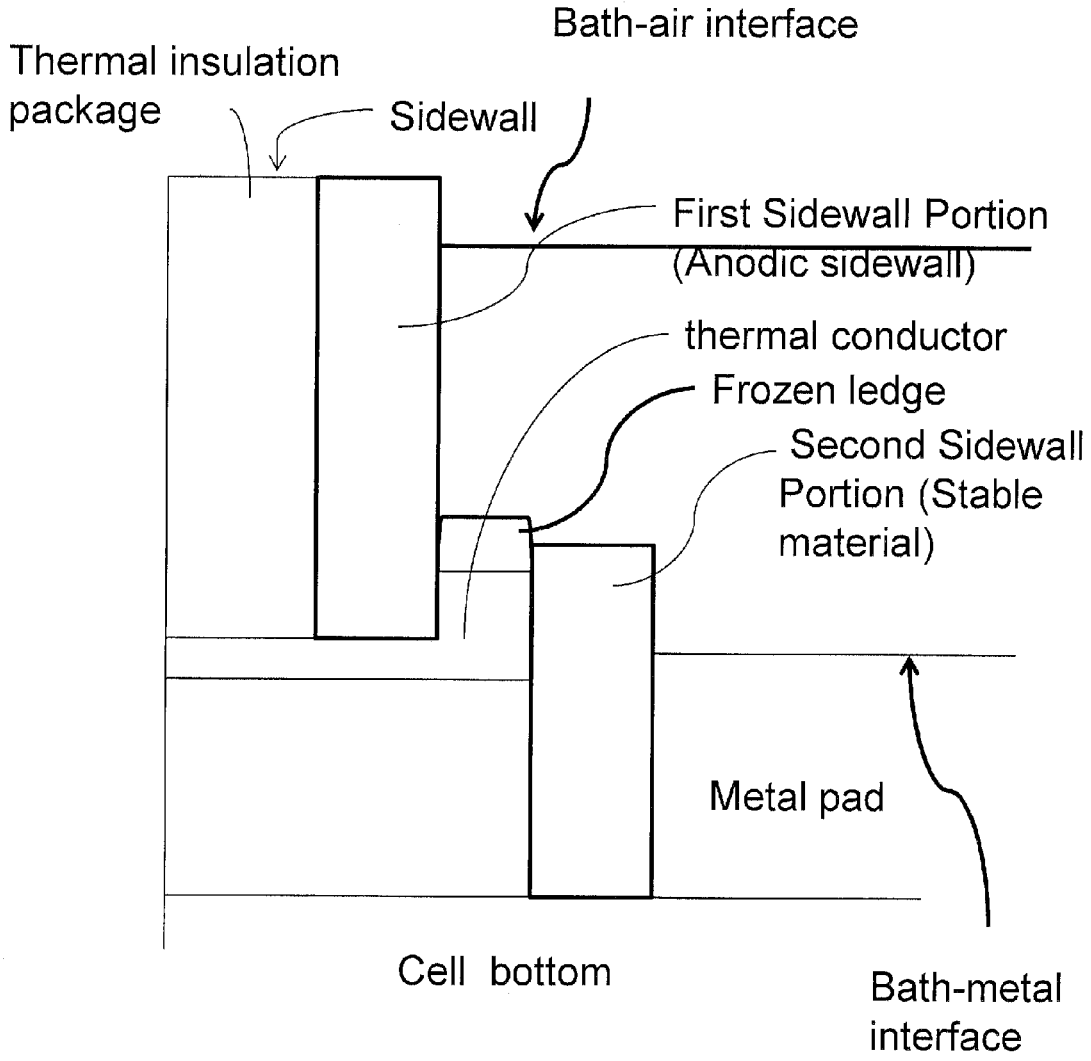
FIG. 7 depicts a partial cut-away side view of a cell body having an anodic sidewall and a second sidewall portion which is a non-polarized sidewall (stable material), including a thermal conductor material which provides a frozen ledge between the first sidewall portion and the second sidewall portion, in accordance with the instant disclosure.
Figure 8:
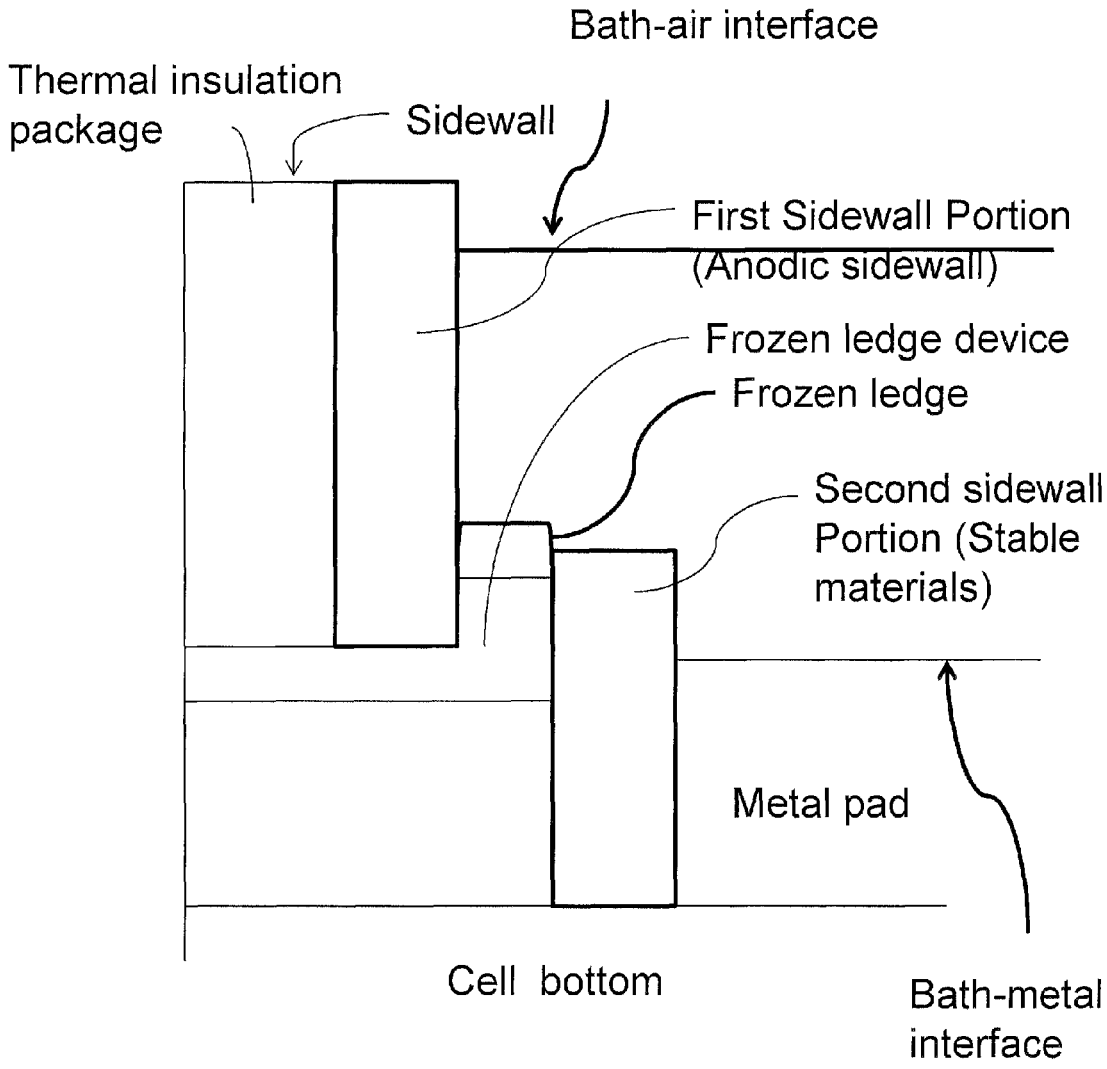
FIG. 8 depicts a partial cut-away side view of a cell body having an anodic sidewall and a second sidewall portion which is a non-polarized sidewall (stable material), including a frozen ledge device which provides a frozen ledge between the first sidewall portion and the second sidewall portion, in accordance with the instant disclosure.
Figure 9:
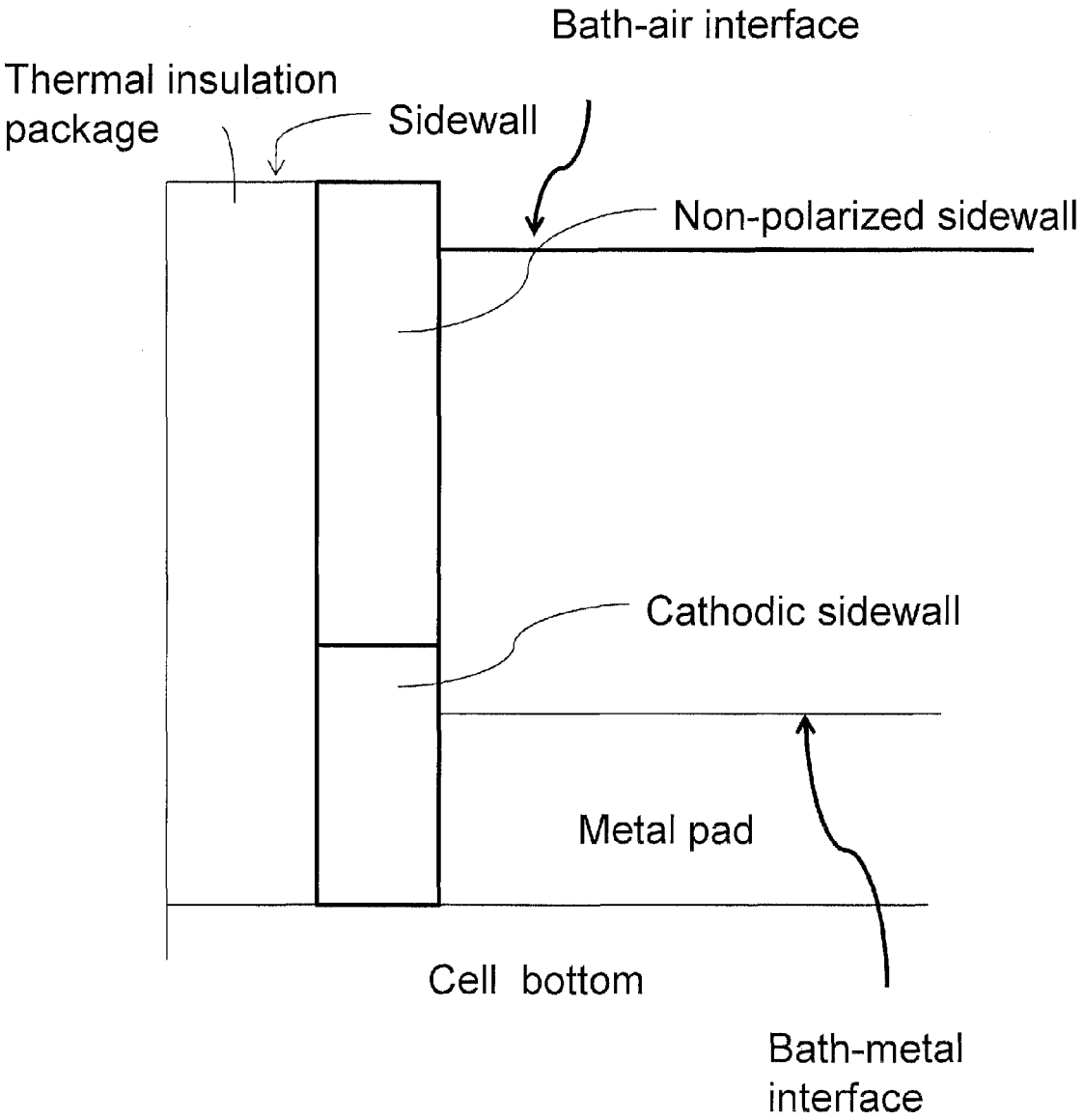
FIG. 9 depicts a partial cut-away side view of a cell body having a cathodic sidewall and a non-polarized sidewall in accordance with the instant disclosure.
Figure 10A:
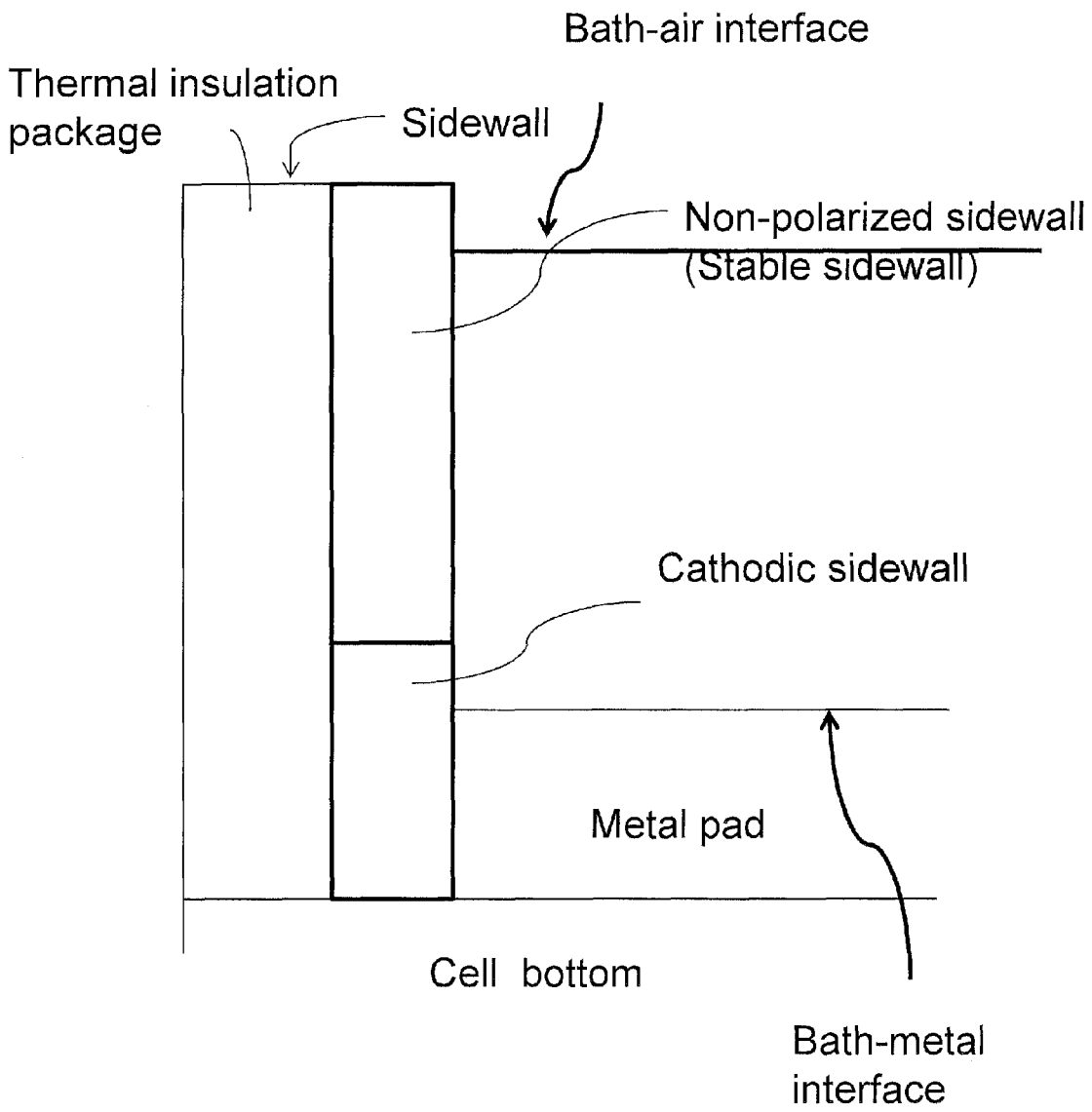
FIG. 10A depicts a partial cut-away side view of a cell body having a cathodic sidewall and a non-polarized sidewall (stable sidewall/non-reactive material) in accordance with the instant disclosure.
Figure 10B:
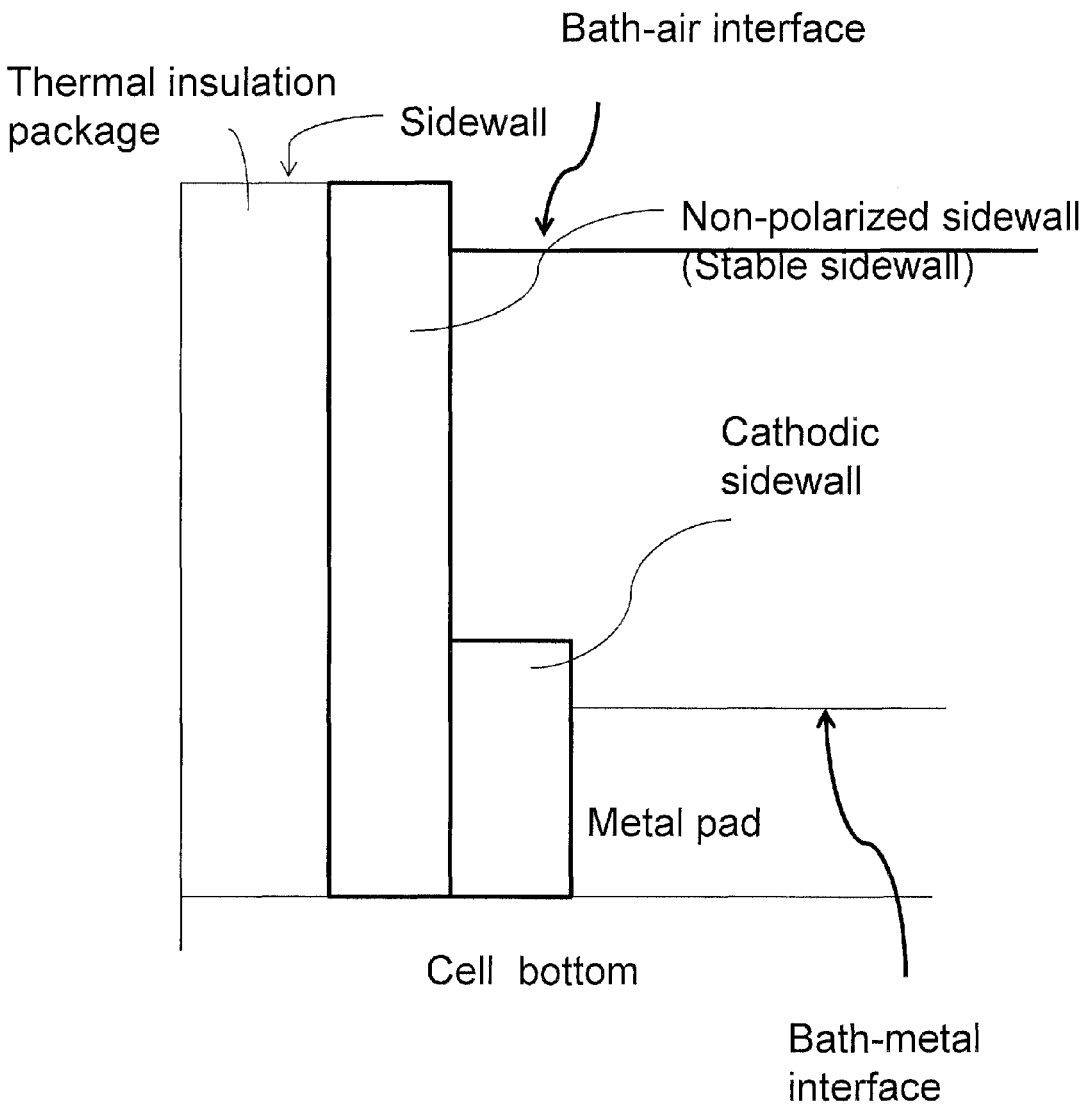
FIG. 10B depicts another embodiment of a partial cut-away side view of a cell body having a cathodic sidewall and a non-polarized sidewall, in accordance with the instant disclosure.
Figure 10C:
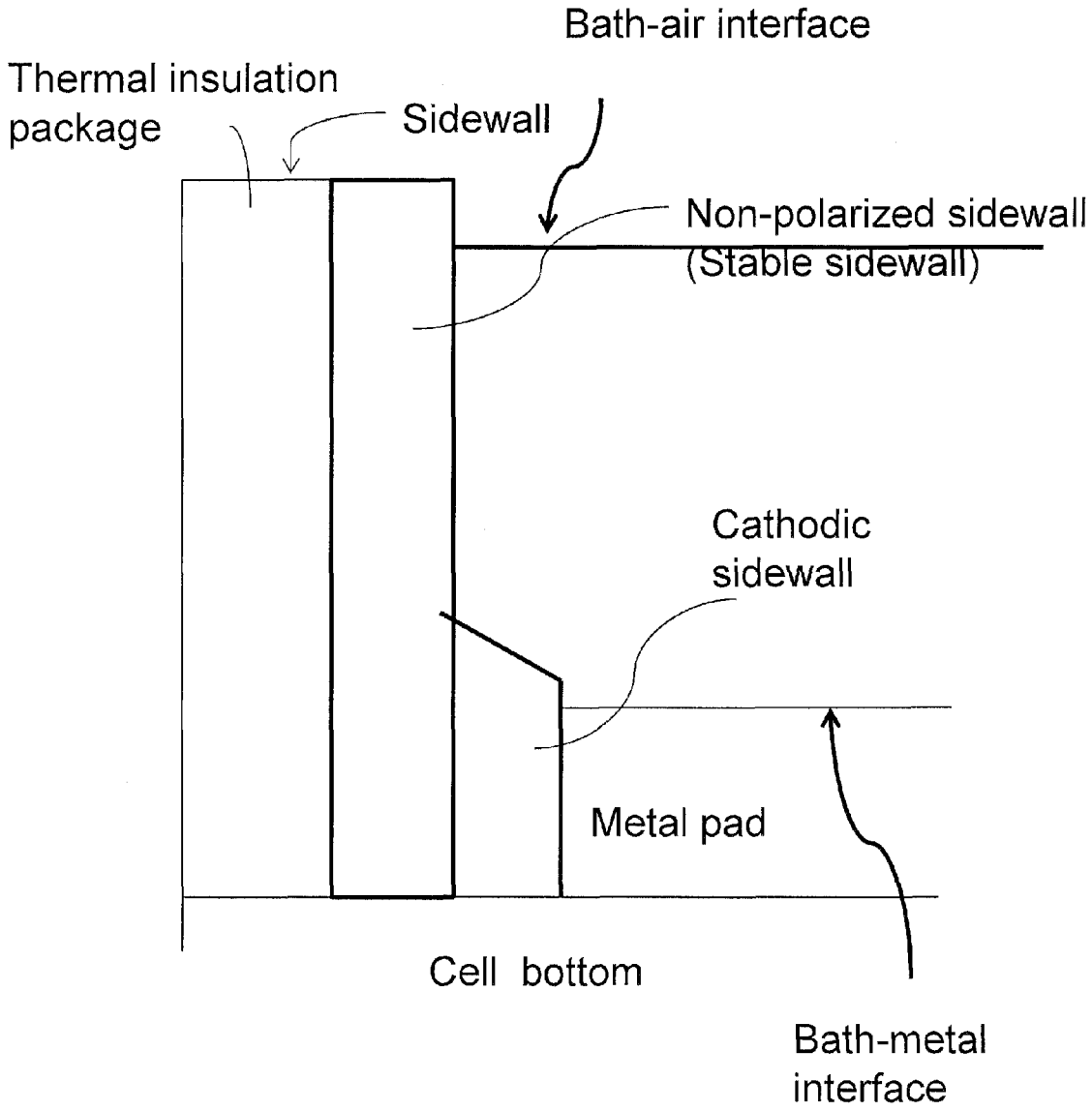
FIG. 10C depicts another embodiment of a partial cut-away side view of a cell body having a first sidewall portion which is a non-polarized sidewall (stable sidewall) and a second sidewall portion which is a cathodic sidewall, in accordance with the instant disclosure.
Figure 10D:
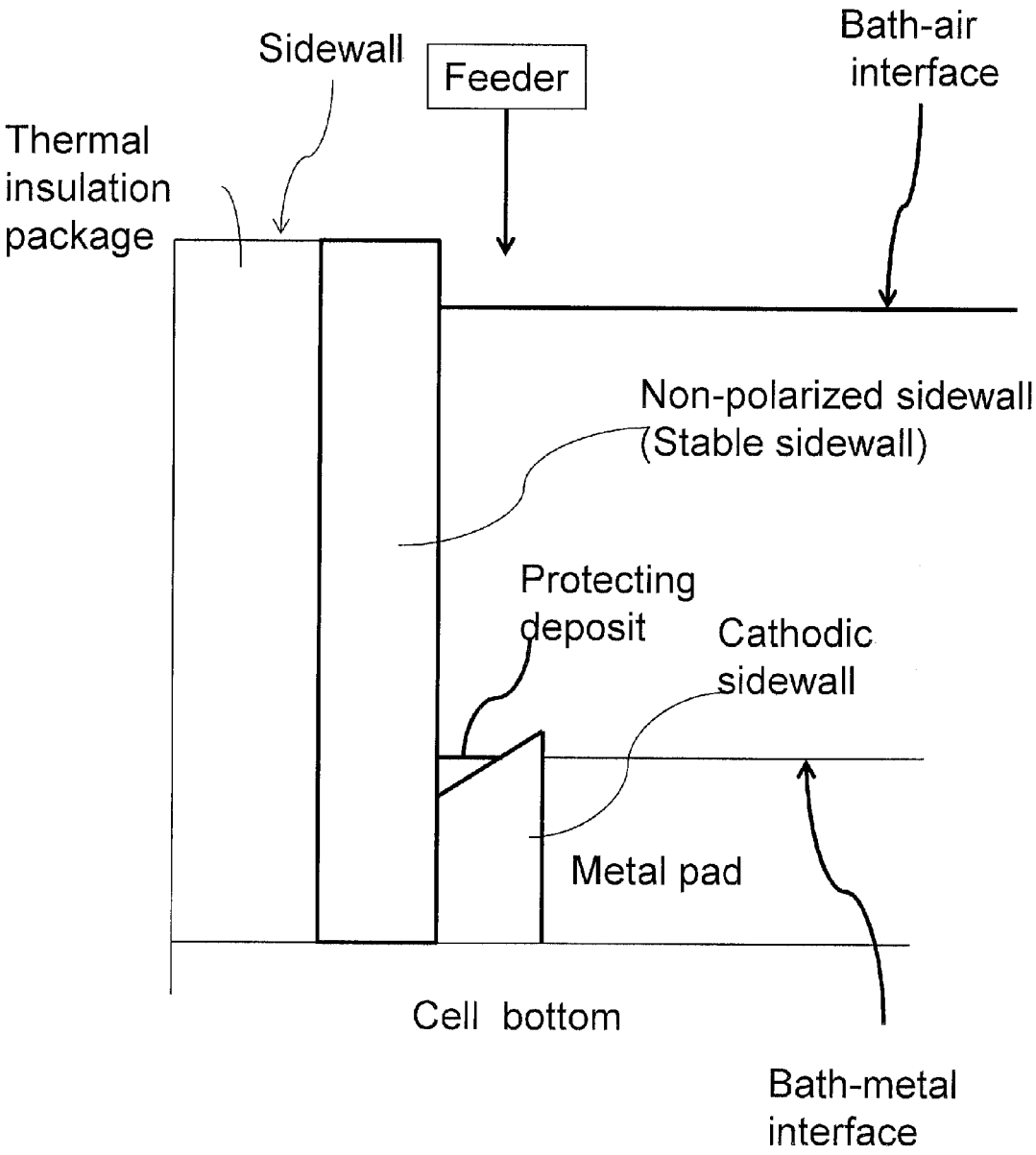
FIG. 10D depicts another embodiment of a partial cut-away side view of a cell body having a first sidewall portion which is a non-polarized sidewall (stable sidewall) and a second sidewall portion which is a cathodic sidewall, including a feeder which provides a protecting deposit, in accordance with the instant disclosure.
Figure 11:
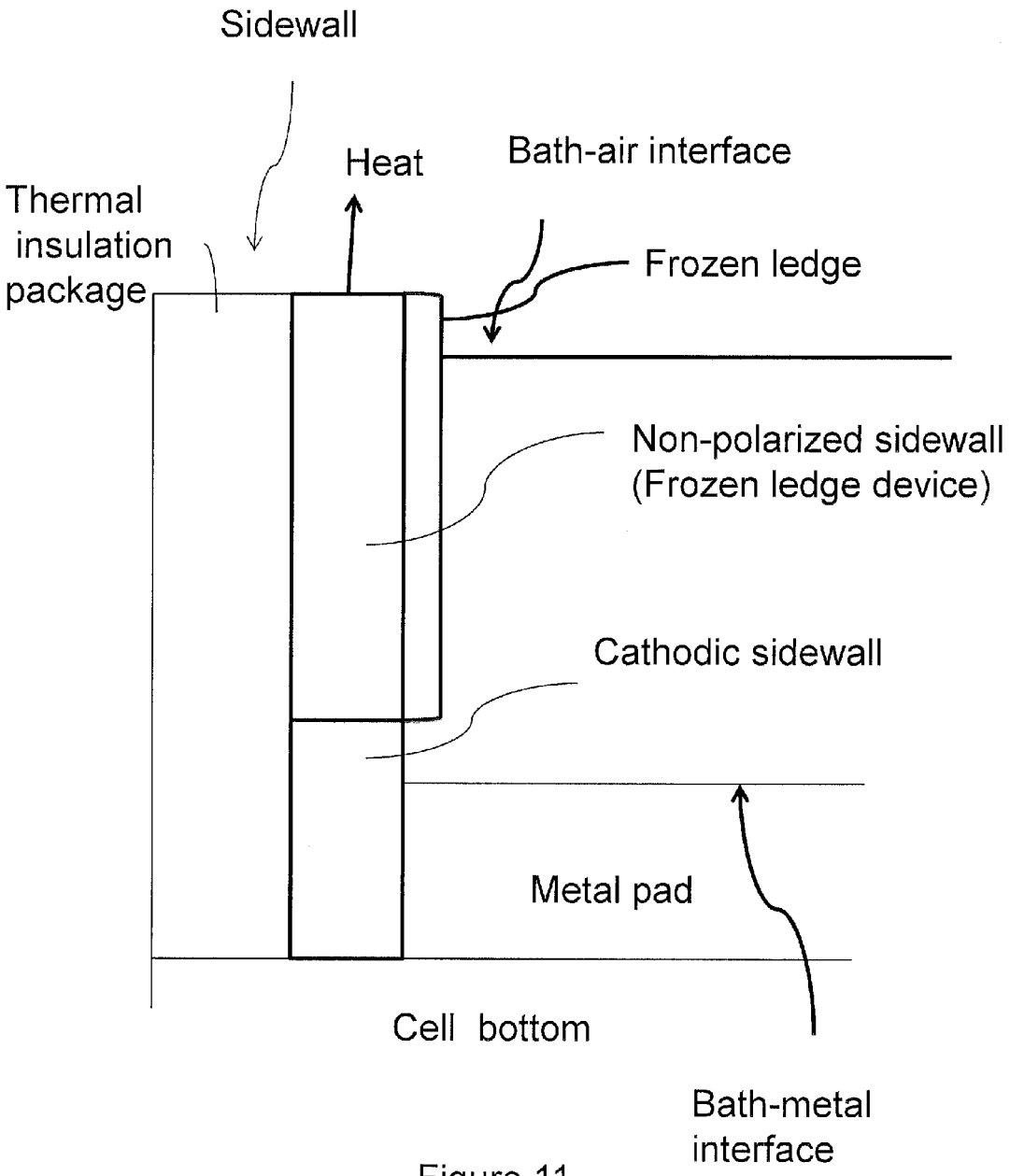
FIG. 11 depicts a partial cut-away side view of a cell body having a cathodic sidewall and a non-polarized sidewall (frozen ledge device with a frozen ledge in accordance with the instant disclosure.
Figure 12:
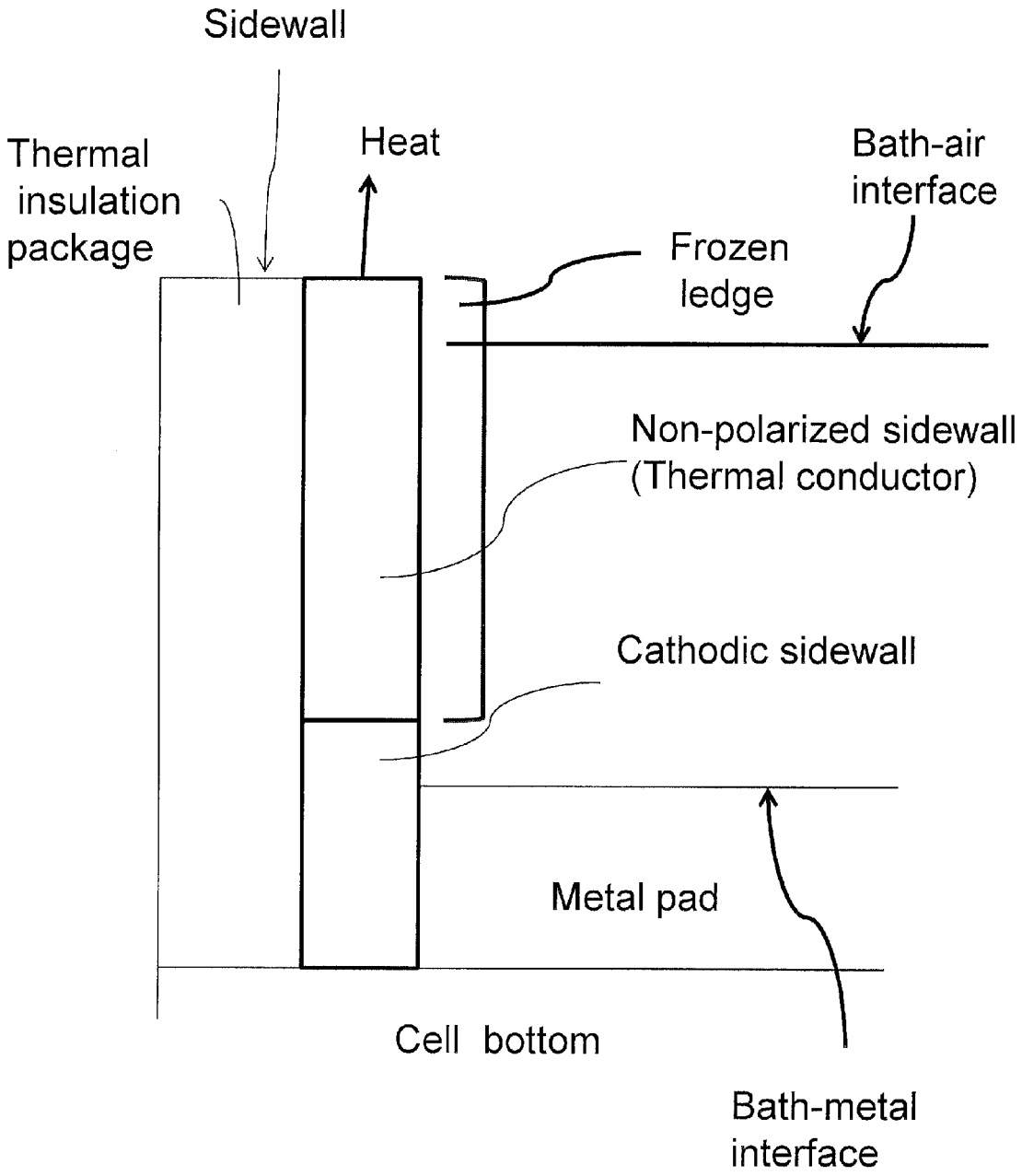
FIG. 12 depicts a partial cut-away side view of a cell body having a cathodic sidewall and a non-polarized sidewall (thermal conductor with a frozen ledge) in accordance with the instant disclosure.
Figure 13:
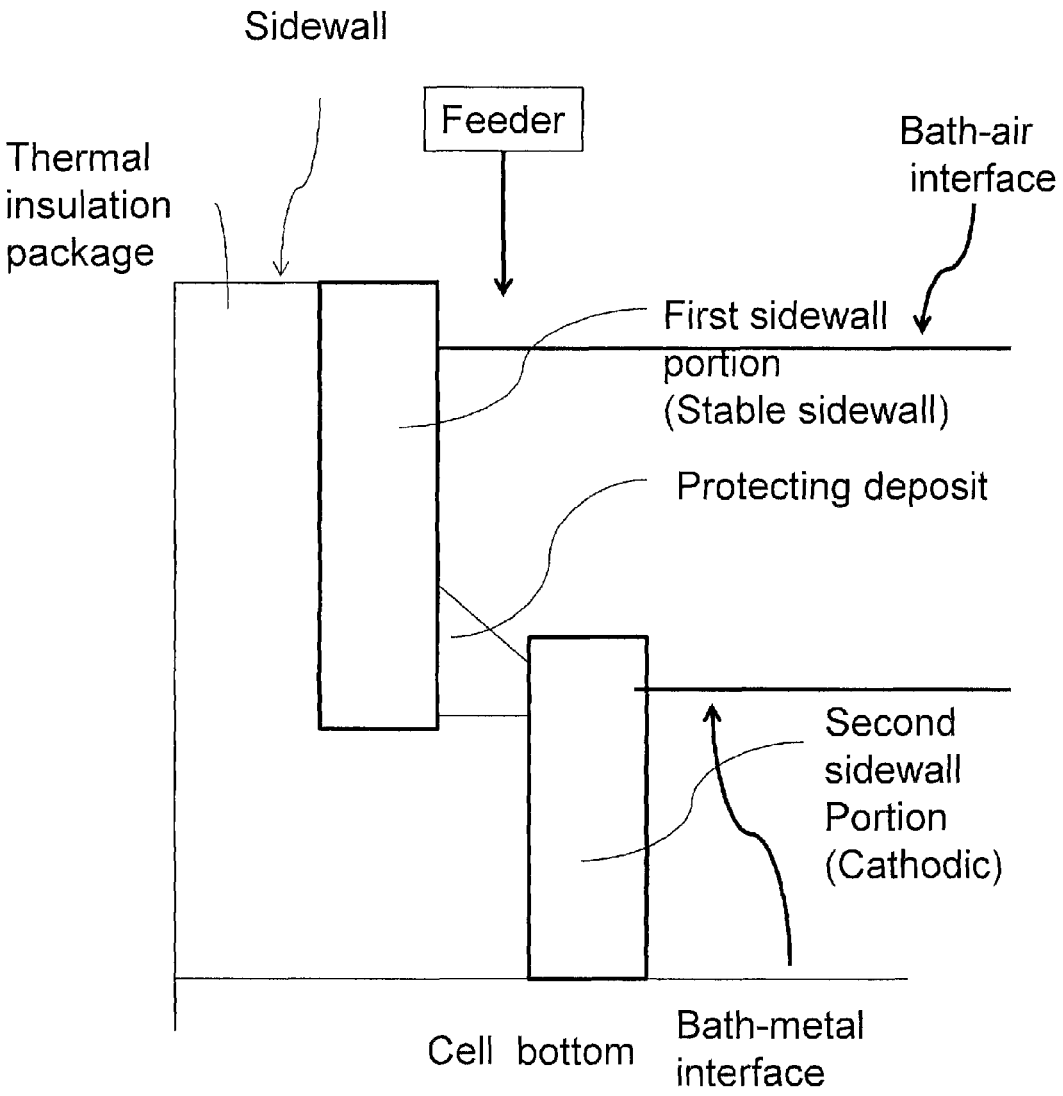
FIG. 13 depicts a partial cut-away side view of a cell body having a first sidewall portion (stable sidewall) and a second sidewall portion (cathodic sidewall) with a feeder and a protecting deposit in accordance with the instant disclosure.
Figure 14:
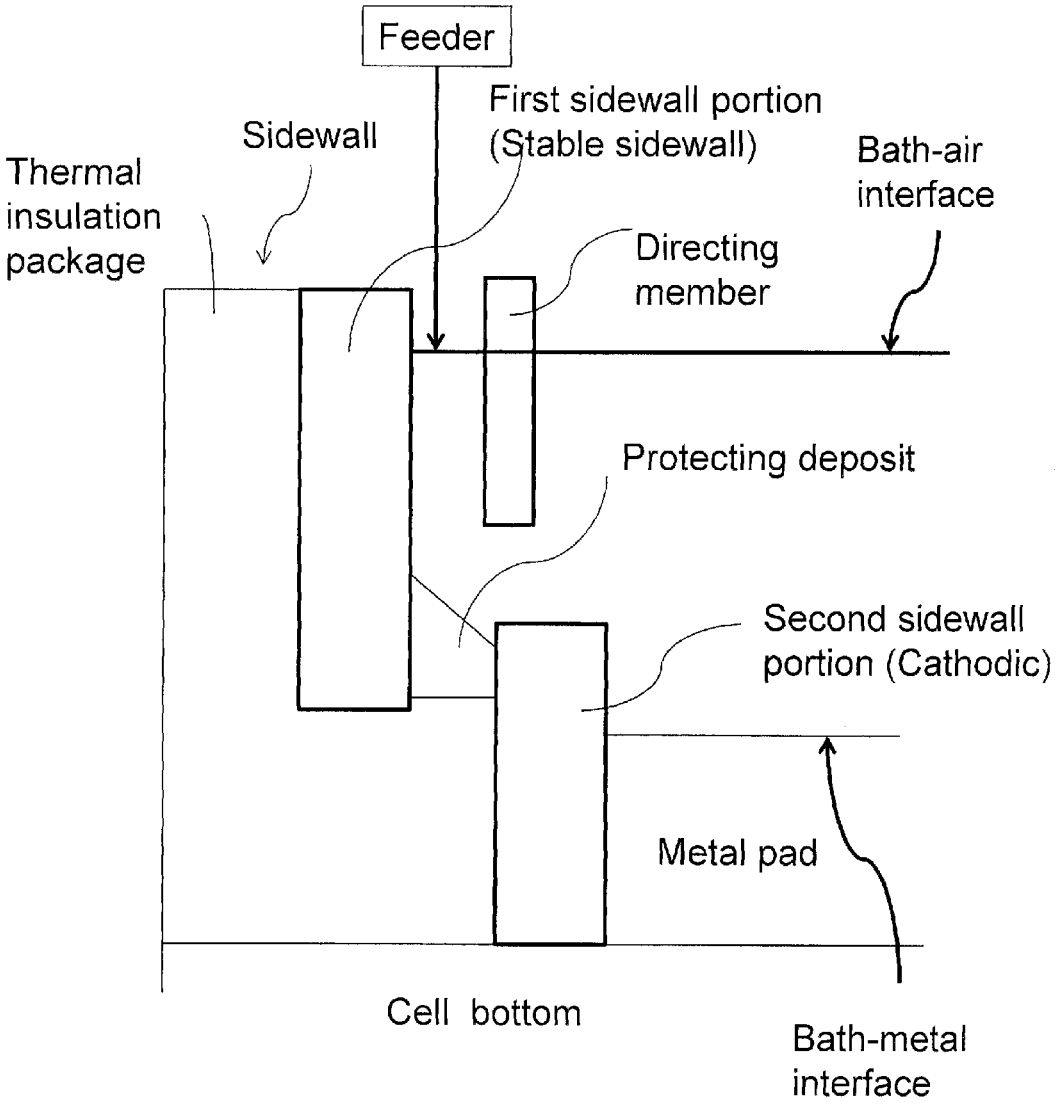
FIG. 14 depicts a partial cut-away side view of a cell body having a first sidewall portion (stable sidewall) and a second sidewall portion (cathodic sidewall) with a feeder and a protecting deposit, including a directing member in accordance with the instant disclosure.
Figure 15:
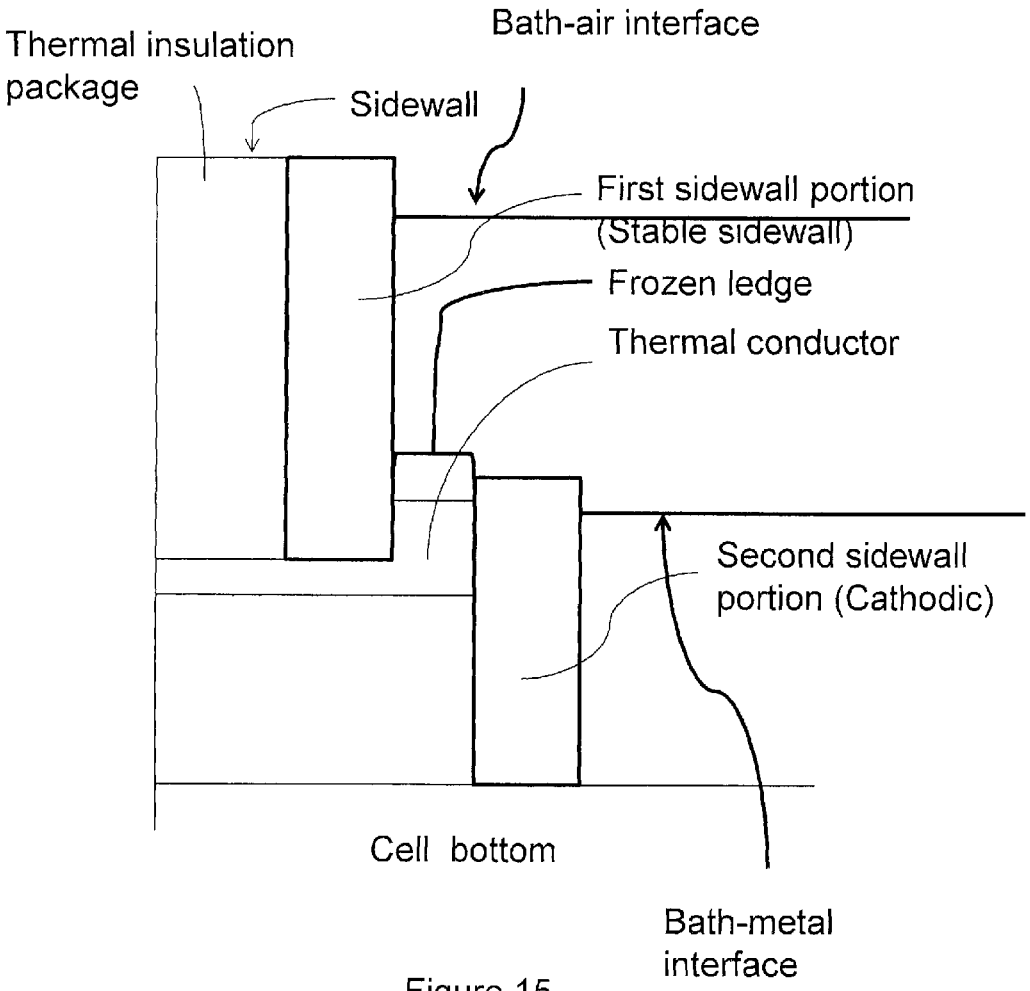
FIG. 15 depicts a partial cut-away side view of a cell body having a first sidewall portion (stable sidewall) and a second sidewall portion (cathodic sidewall) with a thermal conductor there between defining a frozen ledge, in accordance with the instant disclosure.
Figure 16:
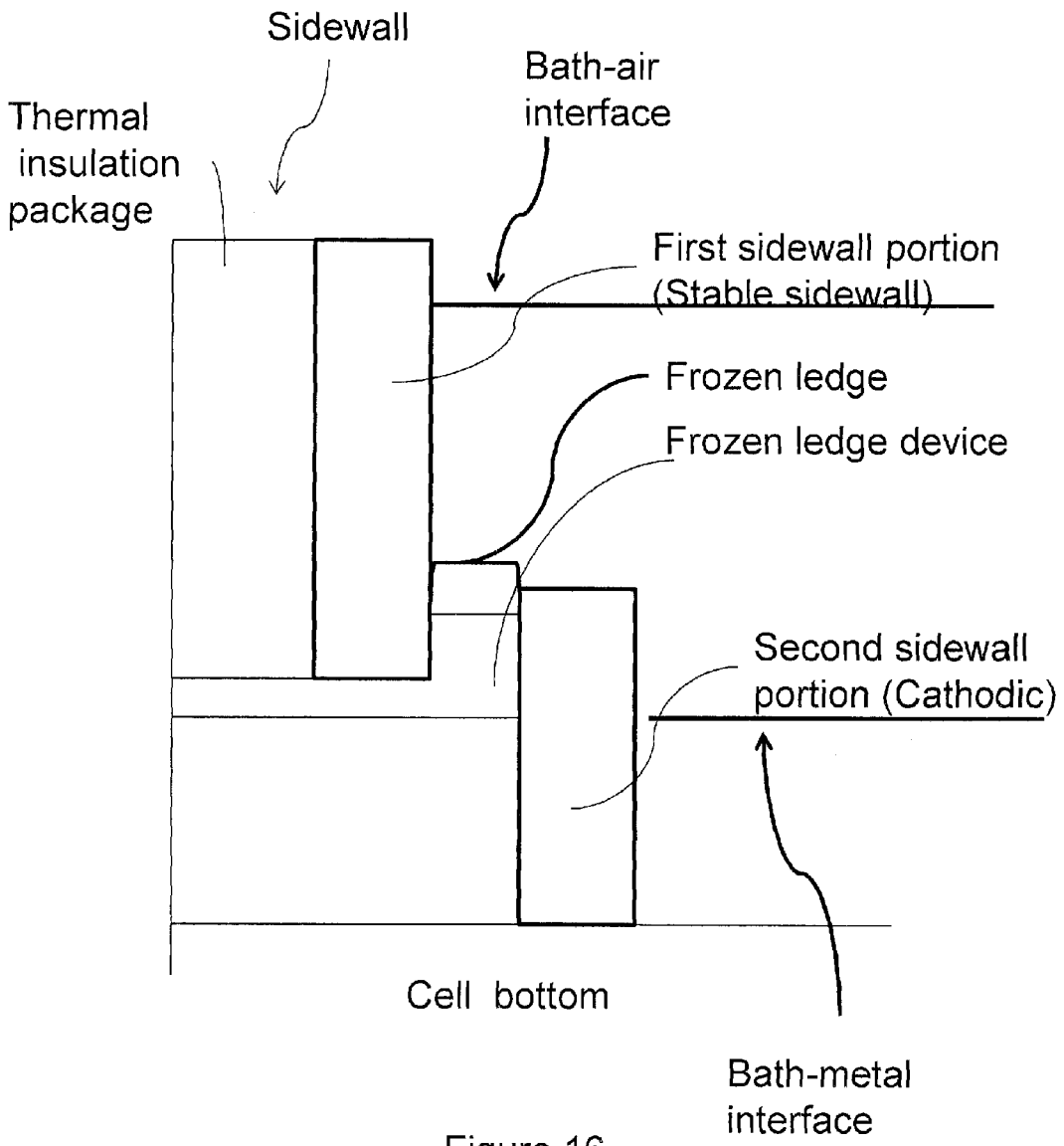
FIG. 16 depicts a partial cut-away side view of a cell body having a first sidewall portion (stable sidewall) and a second sidewall portion (cathodic sidewall) with a frozen ledge device defining a frozen ledge, in accordance with the instant disclosure.
Figure 17:
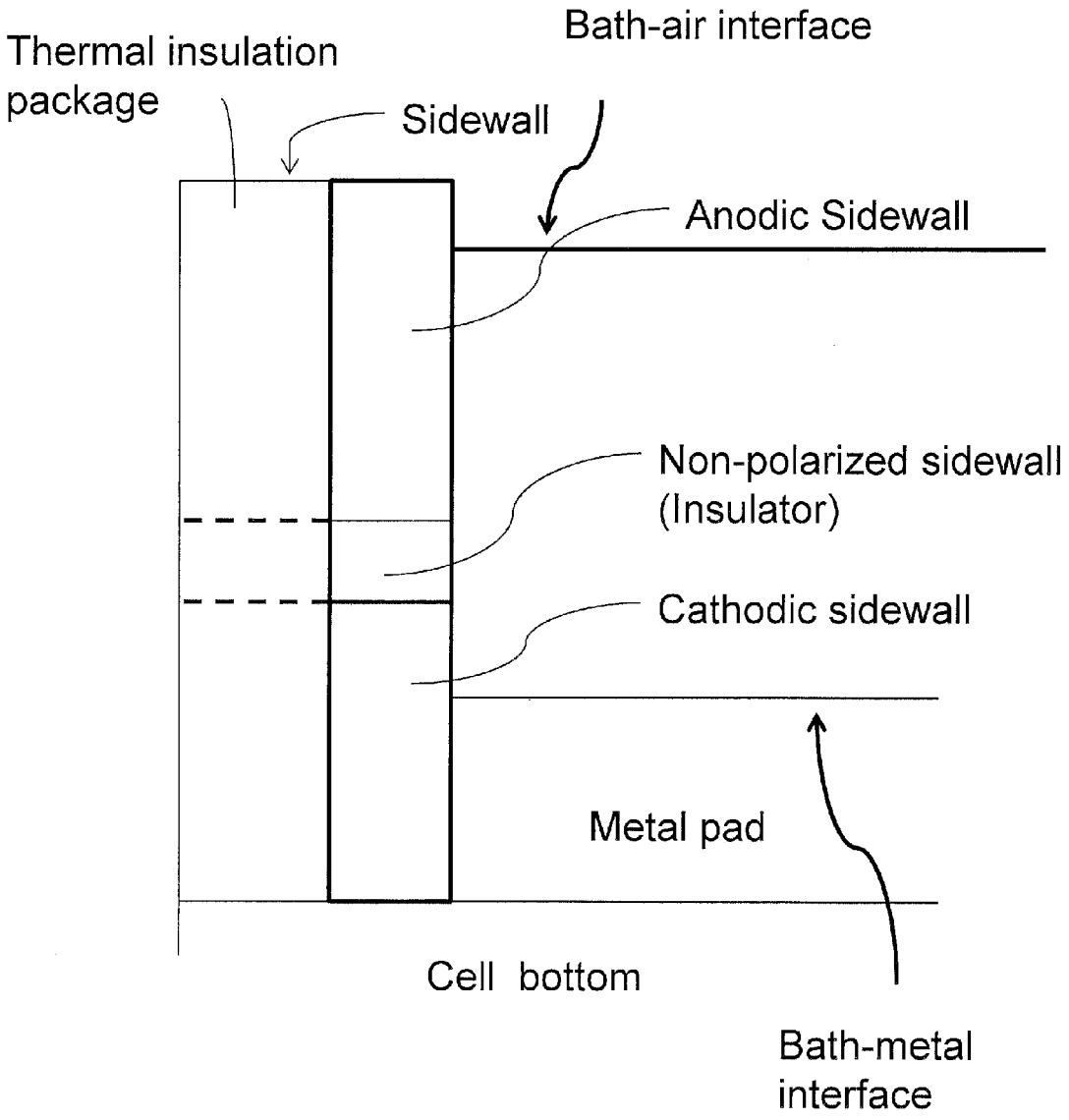
FIG. 17 depicts a partial cut-away side view of a cell body having a sidewall which includes an anodic sidewall portion, a cathodic sidewall portion, and an insulator (e.g. electrical insulator between the anodic and cathodic sidewall portions), in accordance with the instant disclosure.
Figure 18:
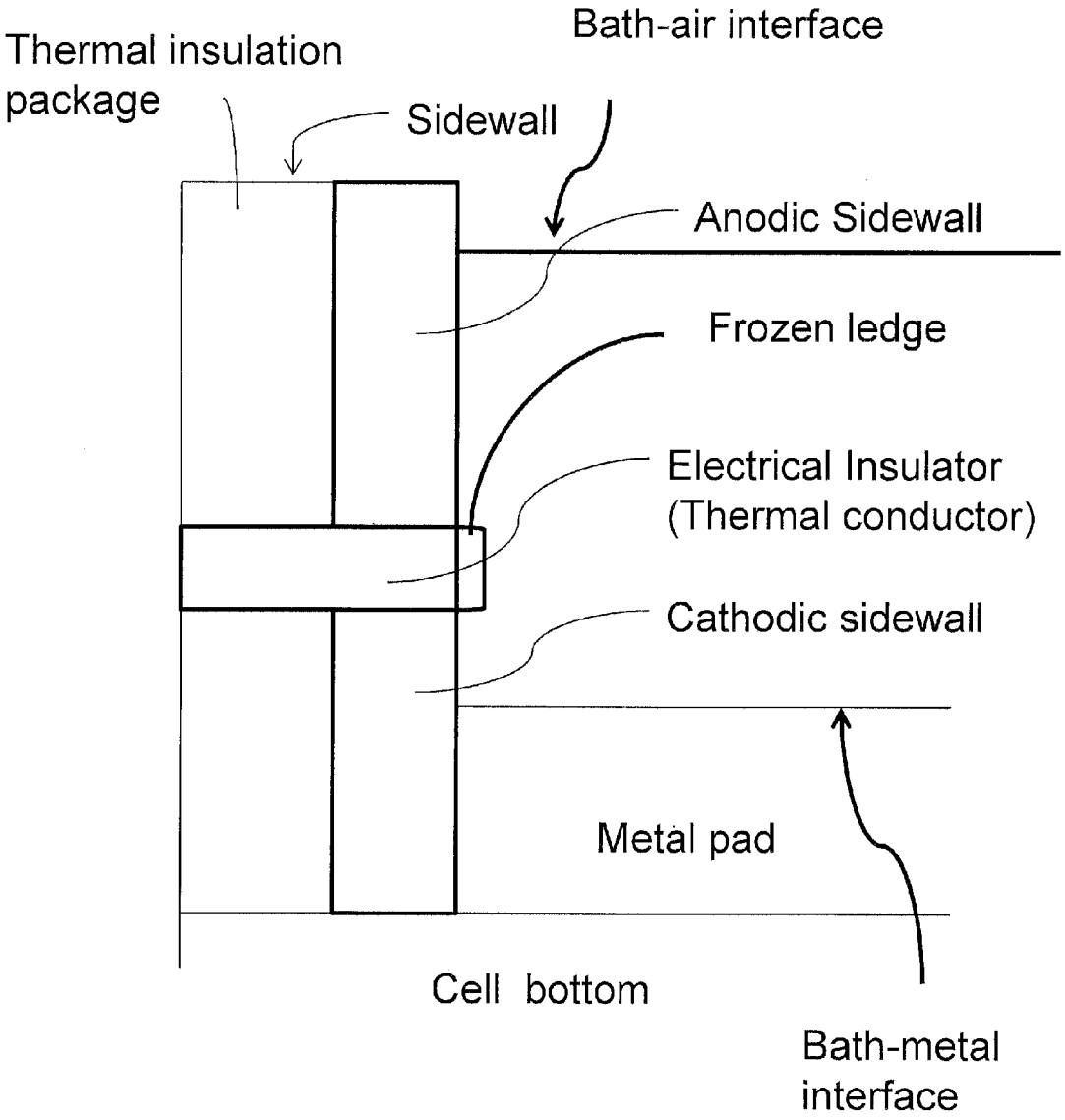
FIG. 18 depicts a partial cut-away side view of a cell body having a sidewall which includes an anodic sidewall portion, a cathodic sidewall portion, and an electrical insulator (thermal conductor material with frozen ledge) between the anodic and cathodic sidewall portions), in accordance with the instant disclosure.
Figure 19:
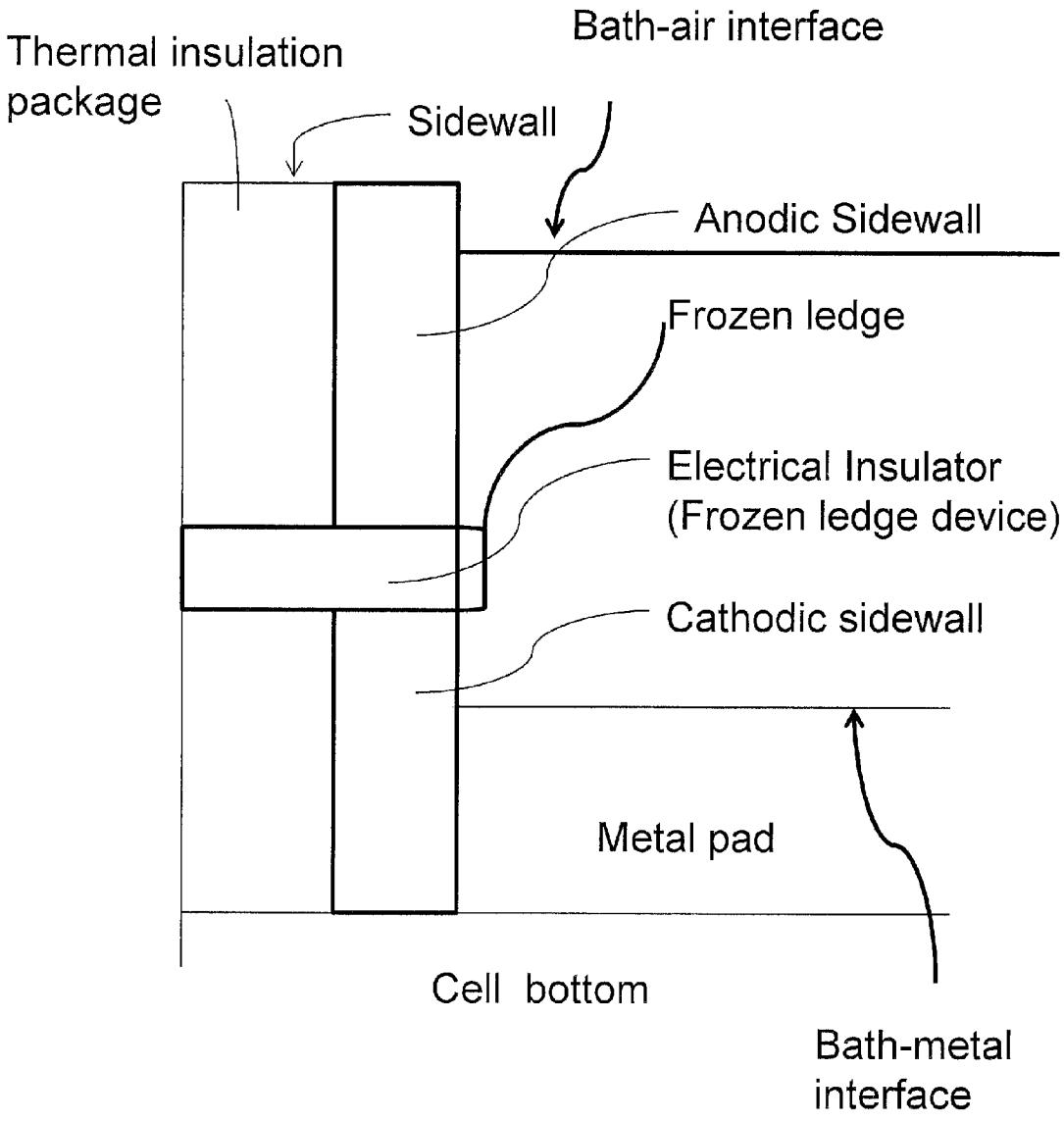
FIG. 19 depicts a partial cut-away side view of a cell body having a sidewall which includes an anodic sidewall portion, a cathodic sidewall portion, and an electrical insulator (frozen ledge device with a frozen ledge) between the anodic and cathodic sidewall portions), in accordance with the instant disclosure.
Figure 20:
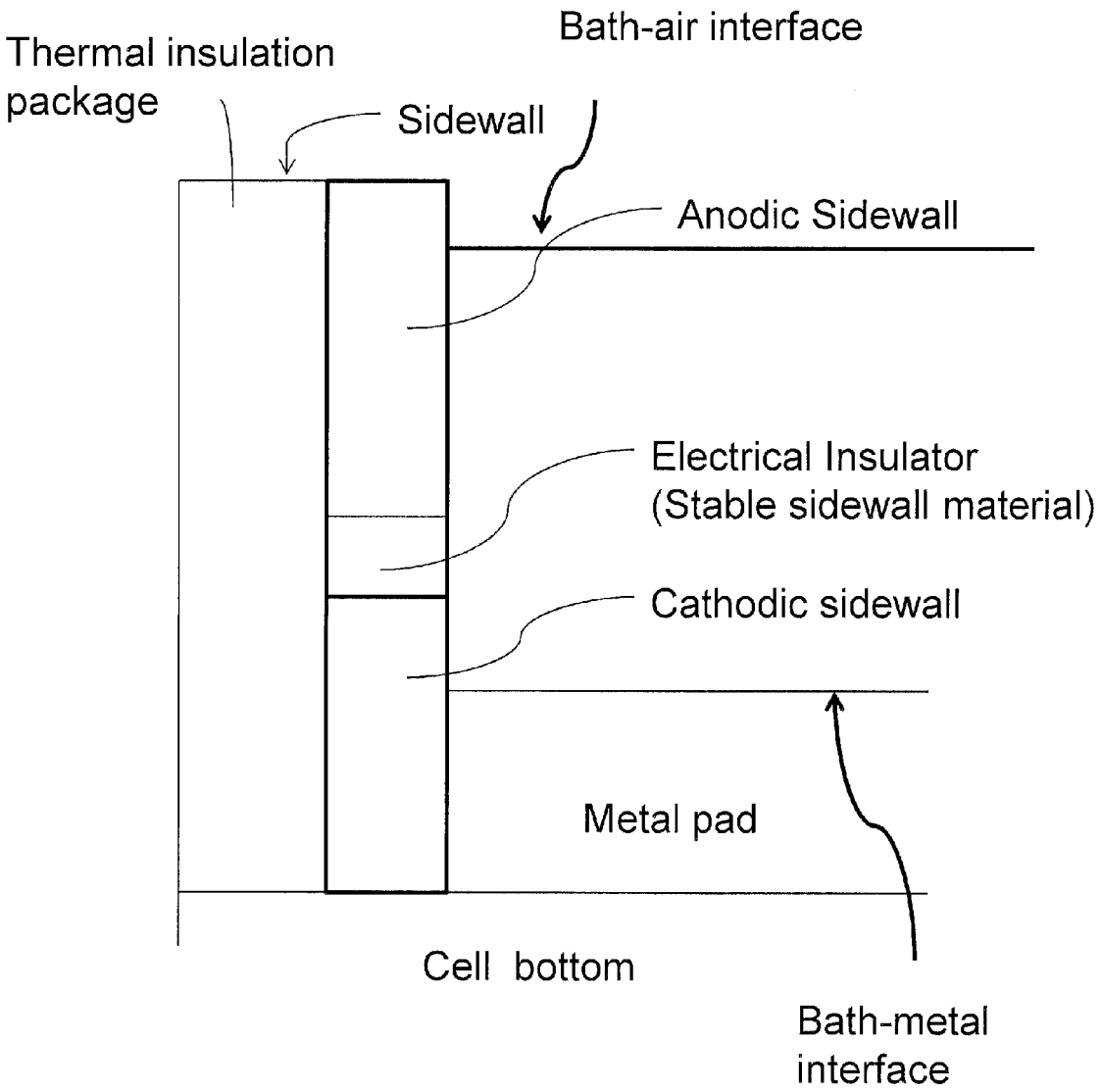
FIG. 20 depicts a partial cut-away side view of a cell body having a sidewall which includes an anodic sidewall portion, a cathodic sidewall portion, and an electrical insulator (stable sidewall material/non-reactive material) between the anodic and cathodic sidewall portions), in accordance with the instant disclosure.
Figure 21:
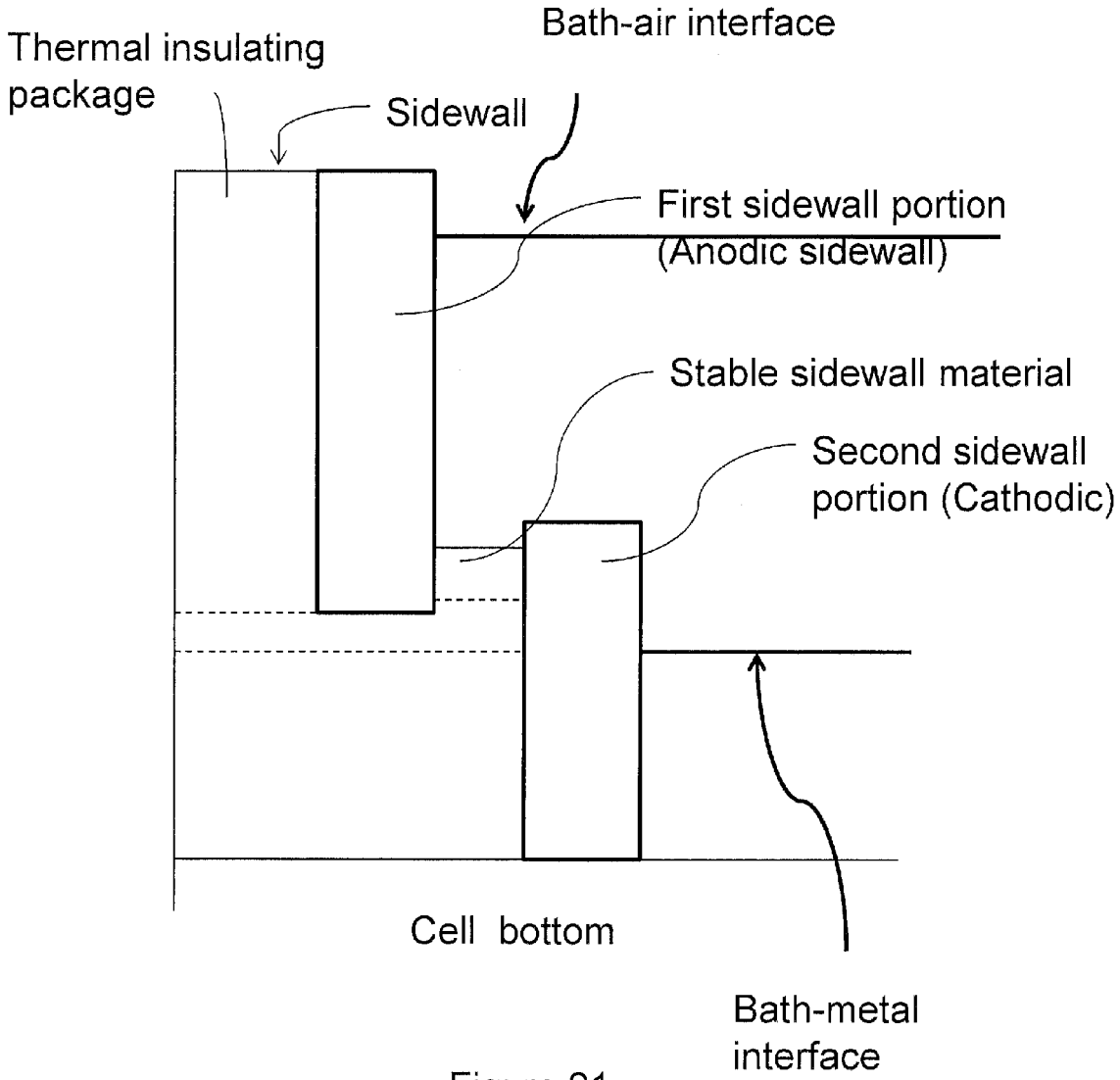
FIG. 21 depicts a partial cut-away side view of a cell body having a first sidewall portion which is anodic and a second sidewall portion which is cathodic, with an electrical insulator spanning the distance between the first sidewall portion and the second sidewall portion, in accordance with the instant disclosure.

Reference will now be made in detail to the accompanying drawings, which at least assist in illustrating various pertinent embodiments of the present invention.

As used herein, "electrolysis" means any process that brings about a chemical reaction by passing electric current through a material. In some embodiments, electrolysis occurs where a species of metal is reduced in an electrolysis cell to produce a metal product. Some non-limiting examples of electrolysis include primary metal production. Some non-limiting examples of electrolytically produced metals include: rare earth metals, non-ferrous metals (e.g. copper, nickel, zinc, magnesium, lead, titanium, aluminum, and rare earth metals).

As used herein, "electrolysis cell" means a device for producing electrolysis. In some embodiments, the electrolysis cell includes a smelting pot, or a line of smelters (e.g. multiple pots). In one non-limiting example, the electrolysis cell is fitted with electrodes, which act as a conductor, through which a current enters or leaves a nonmetallic medium (e.g. electrolyte bath).

As used herein, "electrode" means positively charged electrodes (e.g. anodes) or negatively charged electrodes (e.g. cathodes).

As used herein, "anode" means the positive electrode (or terminal) by which current enters an electrolytic cell. In some embodiments, the anodes are constructed of electrically conductive materials. Some non-limiting examples of anode materials include: metals, metal alloys, oxides, ceramics, cermets, carbon, and combinations thereof.

As used herein, "anode assembly" includes one or more anode(s) connected with, a support. In some embodiments, the anode assembly includes: the anodes, the support (e.g. refractory block and other bath resistant materials), and the electrical bus work.

As used herein, "support" means a member that maintains another object(s) in place. In some embodiments, the support is the structure that retains the anode(s) in place. In one embodiment, the support facilitates the electrical connection of the electrical bus work to the anode(s). In one embodiment, the support is constructed of a material that is resistant to attack from the corrosive bath. For example, the support is constructed of insulating material, including, for example refractory material. In some embodiments, multiple anodes are connected (e.g. mechanically and electrically) to the support (e.g. removably attached), which is adjustable and can be raised, lowered, or otherwise moved in the cell.

As used herein, "electrical bus work" refers to the electrical connectors of one or more component. For example, the anode, cathode, and/or other cell components can have electrical bus work to connect the components together. In some embodiments, the electrical bus work includes pin connectors in the anodes, the wiring to connect the anodes and/or cathodes, electrical circuits for (or between) various cell components, and combinations thereof.

As used herein, "cathode" means the negative electrode or terminal by which current leaves an electrolytic cell. In some embodiments, the cathodes are constructed of an electrically conductive material. Some non-limiting examples of the cathode material include: carbon, cermet, ceramic material(s), metallic material(s), and combinations thereof. In one embodiment, the cathode is constructed of a transition metal boride compound, for example $TiB_2$. In some embodiments, the cathode is electrically connected through the bottom of the cell (e.g. current collector bar and electrical buswork). As some non-limiting examples, cathodes and/or cathodically polarized sidewall portions are constructed of: $TiB_2$, $TiB_2$—C composite materials, boron nitride, zirconium borides, hafnium borides, graphite, and combinations thereof.

As used herein, "cathode assembly" refers to the cathode (e.g. cathode block), the current collector bar, the electrical bus work, and combinations thereof.

As used herein "current collector bar" refers to a bar that collects current from the cell. In one non-limiting example, the current collector bar collects current from the cathode and transfers the current to the electrical buswork to remove the current from the system.

As used herein, "electrolyte bath" refers to a liquefied bath having at least one species of metal to be reduced (e.g. via an electrolysis process). A non-limiting example of the electrolytic bath composition includes: NaF—$AlF_3$ (in an aluminum electrolysis cell), NaF, $AlF_3$, $CaF_2$, $MgF_2$, LiF, KF, and combinations thereof—with dissolved alumina.

As used herein, "molten" means in a flowable form (e.g. liquid) through the application of heat. As a non-limiting example, the electrolytic bath is in molten form (e.g. at least about 750° C.). As another example, the metal product that forms at the bottom of the cell (e.g. sometimes called a "metal pad") is in molten form.

In some embodiments, the molten electrolyte bath/cell operating temperature is: at least about 750° C.; at least about 800° C.; at least about 850° C.; at least about 900° C.; at least about 950° C.; or at least about 980° C. In some embodiments, the molten electrolyte bath/cell operating temperature is: not greater than about 750° C.; not greater than about 800° C.; not greater than about 850° C.; not greater than about 900° C.; not greater than about 950° C.; or not greater than about 980° C.

As used herein, "metal product" means the product which is produced by electrolysis. In one embodiment, the metal product forms at the bottom of an electrolysis cell as a metal pad. Some non-limiting examples of metal products include: aluminum, nickel, magnesium, copper, zinc, and rare earth metals.

As used herein, "sidewall" means the wall of an electrolysis cell. In some embodiments, the sidewall runs parametrically around the cell bottom and extends upward from the cell bottom to defines the body of the electrolysis cell and define the volume where the electrolyte bath is held. In some embodiments, the sidewall includes: an outer shell, a thermal insulation package, and an inner wall. In some embodiments, the inner wall and cell bottom are configured to contact and retain the molten electrolyte bath, the feed material which is provided to the bath (i.e. to drive electrolysis) and the metal product (e.g. metal pad). In some embodiments, the sidewall (inner sidewall) includes a polarized sidewall portion. In some embodiments, the sidewall (inner sidewall) includes a non-reactive sidewall portion (e.g. stable sidewall portion). In some embodiments, the sidewall (inner sidewall) includes: a thermal conductor portion. In some embodiments, the sidewall (inner sidewall) includes: a frozen ledge device. In some embodiments, the sidewall (inner sidewall) is configured to accept and retain a protecting deposit along a portion thereof.

As used herein, "transverse" means an angle between two surfaces. In some embodiments, the surfaces make an acute or an obtuse angle. In some embodiments, transverse includes an angle at or that is equal to the perpendicular angle or almost no angle, i.e. surfaces appearing as continuous (e.g. 180°). In some embodiments, a portion of the sidewall (inner wall) is transverse, or angled towards the cell bottom. In some embodiments, the entire sidewall is transverse to the cell bottom.

In some embodiments, the entire wall is transverse. In some embodiments, a portion of the wall (first sidewall portion, second sidewall portion, shelf, trough, directing member) is transverse (or, sloped, angled, curved, arcuate).

In some embodiments, the shelf is transverse. In some embodiments, the second sidewall portion is transverse. Without being bound by any particular theory or mechanism, it is believed that by configuring the sidewall (first sidewall portion, second sidewall portion, trough, or shelf) in a transverse manner, it is possible to promote certain characteristics of the cell in operation (e.g. metal drain, feed material direction into the cell/towards the cell bottom). As a non-limiting example, by providing a transverse sidewall, the sidewall is configured to promote feed material capture into a protecting deposit in a trough or shelf (e.g. angled towards/or is configured to promote metal drain into the bottom of the cell. an angle to the shelf, In some embodiments, the first sidewall portion is transverse (angled/sloped) and the second sidewall portion is not sloped. In some embodiments, the first sidewall portion is not sloped and the second sidewall portion is sloped. In some embodiments, both the first sidewall portion and the second sidewall portion are transverse (angled/sloped).

In some embodiments, the base (or feed block) is transverse (sloped or angled). In some embodiments, the upper portion of the shelf/trough or second sidewall portion is sloped, angled, flat, transverse, or curved.

As used herein, "wall angle", means the angle of the inner sidewall relative to the cell bottom measurable in degrees. For example, a wall angle of 0 degrees refers to a vertical angle (or no angle). In some embodiments, the wall angle comprises: an angle (theta) from 0 degrees to about 30 degrees. In some embodiments, the wall angle comprises an angle (theta) from 0 degrees to 60 degrees. In some embodiments, the wall angle comprises an angle (theta) from about 0 to about 85 degrees.

In some embodiments, the wall angle (theta) is: at least about 5°; at least about 10°; at least about 15°; at least about 20°; at least about 250; at least about 30°; at least about 35°; at least about 40°; at least about 45°; at least about 50°; at least about 55°; or at least about 60°. In some embodiments, the wall angle (theta) is: not greater than about 5°; not greater than about 10°; not greater than about 15°; not greater than about 20°; not greater than about 25°; not greater than about 30°; not greater than about 35°; not greater than about 40°; not greater than about 45°; not greater than about 50°; not greater than about 55°; or not greater than about 60°.

As used herein, "outer shell" means an outer-most protecting cover portion of the sidewall. In one embodiment, the outer shell is the protecting cover of the inner wall of the electrolysis cell. As non-limiting examples, the outer shell is constructed of a hard material that encloses the cell (e.g. steel).

As used herein, "frozen" refers to something that is rigid and immobilized as a result of thermal energy.

As used herein, "ledge" refers to projecting member.

As used herein, "frozen ledge" refers to something that is rigid and immobilized in a projecting configuration. In some embodiments, the frozen ledge includes a portion of the electrolytic bath adjacent to the sidewall that freezes to form a rigid ledge along a portion of the sidewall (e.g. in a generally horizontal manner). In some embodiments, the frozen ledge is formed and/or maintained by the sidewall materials (e.g. frozen ledge device or thermal conductor material) which are configured to extract/transfer heat from the bath adjacent to the sidewall. In some embodiments, the frozen ledge is formed due to temperature differences in the bath (e.g. lower temperature along the sidewall as compared to the center of the cell).

As used herein, "first sidewall portion" means a portion of the inner sidewall.

As used herein, "second sidewall portion" means another portion of the inner sidewall. In some embodiments, the second portion is a distance (e.g. longitudinally spaced) from the first portion. As one non-limiting example, the second sidewall portion is an upright member having a length and a width, wherein the second portion is spaced apart from the first portion.

In some embodiments, the second portion cooperates with the first portion to retain a material or object (e.g. protecting deposit, portion of frozen ledge).

In some embodiments, the second portion is of a continuous height, while in other embodiments, the second portion's height varies. In one embodiment, the second portion is constructed of a material that is resistant to the corrosive environment of the bath and resistant to the metal product (e.g. metal pad), and thus, does not break down or otherwise react in the bath. As some non-limiting examples, the wall is constructed of: $Al_2O_3$, $TiB_2$, $TiB_2$—C, SiC, $Si_3N_4$, BN, a bath component that is at or near saturation in the bath chemistry (e.g. alumina), and combinations thereof.

In some embodiments, the second portion is electrically conductive and assists in transferring current from the bath to the cathode(s). In some embodiments, the second portion is cast, hot pressed, or sintered into the desired dimension, theoretical density, porosity, and the like. In some embodiments, the second portion is secured to one or more cell components in order to keep the second portion in place.

As used herein, "directing member" means a member which is configured to direct an object or material in a particular manner. In some embodiments, the directing member is adapted and configured to direct a feed material into a trough (e.g. to be retained in the trough as protecting deposit.) In some embodiments, the directing member is suspended in the cell between the first sidewall portion and the second sidewall, and above the trough in order to direct the flow of the feed material into the trough. In some embodiments, the directing member comprises a polarized sidewall portion (e.g. cathodically polarized sidewall portion or anodically polarized sidewall portion). In some embodiments, the directing member is constructed of a material (at least one bath component) which is present in the bath chemistry at or near saturation, such that in the bath the directing member is maintained. In some embodiments, the directing member is configured to attach to a frame (e.g. of bath resistant material), where the frame is configured to adjust the directing member in the cell (i.e. move the directing member laterally (e.g. up or down relative to the cell height) and/or move the directing member longitudinally (e.g. left or right relative to the trough/cell bottom).

In some embodiments, the dimension of and/or the location of the directing member is selected to promote a certain configuration of the protecting deposit and/or a predetermined feed material flow pattern into the trough. In some embodiments, the directing member is attached to the anode assembly. In some embodiments, the directing member is attached to the sidewall of the cell. In some embodiments, the directing member is attached to the feed device (e.g. frame which holds the feed device into position. As non-limiting examples, the directing member comprises a plate, a rod, a block, an elongated member form, and combinations thereof. Some non-limiting examples of directing member materials include: anode materials; SiC; SiN; and/or components which are present in the bath at or near saturation such that the directing member is maintained in the bath.

As used herein, "longitudinally spaced" means the placement of one object from another object in relation to a length. In some embodiments, laterally spaced (i.e. the second sidewall portion from the first sidewall portion—or the trough) means: at least 1", at least 1½", at least 2", at least 2½", at least 3", at least 3½", at least 4", at least 4½", at least 5", at least 5½", at least 6", at least 6½", at least 7", at least 7½", at least 8", at least 8½", at least 9", at least 9½", at least 10", at least 10½", at least 11", at least 11½", or at least 12".

In some embodiments, laterally spaced (i.e. the second sidewall portion from the first sidewall portion—or the trough) means: not greater than 1", not greater than 1½", not greater than 2", not greater than 2½", not greater than 3", not greater than 3½", not greater than 4", not greater than 4½", not greater than 5", not greater than 5½", not greater than 6", not greater than 6½", not greater than 7", not greater than 7½", not greater than 8", not greater than 8½", not greater than 9", not greater than 9½", not greater than 10", not greater than 10½", not greater than 11", not greater than 11½", or not greater than 12". As used herein, "laterally spaced" means the placement of one object from another object in relation to a width.

In some embodiments, the first sidewall portion is set a given distance from the second sidewall portion to define a trough (i.e. having trough width). In some embodiments, the trough width is from 10 mm to not greater than 500 mm. In some embodiments, the trough width is from 50 mm to not greater than 200 mm. In some embodiments, the trough width is from 75 mm to not greater than 150 mm.

In some embodiments, the trough (e.g. trough width) is: at least 10 mm; at least 20 mm; at least 30 mm; at least 40 mm; at least 50 mm; at least 60 mm; at least 70 mm; at least 80 mm; at least 90 mm; at least 100 mm; at least 110 mm; at least 120 mm; at least 130 mm; at least 140 mm; at least 150 mm; at least 160 mm; at least 170 mm; at least 180 mm; at least 190 mm; at least 200 mm; at least 210 mm; at least 220 mm; at least 230 mm; at least 240 mm; at least 250 mm; at least 260 mm; at least 270 mm; at least 280 mm; at least 290 mm; at least 300 mm; at least 310 mm; at least 320 mm; at least 330 mm; at least 340 mm; at least 350 mm; at least 360 mm; at least 370 mm; at least 380 mm; at least 390 mm; at least 400 mm; at least 410 mm; at least 420 mm; at least 430 mm; at least 440 mm; at least 450 mm; at least 460 mm; at least 470 mm; at least 480 mm; at least 490 mm; or at least 500 mm.

In some embodiments, the trough (e.g. trough width) is: not greater than 10 mm; not greater than 20 mm; not greater than 30 mm; not greater than 40 mm; not greater than 50 mm; not greater than 60 mm; not greater than 70 mm; not greater than 80 mm; not greater than 90 mm; not greater than 100 mm; not greater than 110 mm; not greater than 120 mm; not greater than 130 mm; not greater than 140 mm; not greater than 150 mm; not greater than 160 mm; not greater than 170 mm; not greater than 180 mm; not greater than 190 mm; not greater than 200 mm; not greater than 210 mm; not greater than 220 mm; not greater than 230 mm; not greater than 240 mm; not greater than 250 mm; not greater than 260 mm; not greater than 270 mm; 280 mm; not greater than 290 mm; at least 300 mm; at least 310 mm; at least 320 mm; at least 330 not greater than mm; not greater than 340 mm; not greater than 350 mm; not greater than 360 mm; not greater than 370 mm; not greater than 380 mm; not greater than 390 mm; not greater than 400 mm; not greater than 410 mm; not greater than 420 mm; not greater than 430 mm; not greater than 440 mm; not greater than 450 mm; not greater than 460 mm; not greater than 470 mm; not greater than 480 mm; not greater than 490 mm; or not greater than 500 mm.

As used herein, "at least" means greater than or equal to.

As used herein, "not greater than" means less than or equal to.

As used herein, "trough" means a receptacle for retaining something. In one embodiment, the trough is defined by the first sidewall portion, the second sidewall portion, and the base (or bottom of the cell). In some embodiments, the trough retains the protecting deposit. In other embodiments, the trough retains a frozen ledge or frozen portion (e.g. defined via a thermal conductor or the frozen ledge device). In some embodiments the trough retains a feed material in the form of a protecting deposit, such that the trough is configured to prevent the protecting deposit from moving within the cell (i.e. into the metal pad and/or electrode portion of the cell).

In some embodiments, the trough further comprises a height (e.g. relative to the sidewall). As non-limiting embodiments, the trough height (as measured from the bottom of the cell to the bath/vapor interface comprises: at least ¼", at least ½", at least ¾", at least 1", at least 1¼", at least 1½", at least 1¾", at least 2", at least 2¼", at least 2½", at least 2¾", at least 3", 3¼", at least 3½", at least 3¾", at least 4", 4¼", at least 4½", at least 4¾", at least 5", 5¼", at least 5½", at least 5¾", or at least 6". In some embodiments, the trough height comprises: at least 6" at least 12" at least 18", at least 24", or at least 30".

As non-limiting embodiments, the trough height (as measured from the bottom of the cell to the bath/vapor interface comprises: not greater than ¼", not greater than ½", not greater than ¾", not greater than 1", not greater than 1¼", not greater than 1½", not greater than 1¾", not greater than 2", not greater than 2¼", not greater than 2½", not greater than 2¾", not greater than 3", 3¼", not greater than 3½", not greater than 3¾", not greater than 4", 4¼", not greater than 4½", not greater than 4¾", not greater than 5", 5¼ ", not greater than 5½", not greater than 5¾", or not greater than 6". In some embodiments, the trough height comprises: not greater than 6" not greater than 12" not greater than 18", not greater than 24", or not greater than 30".

In some embodiments, the second sidewall portion extends in an upward position (i.e. relative to the cell bottom), such that the second sidewall portion overlaps for a given distance with the first sidewall portion (i.e. to define a portion where two sidewall portions overlap, a common "trough overlap"). In some embodiments, the trough overlap is quantifiable via the overlap relative to the overall cell wall height (e.g. expressed as a percentage). In some embodiments, the trough overlap is from 0% to not greater than 90% of the total cell wall height. In some embodiments, the trough overlap is from 20% to not greater than 80% of the total cell wall height. In some embodiments, the trough overlap is from 40% to not greater than 60% of the total cell wall height.

In some embodiments, the trough overlap is: 0% (i.e. no overlap); at least 5% of the total wall height; at least 10% of the total wall height; at least 15% of the total wall height; at least 20% of the total wall height; at least 25% of the total wall height; at least 30% of the total wall height; at least 35% of the total wall height; at least 40% of the total wall height; at least 45% of the total wall height; at least 50% of the total wall height; at least 55% of the total wall height; at least 60% of the total wall height; at least 65% of the total wall height; at least 70% of the total wall height; at least 75% of the total wall height; at least 80% of the total wall height; at least 85% of the total wall height; or at least 90% of the total wall height.

In some embodiments, the trough overlap is: 0% (i.e. no overlap); not greater than 5% of the total wall height; not greater than 10% of the total wall height; not greater than 15% of the total wall height; not greater than 20% of the total wall height; not greater than 25% of the total wall height; not greater than 30% of the total wall height; not greater than 35% of the total wall height; not greater than 40% of the total wall height; not greater than 45% of the total wall height; not greater than 50% of the total wall height; not greater than 55% of the total wall height; not greater than 60% of the total wall height; not greater than 65% of the total wall height; not greater than 70% of the total wall height; not greater than 75% of the total wall height; not greater than 80% of the total wall height; not greater than 85% of the total wall height; or not greater than 90% of the total wall height.

In some embodiments, the trough comprises a polarized sidewall portion (e.g. cathodically polarized sidewall portion). In some embodiments, the trough is constructed of a material (at least one bath component) which is present in the bath chemistry at or near saturation, such that in the bath it is maintained.

As used herein, "protecting deposit" refers to an accumulation of a material that protects another object or material. As a non-limiting example, a "protecting deposit" refers to the feed material that is retained in the trough. In some embodiments, the protecting deposit is: a solid; a particulate form; a sludge; a slurry; and/or combinations thereof. In some embodiments, the protecting deposit is dissolved into the bath (e.g. by the corrosive nature of the bath) and/or is consumed through the electrolytic process. In some embodiments, the protecting deposit is retained in the trough, between the first sidewall portion and the second sidewall portion. In some embodiments, the protecting deposit is configured to push the metal pad (molten metal) away from the sidewall, thus protecting the sidewall from the bath-metal interface. In some embodiments, the protecting deposit is dissolved via the bath to provide a saturation at or near the cell wall which maintains the stable/non-reactive sidewall material (i.e. composed of a bath component at or near saturation). In some embodiments the protecting deposit comprises an angle of deposit (e.g. the protecting deposit forms a shape as it collects in the trough), sufficient to protect the sidewall and provide feed material to the bath for dissolution.

As used herein, "feed material" means a material that is a supply that assists the drive of further processes. As one non-limiting example, the feed material is a metal oxide which drives electrolytic production of rare earth and/or non-ferrous metals (e.g. metal products) in an electrolysis cell. In some embodiments, the feed material once dissolved or otherwise consumed, supplies the electrolytic bath with additional starting material from which the metal oxide is produced via reduction in the cell, forming a metal product. In some embodiments, the feed material has two non-limiting functions: (1) feeding the reactive conditions of the cell to produce metal product; and (2) forming a feed deposit in the channel between the wall at the inner sidewall to protect the inner sidewall from the corrosive bath environment. In some embodiments, the feed material comprises alumina in an aluminum electrolysis cell. Some non-limiting examples of feed material in aluminum smelting include: smelter grade alumina (SGA), alumina, tabular aluminum, and combinations thereof. In the smelting of other metals (non-aluminum), feed materials to drive those reactions are readily recognized in accordance with the present description. In some embodiments, the feed material is of sufficient size and density to travel from the bath-air interface, through the bath and into the trough to form a protecting deposit.

As used herein, "average particle size" refers to the mean size of a plurality of individual particles. In some embodiments, the feed material in particulate (solid) form having an average particle size. In one embodiment, the average particle size of the feed material is large enough so that it settles into the bottom of the cell (e.g. and is not suspended in the bath or otherwise "float" in the bath). In one embodiment, the average particle size is small enough so that there is adequate surface area for surface reactions/dissolution to occur (e.g. consumption rate).

As used herein, "feed rate" means a certain quantity (or amount) of feed in relation to a unit of time. As one non-limiting example, feed rate is the rate of adding the feed material to the cell. In some embodiments, the size and/or position of the protecting deposit is a function of the feed rate. In some embodiment, the feed rate is fixed. In another embodiment, the feed rate is adjustable. In some embodiments, the feed is continuous. In some embodiments, the feed is discontinuous.

As used herein, "consumption rate" means a certain quantity (or amount) of use of a material in relation to a unit of time. In one embodiment, consumption rate is the rate that the feed material is consumed by the electrolysis cell (e.g. by the bath, and/or consumed to form metal product).

In some embodiments, the feed rate is higher than the consumption rate. In some embodiment, the feed rate is configured to provide a protecting deposit above the bath-air interface.

As used herein, "feeder" (sometimes called a feed device) refers to a device that inputs material (e.g. feed) into something. In one embodiment, the feed device is a device that feeds the feed material into the electrolysis cell. In some embodiments, the feed device is automatic, manual, or a combination thereof. As non-limiting examples, the feed device is a curtain feeder or a choke feeder. As used herein, "curtain feeder" refers to a feed device that moves along the sidewall (e.g. with a track) to distribute feed material. In one embodiment, the curtain feeder is movably attached so that it moves along at least one sidewall of the electrolysis cell. As used herein, "choke feeder" refers to a feed device that is stationary on a sidewall to distribute feed material into the cell. In some embodiments, the feed device is attached to the sidewall by an attachment apparatus. Non-limiting examples include braces, and the like.

In some embodiments, the feed device is automatic. As used herein, "automatic" refers to the capability to operate independently (e.g. as with machine or computer control). In some embodiments, the feed device is manual. As used herein, "manual" means operated by human effort.

As used herein, "feed block" refers to feed material in solid form (e.g. cast, sintered, hot pressed, or combinations thereof). In some embodiments, the base of the trough comprises a feed block. As one non-limiting example, the feed block is made of alumina. In some embodiments, the feed block is a solid block (e.g. of any shape or dimension) of the feed material and/or another bath component.

As used herein, "polarized" means a material that has a positive or negative electric potential imparted in it.

As used herein, "polarized sidewall" refers to a wall portion that is polarized to have a charge. In one embodiment, polarized sidewall is a portion of the inner wall of the cell that has a positive polarization (e.g. anodic or anodically polarized), negative polarization (cathodic or cathodically polarized), or combination thereof. In some embodiments, the polarized sidewall assists in the electrolysis process. In some embodiments, the polarized sidewall portions include a first material and a second material, where the first material is different from the second material.

In some embodiments, the polarized sidewall comprises a percentage of the total sidewall/percentage of the total surface area of the sidewall (e.g. portion of the sidewall attached to the thermal insulation package). In some embodiments, the polarized sidewall is: at least about 1%; at least about 5%; at least about 10%; at least about 15%; at least about 20%; at least about 25%; at least about 30%; at least about 35%; at least about 40%; at least about 45%; at least about 50%; at least about 55%; at least about 60%; at least about 65%; at least about 70%; at least about 75%; at least about 80%; at least about 85%; at least about 90%; at least about 95%; or 100% of the surface area of the sidewall (i.e. sidewall configured to attach to the thermal insulation package, or second sidewall portion).

In some embodiments, the polarized sidewall is: not greater than about 1%; not greater than about 5%; not greater than about 10%; not greater than about 15%; not greater than about 20%; not greater than about 25%; not greater than about 30%; not greater than about 35%; not greater than about 40%; not greater than about 45%; not greater than about 50%; not greater than about 55%; not greater than about 60%; not greater than about 65%; not greater than about 70%; not greater than about 75%; not greater than about 80%; not greater than about 85%; not greater than about 90%; not greater than about 95%; or 100% of the surface area of the sidewall (i.e. sidewall configured to attach to the thermal insulation package, or second sidewall portion).

As used herein, "anodic sidewall" (also called an anodically polarized sidewall), means a sidewall material that has a positive charge on it (or through it) so that the sidewall acts in an anodic fashion in an electrolysis cell. In some embodiments, the anodic sidewall is located above the cell bottom. In some embodiments, the anodic sidewall is located at a height which is above the metal pad. In some embodiments, the anodic sidewall is located at a height above the bath-metal interface. In some embodiments, the electrically connected portion of the anodic sidewall is located in an elevated position along the inner sidewall, remote from the bottom.

As used herein, "anodic sidewall electrical connection" means the electrical connection which provides the positive charge to the surface of the anodic sidewall. In some embodiments, the electrical connection supplies current to the anodic sidewall. In some embodiments, the electrical connection includes a conductor pin. In some embodiments, the electrical connection includes a conductor bar. As one non-limiting example, the electrical connection is the collector bar and the conductor pin, which are embedded inside of the anodic sidewall.

As used herein, "cathodic sidewall", means a sidewall that has a negative charge on it (or through it) so that it acts in a cathodic fashion in an electrolysis cell. In some embodiments, the cathodic sidewall is in communication with the cell bottom. In some embodiments, the cathodic sidewall is in communication with the metal product/metal pad. In some embodiments, the cathodic sidewall is at a height which is below the bath-air interface. In some embodiments, the cathodic sidewall is located in the electrolyte bath.

As used herein, "cathodic sidewall electrical connection" means the electrical connection which provides the negative charge to the surface of the anodic sidewall. In some embodiments, the electrical connection removes current from the cathodic sidewall. In some embodiments, the electrical connection includes a conductor bar. As one non-limiting example, the electrical connection is the collector bar, which is embedded inside of the cathodic sidewall. In some embodiments, the electrical connection is provided by contact of (e.g. mechanical connection/attachment) of the cathodic sidewall to the cathode. In some embodiments, the electrical connection is provided by the contact of the cathodic sidewall to the metal pad, which is cathodic due to its contact with the cathode.

As used herein, "non-polarized" means an object or material which is not configured to carry current (i.e. is not anodically or cathodically polarized). In some embodiments, the non-polarized sidewall is configured to provide electrical insulation to at least one (or two) polarized sidewall portions. Some non-limiting examples of a non-polarized material include: a thermal conductor material, a non-reactive material, and a frozen ledge device.

In some embodiments, the non-polarized sidewall comprises a percentage of the total sidewall/percentage of the total surface area of the sidewall (e.g. portion of the sidewall attached to the thermal insulation package). In some embodiments, the non-polarized sidewall is: at least about 1%; at least about 5%; at least about 10%; at least about 15%; at least about 20%; at least about 25%; at least about 30%; at least about 35%; at least about 40%; at least about 45%; at least about 50%; at least about 55%; at least about 60%; at least about 65%; at least about 70%; at least about 75%; at least about 80%; at least about 85%; at least about 90%; at least about 95%; or 100% of the surface area of the sidewall (i.e. sidewall configured to attach to the thermal insulation package, or second sidewall portion).

In some embodiments, the non-polarized sidewall is: not greater than about 1%; not greater than about 5%; not greater than about 10%; not greater than about 15%; not greater than about 20%; not greater than about 25%; not greater than about 30%; not greater than about 35%; not greater than about 40%; not greater than about 45%; not greater than about 50%; not greater than about 55%; not greater than about 60%; not greater than about 65%; not greater than about 70%; not greater than about 75%; not greater than about 80%; not greater than about 85%; not greater than about 90%; not greater than about 95%; or 100% of the surface area of the sidewall (i.e. sidewall configured to attach to the thermal insulation package, or second sidewall portion).

As used herein, "thermal conductor" refers to a substance (or medium) that conducts thermal energy (e.g. heat). In some embodiments, the thermal conductor material is a portion of the sidewall. In some embodiments, the thermal conductor material is configured to transfer heat from the molten electrolyte bath through its body, thus removing heat from the cell. In some embodiments, due to the heat transfer across the face of the thermal conductor, a frozen ledge portion is generated at the bath-thermal conductor interface. In some embodiments, the frozen ledge defined by the thermal conductor acts as an electrical insulator along a portion of the sidewall of the cell. Some non-limiting examples of thermal conductor materials include: SiC, graphite, metal, or metal alloys, Si3N4, BN, stainless steel, metal, and metal alloy, and combinations thereof.

As used herein, "insulator", means a material or an object that does not easily allow electricity, to pass through it. As a non-limiting example, an insulator refers to a material that is resistant to the transfer of electricity. In some embodiments of the instant disclosure, insulators are provided along portions of the sidewall to electrically insulate one portion from another (e.g. an anodically polarized sidewall portion from a cathodically polarized sidewall portion; an anodically polarized sidewall portion from a cell bottom (or metal pad); or combinations thereof. Some non-limiting examples of insulators include: non-reactive (e.g. stable) sidewall materials, thermal conductor sidewalls, polarized sidewalls, and/or a frozen ledge device.

As used herein, "stable" means a material that is generally non-reactive and/or retains its properties within an environment. In some embodiments, the sidewall material is stable (or non-reactive, as set out below) in the electrolytic cell environment, given the cell conditions and operating parameters.

Though not wishing to be bound by a particular mechanism or theory, if the cell environment is maintained/kept constant (e.g. including maintaining the feed material in the cell at saturation for the particular cell system), then the sidewall material is truly stable in that it will not react or dissolve into the bath. However, an operating electrolytic cell is difficult, if not impossible to maintain at constant cell operating parameters, as the operating cell is characterized by constant change (at least as far as reducing feed material into metal product via electrochemistry). Without wanting to be bound by a particular mechanism or theory, it is believed that the temperature flux is changing (as the current flux and any other process variation will change the temperature of the cell/bath); the feed flux is ever changing, even with optimized distribution, as different feed locations and/or feed rates will impact solubility (i.e. of the stable material(s)) throughout the cell; and analytical tools and methods to quantify and control cell processes inherently have some attributable error to the calibration of solubility limits (e.g. LECO methods used to determine the alumina content in the cell has an error range of +/−5%).

In some embodiments, stable materials and/or non-reactive sidewall materials do not react or degrade (e.g. when the bath is at saturation for that particular material). In other embodiments, stable materials and/or non-reactive materials undergo a small amount of dissolution (i.e. within a predetermined threshold), such that the sidewall material does not fail cell during electrolysis and cell operation (i.e. maintains the molten electrolyte). In this embodiment, as the content of the feed material in the bath (i.e. quantifiable as % of saturation) inevitably varies as a function of cell operation, so too will the dissolution either cease or initiate, and/or the dissolution rate of the stable sidewall material decrease or increase.

In some embodiments, a stable sidewall is maintained via modulating dissolution. In some embodiments, dissolution is modulated to within acceptable limits (e.g. small amounts of and/or no dissolution) by controlled the feed rate and/or feed locations (e.g. to impact the % saturation of feed material in the bath).

In some embodiments, the cations of such component materials (Na, K, Rb, Cs, Be, Mg, Ca, Sr, Ba, Sc, Y, La, and Ce) are electrochemically less noble than the metal that is produced, so they are not consumed during electrolysis. Put another way, since the electrochemical potential of these materials is more negative than aluminum, in an aluminum electrolytic cell, these materials are less likely to be reduced.

As used here, "non-reactive sidewall" refers to a sidewall which is constructed or composed of (e.g. coated with) a material which is stable (e.g. non-reactive, inert, dimensionally stable, and/or maintained) in the molten electrolyte bath at cell operating temperatures (e.g. above 750° C. to not greater than 980° C.). In some embodiments, the non-reactive sidewall material is maintained in the bath due to the bath chemistry. In some embodiments, the non-reactive sidewall material is stable in the electrolyte bath since the bath comprises the non-reactive sidewall material as a bath component in a concentration at or near its saturation limit in the bath. In some embodiments, the non-reactive sidewall material comprises at least one component that is present in the bath chemistry. In some embodiments, the bath chemistry is maintained by feeding a feed material into the bath, thus keeping the bath chemistry at or near saturation for the non-reactive sidewall material, thus maintaining the sidewall material in the bath.

Some non-limiting examples of non-reactive sidewall materials include: Al; Li; Na; K; Rb; Cs; Be; Mg; Ca; Sr; Ba; Sc; Y; La; or Ce-containing materials, and combinations thereof. In some embodiments, the non-reactive material is an oxide of the aforementioned examples. In some embodiments, the non-reactive material is a halide salt and/or fluoride of the aforementioned examples. In some embodiments, the non-reactive material is an oxofluoride of the aforementioned examples. In some embodiments, the non-reactive material is pure metal form of the aforementioned examples. In some embodiments, the non-reactive sidewall material is selected to be a material (e.g. Ca, Mg) that has a higher electrochemical potential than (e.g. cations of these materials are electrochemically more noble than) the metal product being produced (e.g. Al), the reaction of the non-reactive sidewall material is less desirable (electrochemically) than the reduction reaction of Alumina to Aluminum. In some embodiments, the non-reactive sidewall is made from castable materials. In some embodiments, the non-reactive sidewall is made of sintered materials.

In some embodiments the sidewall has a thickness of from 3 mm to not greater than 500 mm.

In some embodiments, the thickness of the sidewall is: at least 3 mm; at least 5 mm; at least 10 mm; at least 15 mm; at least 20 mm; at least 25 mm; at least 30 mm; at least 35 mm; at least 40 mm; at least 45 mm; at least 50 mm; at least 55 mm; at least 60 mm; at least 65 mm; at least 70 mm; at least 75 mm; at least 80 mm; at least 85 mm; at least 90 mm; at least 95 mm; or at least 100 mm.

In some embodiments, the thickness of the sidewall is: at least 100 mm; at least 125 mm; at least 150 mm; at least 175 mm; at least 200 mm; at least 225 mm; at least 250 mm; at least 275 mm; at least 300 mm; at least 325 mm; at least 350 mm; at least 375 mm; at least 400 mm; at least 425 mm; at least 450 mm; at least 475 mm; or at least 500 mm.

In some embodiments, the thickness of the sidewall is: not greater than 3 mm; not greater than 5 mm; not greater than 10 mm; not greater than 15 mm; not greater than 20 mm; not greater than 25 mm; not greater than 30 mm; not greater than 35 mm; not greater than 40 mm; not greater than 45 mm; not greater than 50 mm; not greater than 55 mm; not greater than 60 mm; not greater than 65 mm; not greater than 70 mm; not greater than 75 mm; not greater than 80 mm; not greater than 85 mm; not greater than 90 mm; not greater than 95 mm; or not greater than 100 mm.

In some embodiments, the thickness of the sidewall is: not greater than 100 mm; not greater than 125 mm; not greater than 150 mm; not greater than 175 mm; not greater than 200 mm; not greater than 225 mm; not greater than 250 mm; not greater than 275 mm; not greater than 300 mm; not greater than 325 mm; not greater than 350 mm; not greater than 375 mm; not greater than 400 mm; not greater than 425 mm; not greater than 450 mm; not greater than 475 mm; or not greater than 500 mm.

In some embodiments the polarized sidewall has a thickness of from 3 mm to not greater than 500 mm. In some embodiments, the polarized sidewall has a thickness of from 10 mm to 200 mm. In some embodiments, the polarized sidewall has a thickness of from 40 mm to 100 mm.

In some embodiments the stable sidewall has a thickness of from 3 mm to not greater than 500 mm. In some embodiments, the stable sidewall has a thickness of from 50 mm to not greater than 400 mm. In some embodiments, the stable sidewall has a thickness of from 100 mm to not greater than 300 mm. In some embodiments, the stable sidewall has a thickness of from 150 mm to not greater than 250 mm.

Example: Bench Scale Study: Side Feeding

Bench scale tests were completed to evaluate the corrosion-erosion of an aluminum electrolysis cell. The corrosion-erosion tests showed that alumina, and chromia-alumina materials were preferentially attacked at the bath-metal interface. Also, it was determined that the corrosion-erosion rate at the bath-metal interface is accelerated dramatically when alumina saturation concentration is low (e.g. below about 95 wt. %). With a physical barrier of feeding materials, i.e. to feed increase the alumina saturation concentration, the barrier (e.g. of alumina particles) operated to keep alumina saturated at bath-metal interface to protect the sidewall from being dissolved by the bath. Thus, the sidewall at the bath-metal interface is protected from corrosive-erosive attack and the aluminum saturation concentration was kept at about 98 wt. %. After performing electrolysis for a period of time, the sidewall was inspected and remained intact.

Example: Pilot Scale Test: Automated Side Feeding with Rotary Feeder

Figure 31:
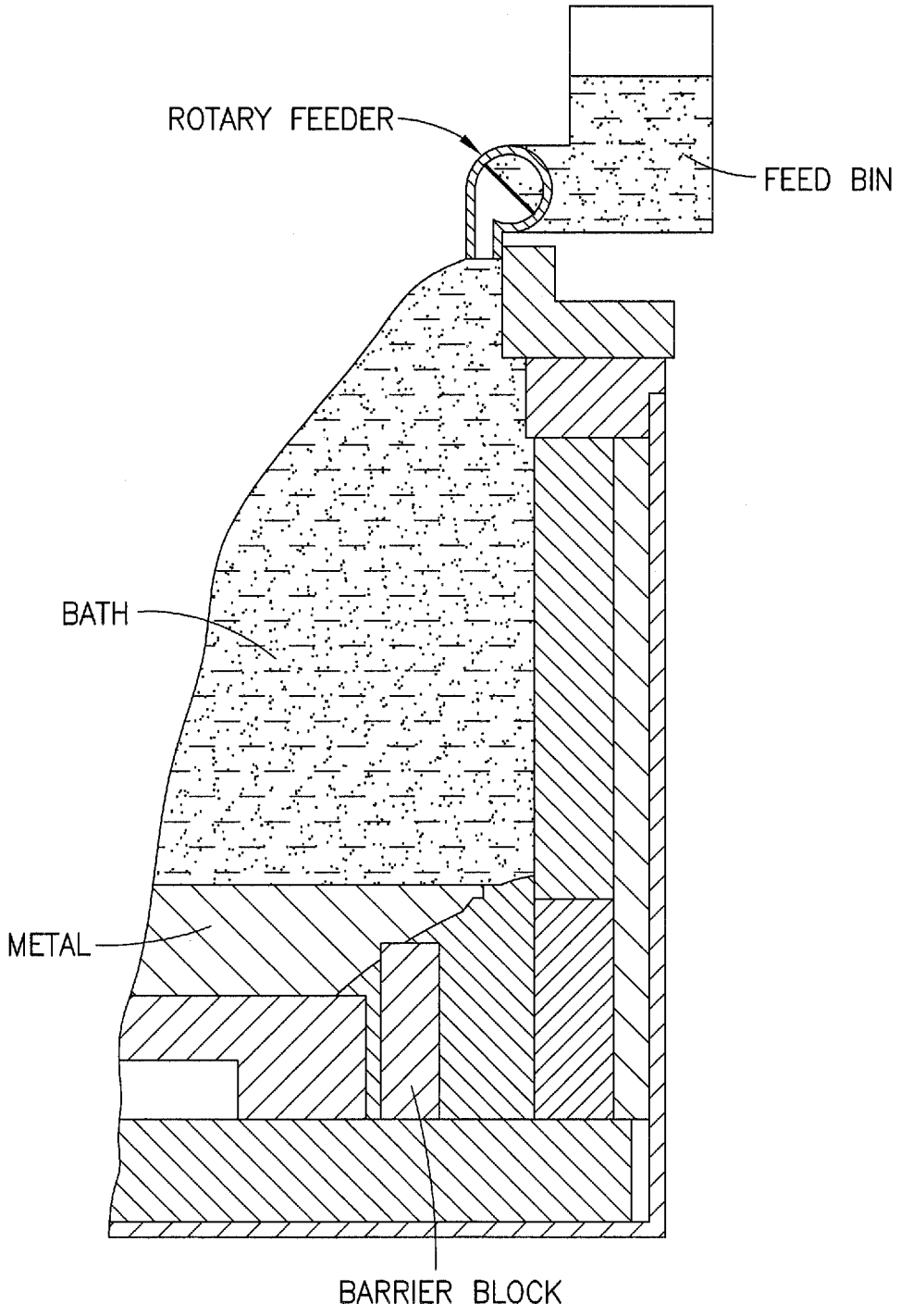
FIG. 31 depicts a partial cut away side view of a cell with a rotary feeder, in accordance with the Examples section.
Figure 32:
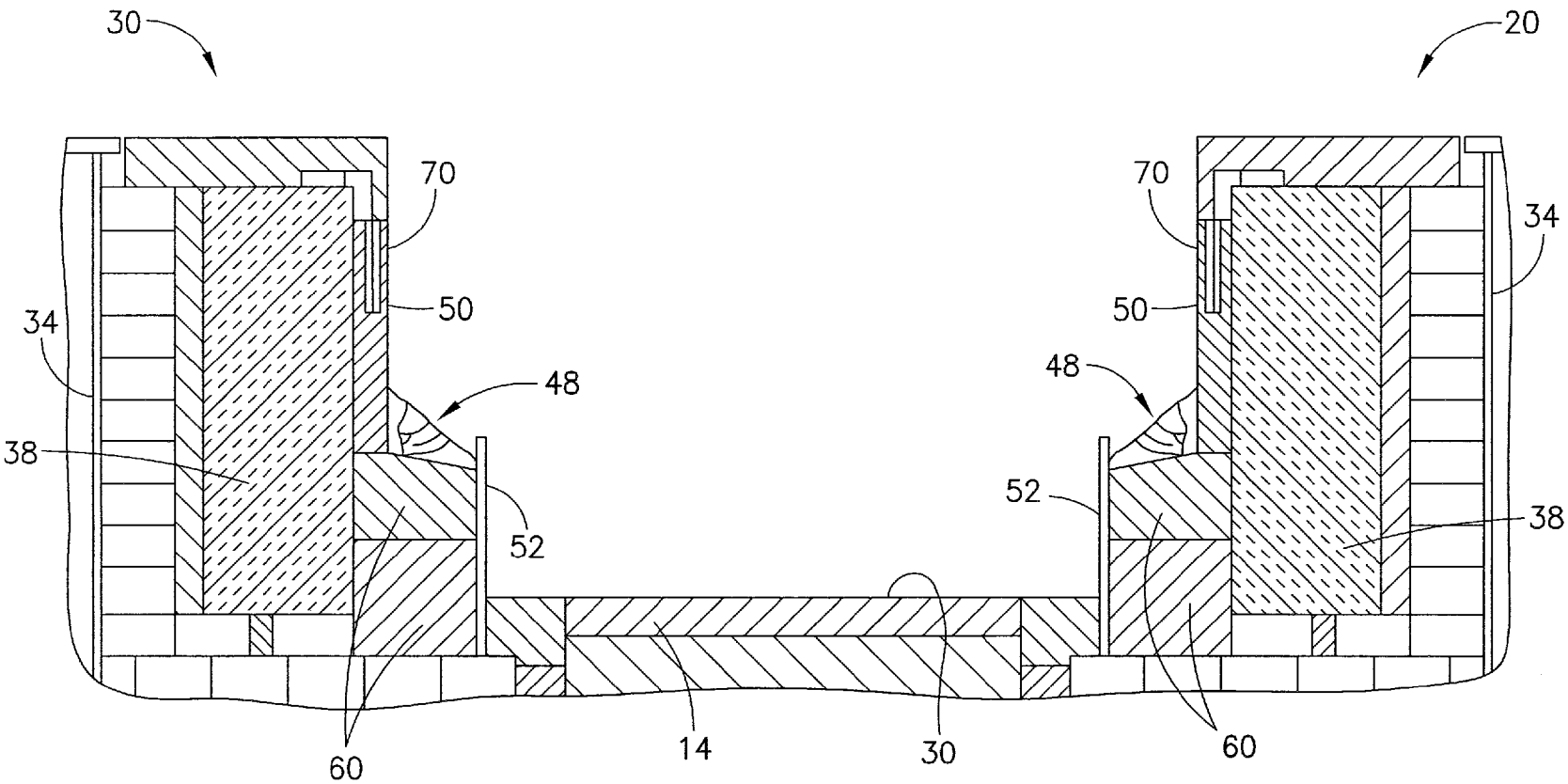
FIG. 32 depicts a partial cut away side view of a cell having an anodic sidewall portion and a cathodic sidewall portion with a protecting deposit there between, in accordance with one of the experiments run for the Examples section.
Figure 33A:
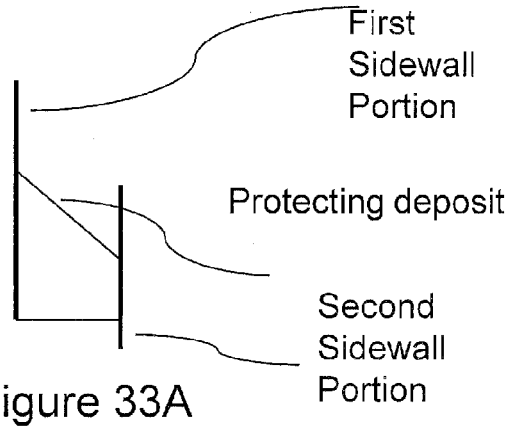
FIG. 33A-H depicts a partial cut away side view of various angles of the protecting deposit and the trough bottom/base (sometimes called a feed block) beneath the protecting deposit. Various angles of the protecting deposit are depicted (angling towards the second sidewall portion, angled towards the first sidewall portion, flat, angled, and the like). Also, various angles of the trough bottom/base are depicted (angling towards the second sidewall portion, angled towards the first sidewall portion, flat, angled, and the like).
Figure 33B:
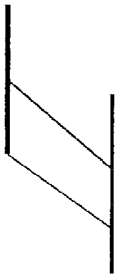
Figure 33C:
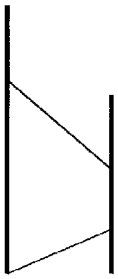
Figure 33D:
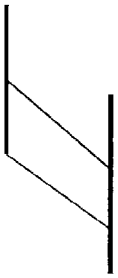
Figure 33E:
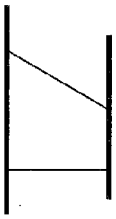
Figure 33F:
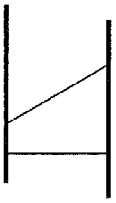
Figure 33G:
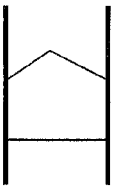
Figure 33H:
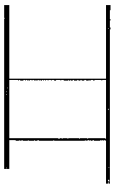
Figure 34A:
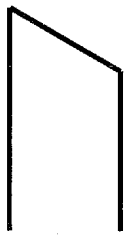
FIG. 34A-D depicts a partial cut-away side view of the various configurations of the shelf top and/or second sidewall portion.
Figure 34B:
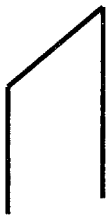
Figure 34C:
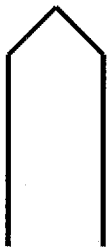
Figure 34D:
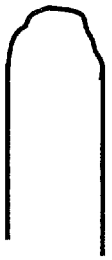
Figure 35:
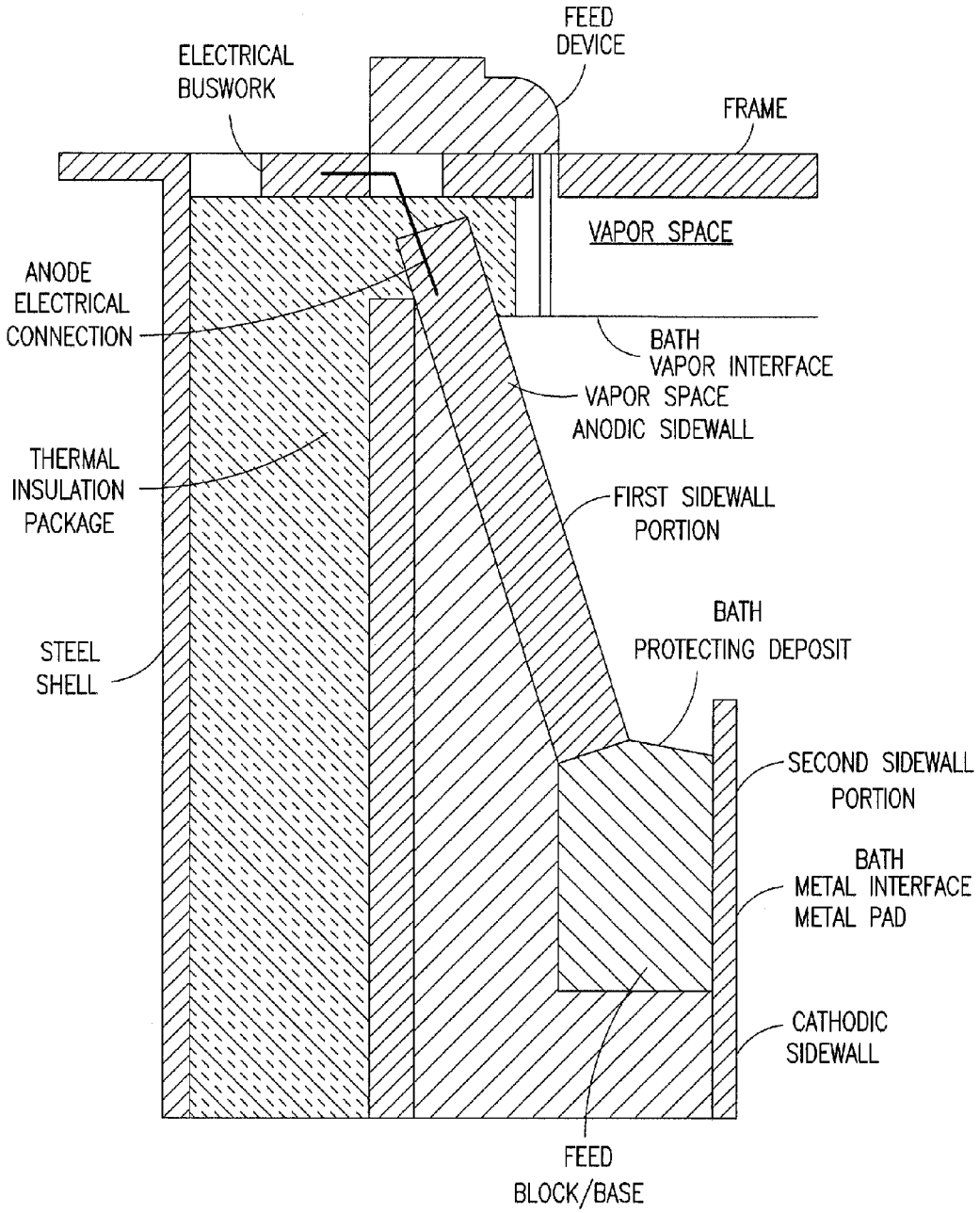
FIG. 35 depicts a schematic cut away side view of a transverse sidewall portion (e.g. sloped anodically polarized sidewall, depicted with feed device, trough, and second sidewall portion.
Figure 36:
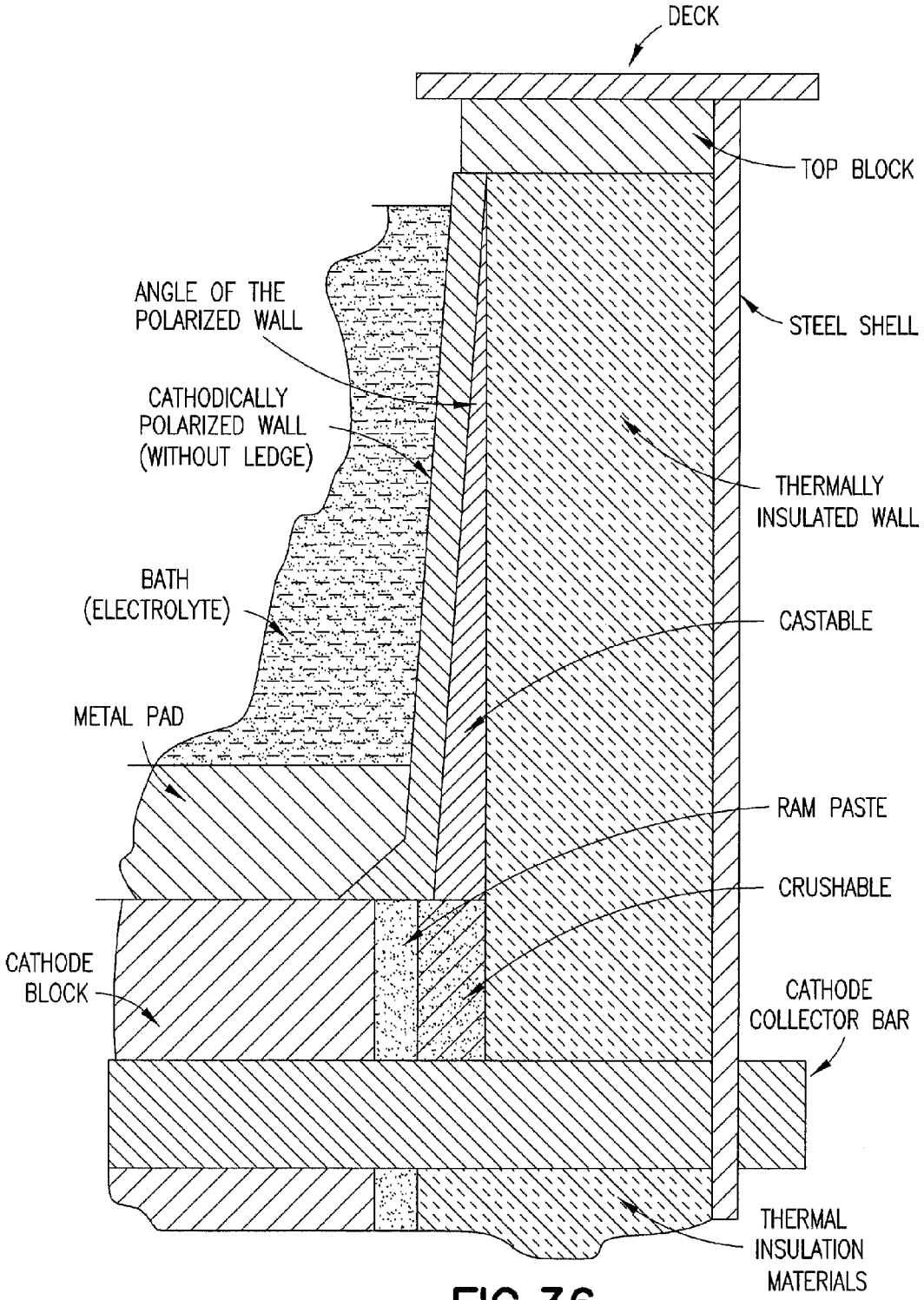
FIG. 36 depicts a schematic cut away side view of a cathodically polarized sidewall of the present disclosure, wherein the cathodically polarized sidewall extends through the bath-metal interface and the bath-vapor (sometimes called air) interface.

A single hall cell was operated continuously for about 700 hr with a trough along the sidewall around the perimeter of the cell (e.g. via a rotary feeder). The feeder included a hopper, and rotated along the sidewall to feed the entire sidewall (along one sidewall). A feed material of tabular alumina was fed into the cell at a location to be retained in the trough by an automatic feeder device. After electrolysis was complete, the sidewall was inspected and found intact (i.e. the sidewall was protected by the side feeding). The rotary feeder along the sidewall is depicted in FIG. 31.

Example: Full Pot Test Side Feeding (Manual)

A commercial scale test on sidewall feeding was operated continuously for a period of time (e.g. at least one month) with a trough along the sidewall via manual feeding. A feed material of tabular alumina was fed into the cell manually at a location adjacent to the sidewall such that the alumina was retained in a trough in the cell, located adjacent to the sidewall. Measurements of the sidewall profile showed minimum corrosion-erosion of the sidewall above the trough, and trough profile measurements indicated that the trough maintained its integrity throughout the operation of the cell. Thus, the manually fed alumina protected the metal-bath interface of the sidewall of the cell from corrosion-erosion. An autopsy of the cell was performed to conclusively illustrate the foregoing.

Example: Polarized Sidewalls with Side Feeding

Figure 22:
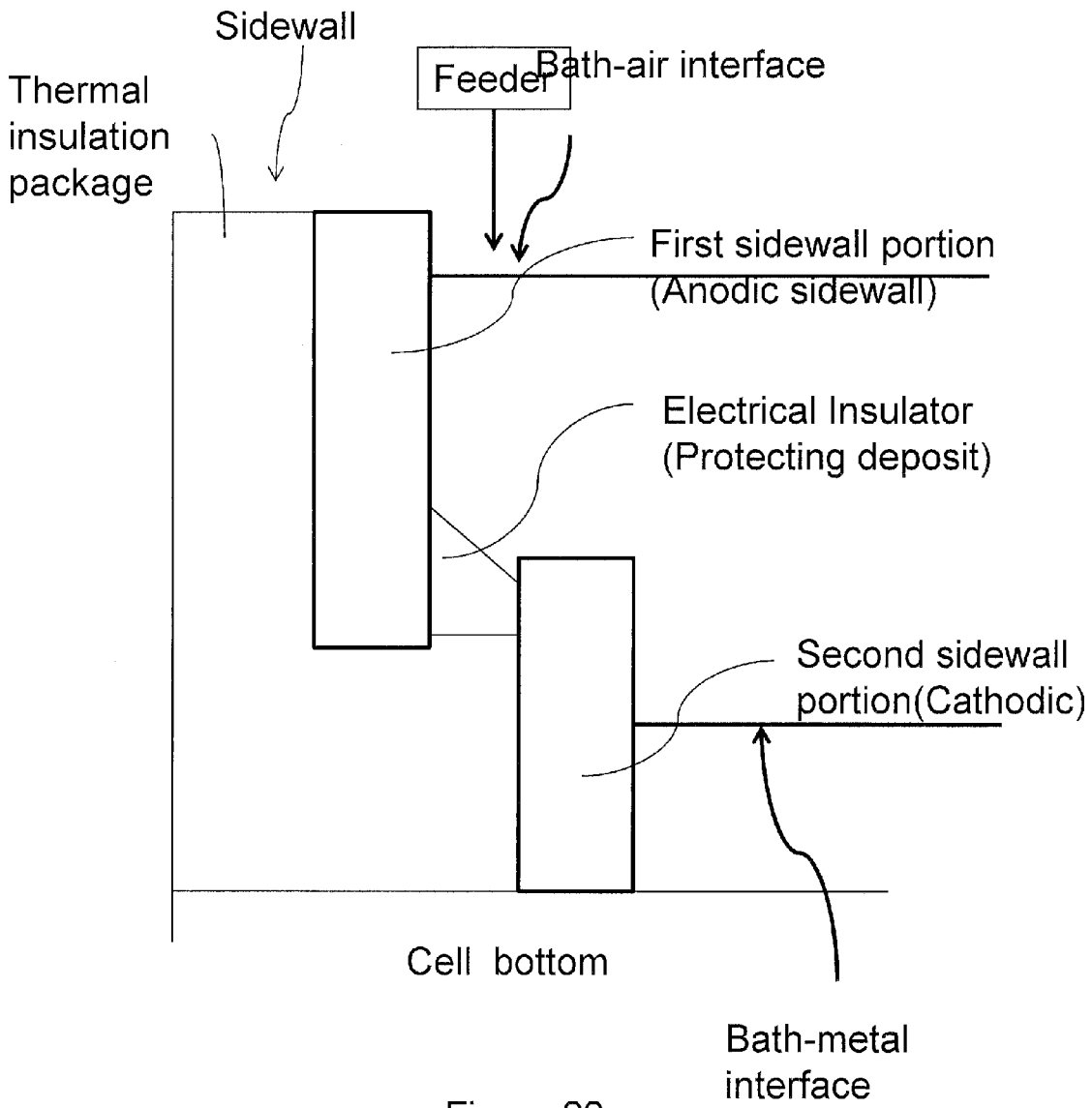
FIG. 22 depicts a partial cut-away side view of a cell body having a first sidewall portion which is anodic and a second sidewall portion which is cathodic, with an electrical insulator (protecting deposit provided via feeder) spanning the distance between the first sidewall portion and the second sidewall portion, in accordance with the instant disclosure.
Figure 23:
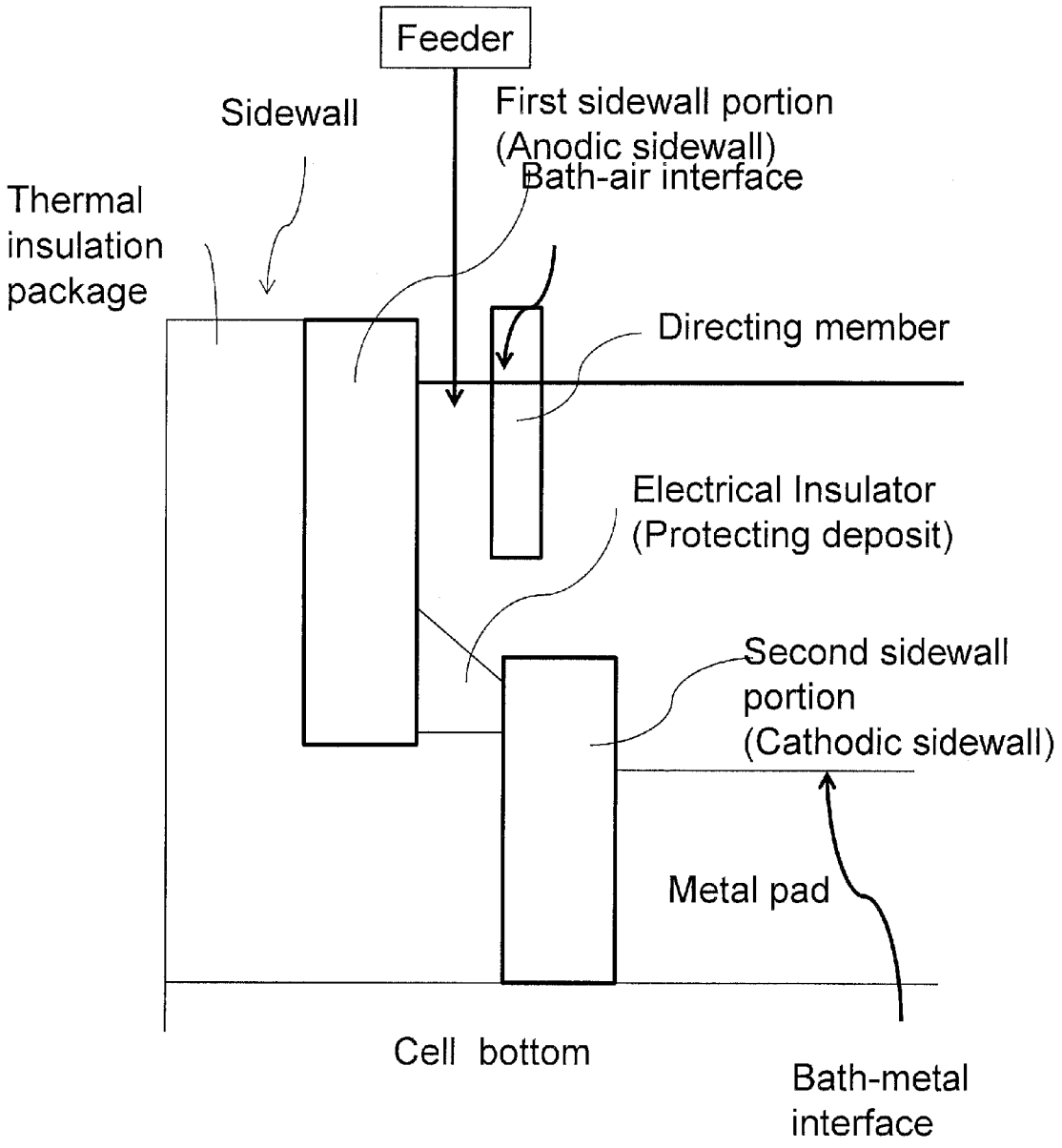
FIG. 23 depicts a partial cut-away side view of a cell body having a first sidewall portion which is anodic and a second sidewall portion which is cathodic, with an electrical insulator (protecting deposit provided via feeder) spanning the distance between the first sidewall portion and the second sidewall portion including a directing member, in accordance with the instant disclosure.
Figure 24:
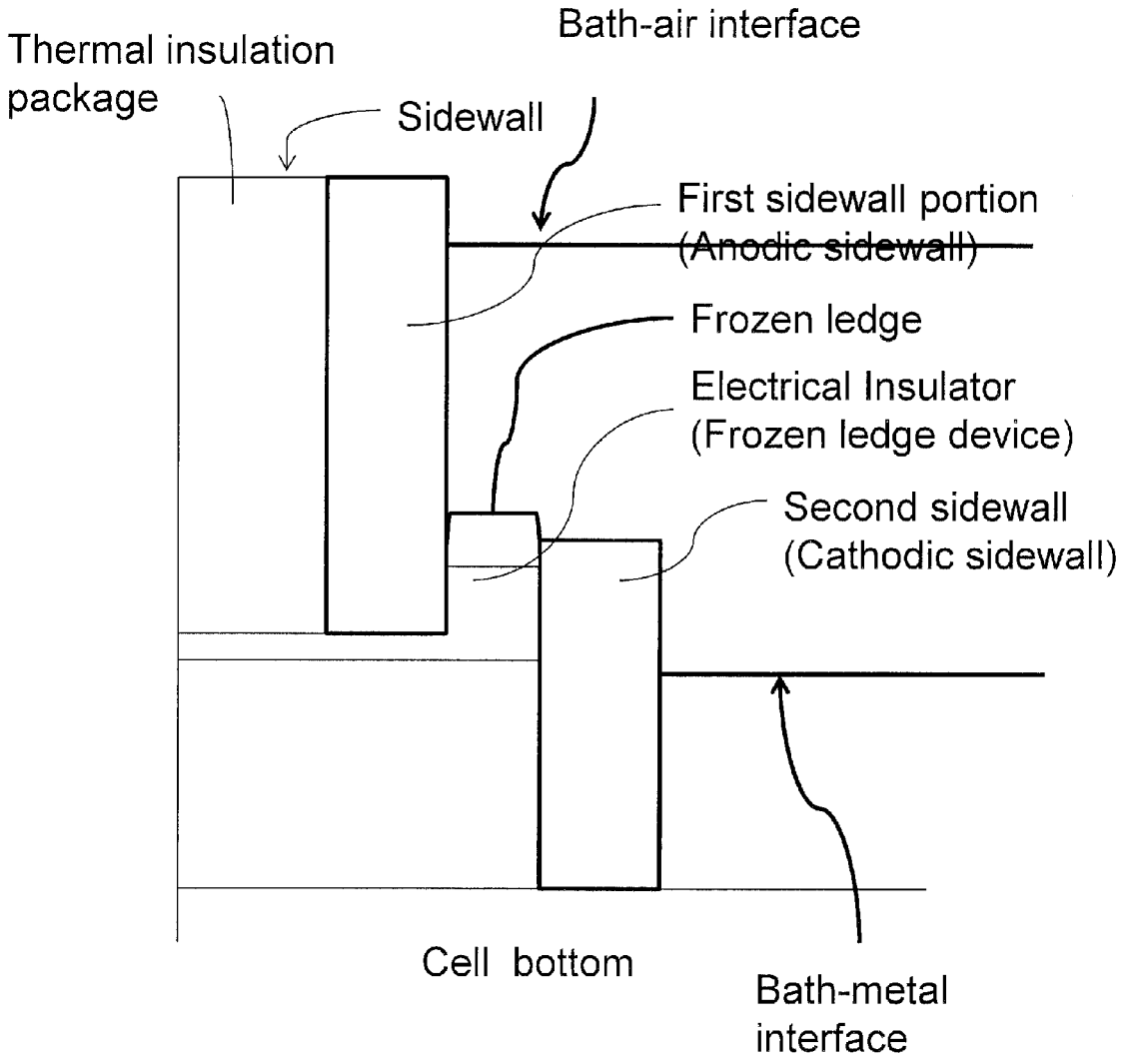
FIG. 24 depicts a partial cut-away side view of a cell body having a first sidewall portion which is anodic and a second sidewall portion which is cathodic, with an electrical insulator (frozen ledge device with frozen ledge) spanning the distance between the first sidewall portion and the second sidewall portion including a directing member, in accordance with the instant disclosure.
Figure 25:
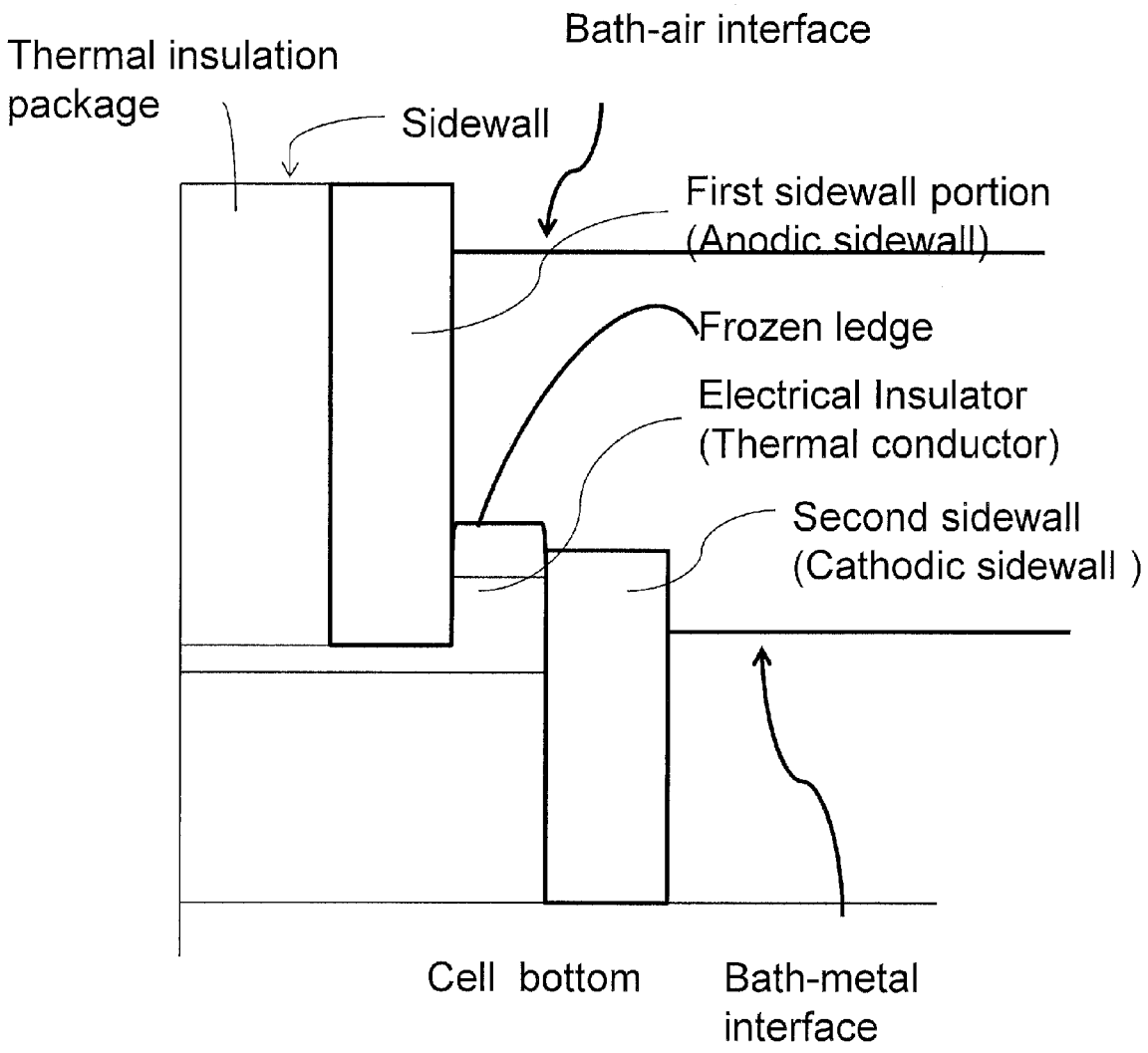
FIG. 25 depicts a partial cut-away side view of a cell body having a first sidewall portion which is anodic and a second sidewall portion which is cathodic, with an electrical insulator (frozen ledge device with frozen ledge) spanning the distance between the first sidewall portion and the second sidewall portion including a directing member, in accordance with the instant disclosure.
Figure 26:
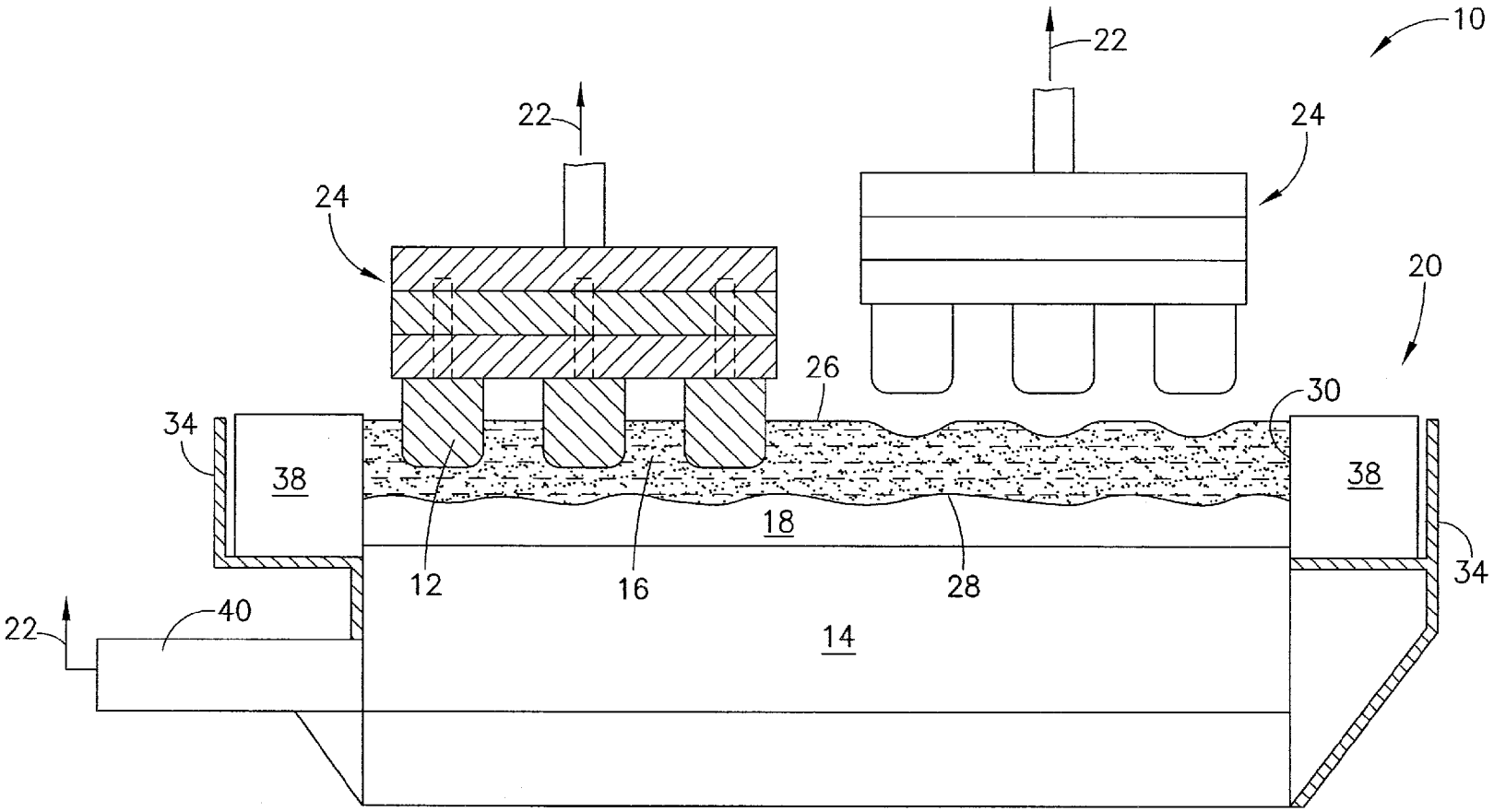
FIG. 26 depicts a schematic side view of an electrolysis cell in operation in accordance with the instant disclosure, depicting an active sidewall (e.g. one or more sidewalls of the instant disclosure).
Figure 27:
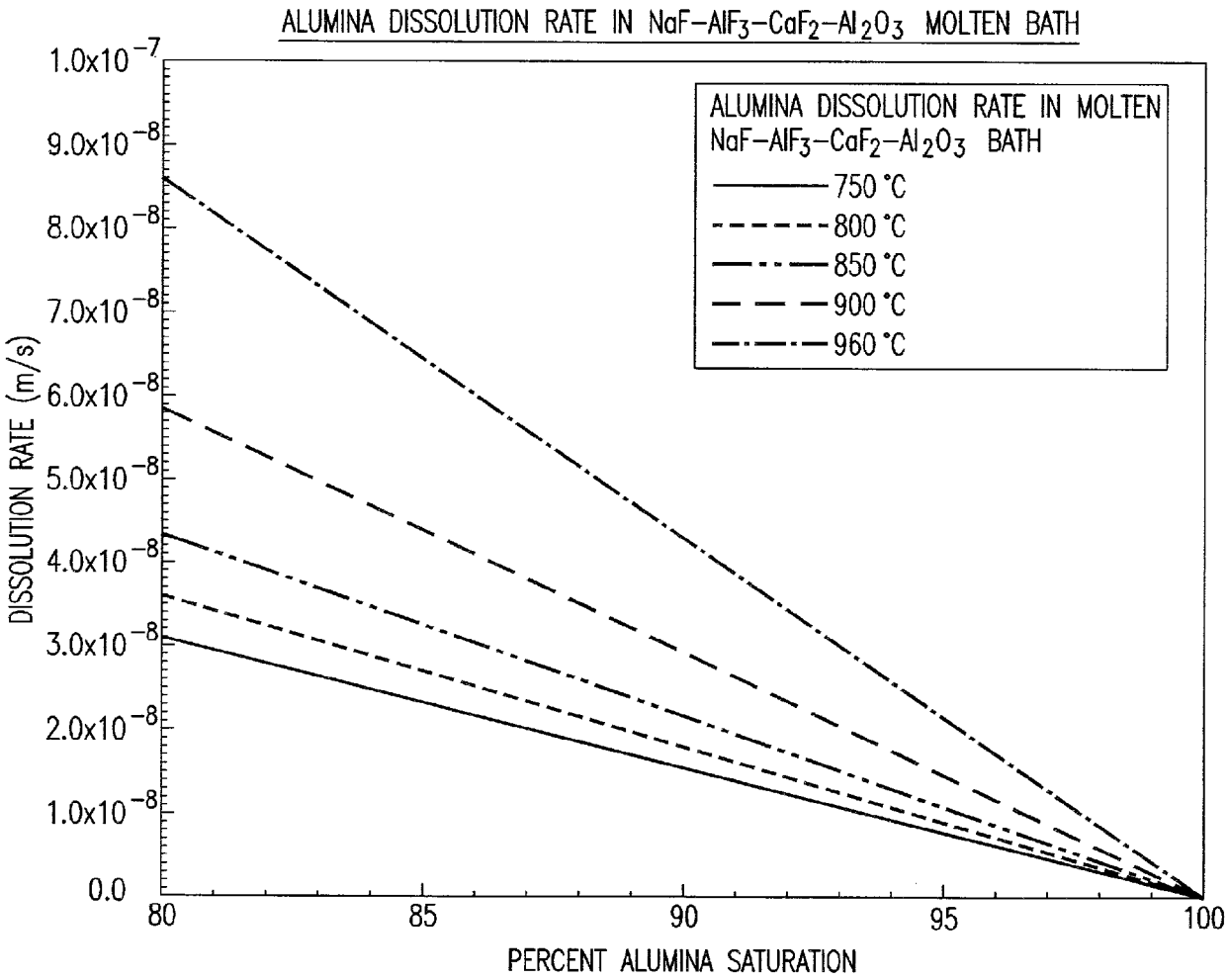
FIG. 27 is a chart depicting the alumina dissolution rate (m/s) in electrolytic bath per percent alumina saturation, plotted at five (5) different temperature lines (750° C., 800° C., 850° C., 900° C., and 950° C.).
Figure 28:
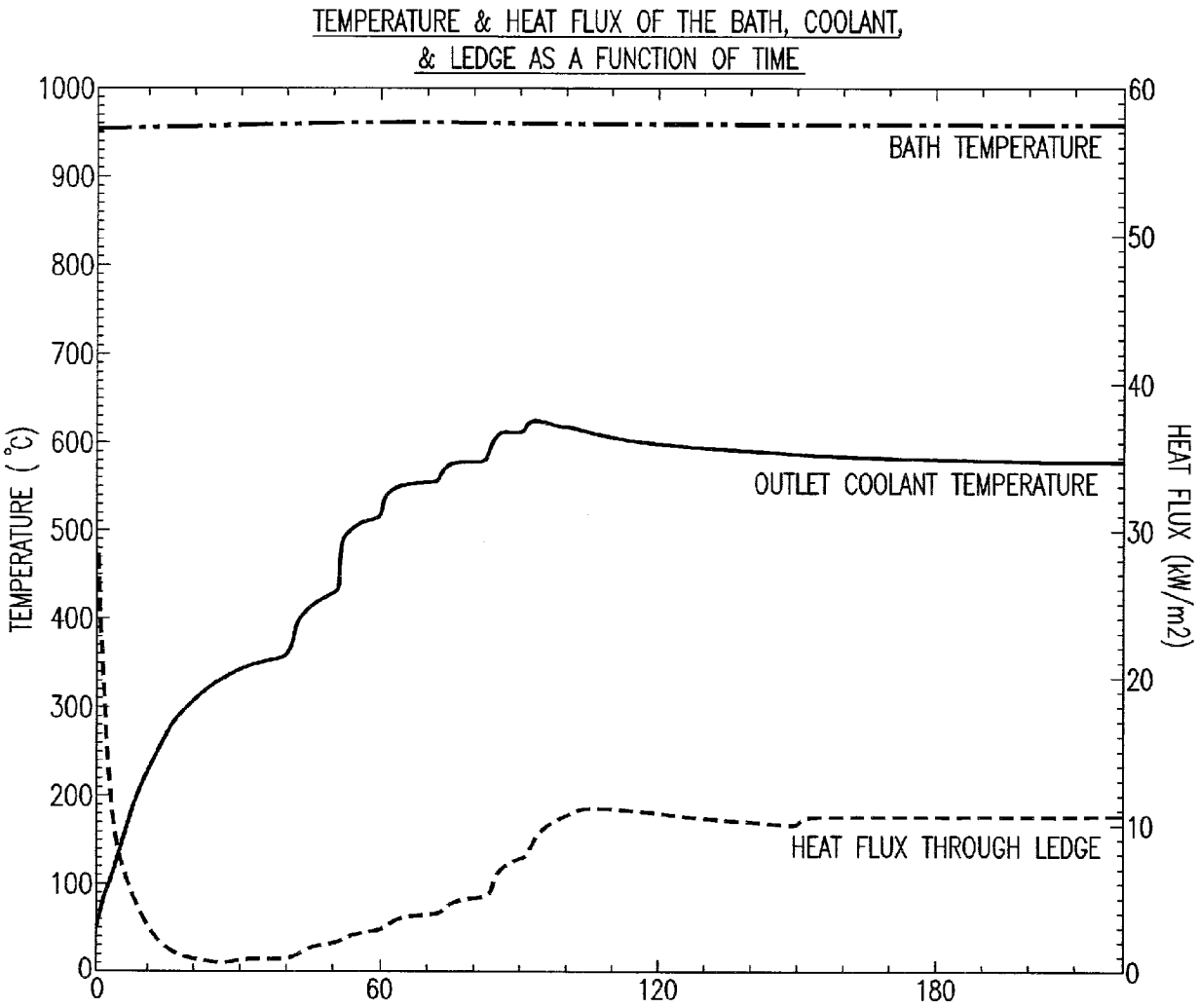
FIG. 28 is a chart of temperature and heat flux of the bath, coolant, and outlet ledge as a function of time.

Bench tests and pilot tests were performed (e.g. 100 A cell up to 25 kA cell), with some tests running for as long as nine months. the Sidewall included an anodic portion and a cathodic portion, with a feeder providing a protecting deposit to act as an insulator there between, as depicted in FIGS. 22 and 33. After the cell was run, the sidewalls were evaluated and confirmed to be intact.

Example: Frozen Ledge Device

Figure 29:
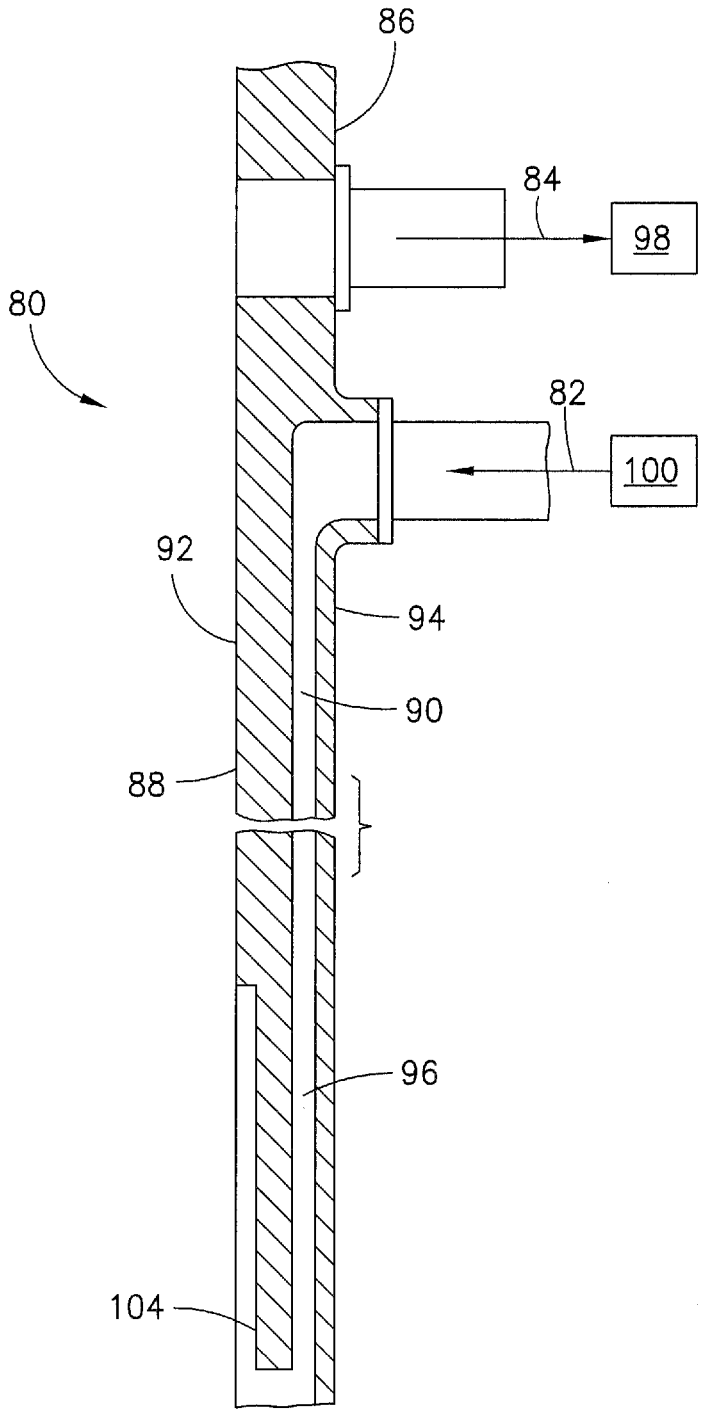
FIG. 29 depicts a schematic cut-away side view of a frozen ledge device (removable/adjustable) in accordance with the instant disclosure.
Figure 30:
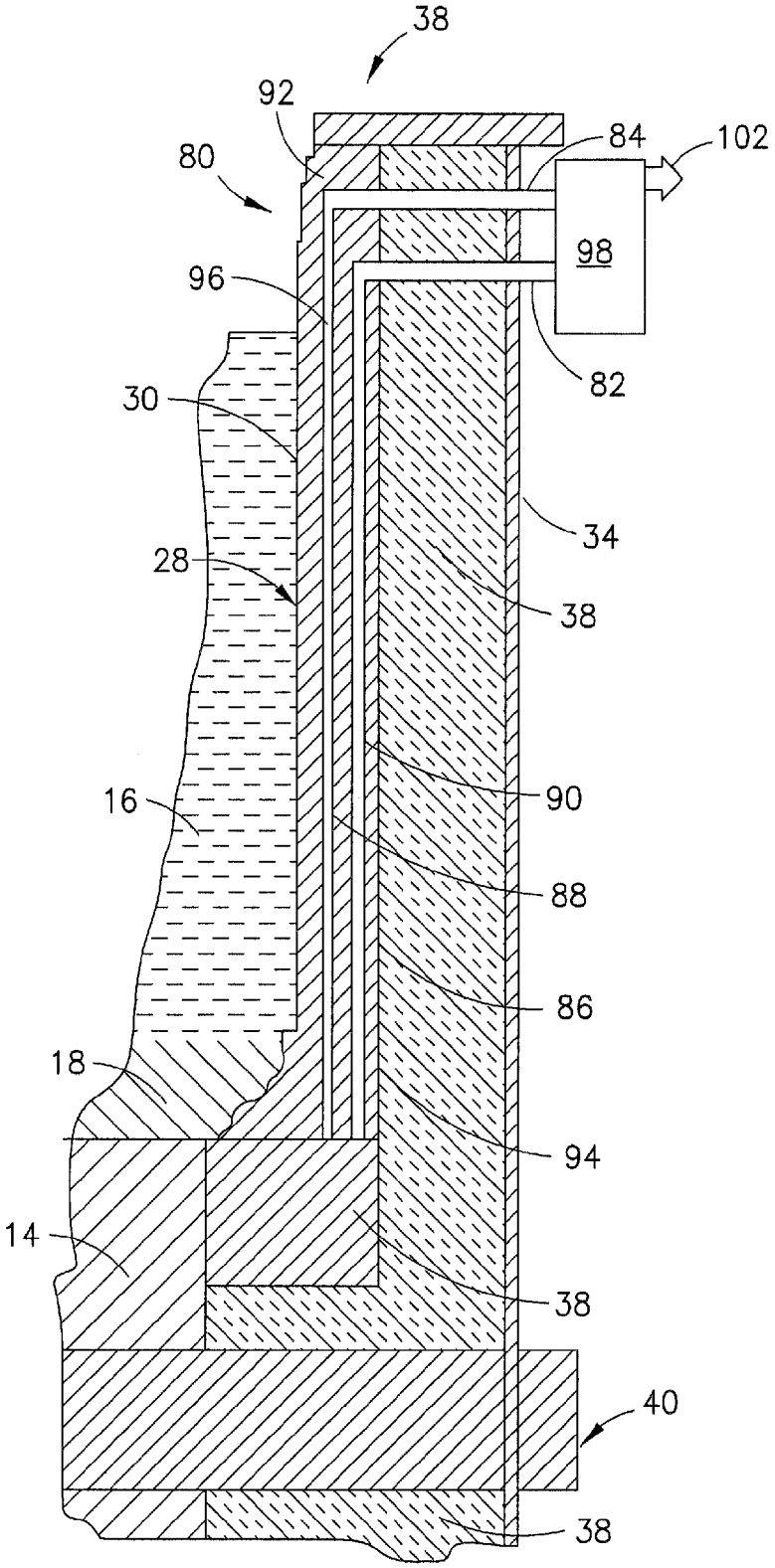
FIG. 30 depicts a schematic cut-away side view of a frozen ledge device which is configured to be retained at least partly through the sidewall, in accordance with the instant disclosure.

A pilot scale test was performed with a frozen ledge device (e.g. frozen finger) due to the scale-down, in a crucible reactor. The frozen ledge device operated to form a frozen portion of bath along the surface of the frozen ledge device. FIGS. 29-30 depict the frozen ledge device and the experimental set up within the crucible reactor.

Example: Average % Saturation of Alumina vs. Max Wear Rate (Dissolution Rate)

Five Electrolytic Cells (i.e. Cell 1-5) were operated for a period of time to produce aluminum on a bench scale. The Cells were each the same size and had the same sidewall material (e.g. alumina) with no seams in the sidewalls, where each Cell had the same molten electrolyte material (bath). Each Cell was operated at a different average saturation percentage of alumina in the bath, where the Cells ranged from an average of 85.5% saturation (Cell 1) to 98.92% saturation (Cell 5). Measurements were obtained on each cell (e.g. at a position along the sidewall surface) to determine the dissolution rate of the alumina sidewall. The maximum wear rate (in mm/year) is provided in the table below. The data supports the trend that as the average saturation increases, the max wear rate decreases. The table provides that where the average saturation % was within 2% of saturation (i.e. Cell 5), the maximum wear rate (dissolution rate) was less than half of that than for Cell 1 (i.e. 31.97 mm/year vs. 75.77 mm/year), which operated at 85.5% of saturation.

Average Saturation % and Max Wear Rate (Dissolution Rate) in mm/Year for Cells 1-5

| Cell | Avg Sat'n % | Max Wear Rate (mm/yr) |
|---|---|---|
| Cell 1 | 85.5 | 75.77 |
| Cell 2 | 91.99 | 73.58 |
| Cell 3 | 93.65 | 57.81 |
| Cell 4 | 94.42 | 45.11 |
| Cell 5 | 98.92 | 31.97 |

Example Average % Saturation of Alumina Vs. Max Wear Rate (Dissolution Rate)

Three Electrolytic Cells (i.e. Cell 5-7) were operated for a period of time to produce aluminum on a bench scale. Cells 5-7 were operated to produce aluminum from alumina (feed material) and each cell had alumina sidewalls and the same bath material (molten electrolyte). Cells 5 and 6 were the same size (and also, Cells 1-6 were the same size), while Cell 7 was a larger pilot cell than cells 1-6). Cell 7 had at least one seam, in addition to the alumina sidewall material. For Cells 5-7, alumina saturation was determined via analytical measurements every 4 hours (e.g. LECO measurements). For Cell 5, alumina feed (saturation control) was completed manually (e.g. via visual observation of the bath), while alumina feed was automated for Cells 6 & 7 (e.g. with at least the LECO measurement being incorporated into the automated system). The three cells were each operated for varying periods of time prior to shut down. During operation, alumina was added to Cell 5 based upon visual inspection (e.g. clear denoting an indication for an "overfeed" event and cloudy denoting an indication for an "underfeed" event). Cells 6 and 7 were fed based upon the automated control system parameters, including the LECO measurements.

For Cells 5-7, each Cell was operated at a different average saturation percentage of alumina in the bath, where the Cells ranged from an average of 101.7% saturation (Cell 5) to 99.8% saturation (Cell 6). Measurements were obtained on each cell (e.g. at a position along the sidewall surface) to determine the dissolution rate of the alumina sidewall as cell operation progressed. For each cell, the average saturation % (alumina) is provided, along with the maximum wear rate (dissolution rate) in mm/year in the table below. Average saturation % values were obtained via LECO measurements, which had a potential error of +/−5%. In this instance, each Cell was operated with an average saturation % that was close to or slightly above the saturation limit of alumina (as computer for) the cell system with operating parameters. In each Cell, muck was observed at one time or another, where muck (alumina which settles from the bath) will accumulate towards the cell bottom in the case where the cell is operated for long periods of time with alumina contents above the saturation limit (i.e. for the cell system and its operating parameters). Wear rates were evaluated for Cell 7 at the seam (in addition to the face/surface of the sidewall) and it is noted that, as expected, the measured average wear rate at the seam was larger than that of the face for Cell 7. It is noted that Cell 5 from the previous Example is the same as Cell 5 from this Example, but the average saturation % was increased (i.e. from 98.92% to 101.7%).

Average Saturation % and Max Wear Rate (Dissolution Rate) in mm/year for Cells 5-7

| Cell | Avg Sat'n % | Max Wear Rate (mm/yr) |
|---|---|---|
| Cell 5 | 101.7 | 45.72 |
| Cell 6 | 99.8 | 109.22 |
| Cell 7 | 100.1 | 119.38 |

Example Average % Saturation of Alumina Vs. Max Wear Rate (Dissolution Rate)

Cell 8 was the same size as Cell 7 from the previous example (e.g. larger size bench scale cell, with at least one seam and alumina sidewall material). Cell 8 was operated at a number of days at an average saturation of 98.5%, during which time a number of wear measurements were taken along a given portion of one seam in the cell. For Cell 8 operating at 98.5% of alumina saturation with alumina walls, the wear rate at the seam was calculated. Following operation for a number of days at an average saturation of 98.5%, Cell 8 was operated for a number of days at an average saturation of 98%, during which time a number of wear measurements were taken. Again, wear rates at the seam were calculated for the same cell, operating at 98% of alumina saturation. The average saturation percents and maximum wear rates at the seam are provided in the table, below. It is noted, that Cell 8 was operated for over a month longer at an average saturation of 98.5% as compared its operation at an average saturation of 98%. From the Table below, it is shown that by operating the Cell at an average saturation of just 0.5% higher, the wear rate at the seam was less than half the rate of the lower average saturation's wear rate (dissolution rate) (i.e. 109.73 mm/yr vs. 241.40 mm/yr).

Average Saturation % and Max Wear Rate@Seam (Dissolution Rate) for Cell 8

| Avg Sat'n % | Max Wear Rate @ seam (mm/yr) |
|---|---|
| 98.5 | 109.73 |
| 98 | 241.40 |

While various embodiments of the present invention have been described in detail, it is apparent that modifications and adaptations of those embodiments will occur to those skilled in the art. However, it is to be expressly understood that such modifications and adaptations are within the spirit and scope of the present invention.

REFERENCE NUMBERS

Cell 10
Anode 12
Cathode 14
Electrolyte bath 16
Metal pad 18
Cell body 20
Electrical bus work 22
Anode assembly 24
Current collector bar 40
Active sidewall 30
Sidewall 38 (e.g. includes active sidewall and thermal insulation package)
Bottom 32
Outer shell 34
Polarized sidewall 50
Feed block 60
Anodic sidewall 70
Cathodic sidewall 52
Bath-air (vapor) interface 26
Metal-bath interface 28
Frozen ledge device 80
Inlet 82
Outlet 84
Body 86
Outer wall 92 (contacts electrolyte)
Heat absorption section 88 (comprising thermal conducting material e.g. steel, SiC, graphite sleeve)
Channel 90
Pump 100
Energy output 102
Coolant 96
Expanded areas (e.g. fins) 104
Heat exchanger 98

What is claimed is:

1. An electrolysis cell comprising:

an anode;

a cathode in spaced relation from the anode;

a molten electrolyte bath in liquid communication with the anode and the cathode;

a cell body comprising a sidewall and a bottom, wherein the cell body is configured to retain the molten electrolyte bath;

wherein the sidewall comprises a second sidewall portion overlapping a first sidewall portion and wherein the overlap is from 0% to not greater than 90% of a total height of the cell sidewall;

wherein the sidewall comprises: a polarized sidewall portion, wherein the polarized sidewall portion comprises not greater than 95% of the sidewall and is in liquid communication with the molten electrolyte bath, wherein the sidewall is from 5 mm thick to 500 mm thick, and wherein the polarized sidewall portion comprises: an anodically polarized sidewall, wherein the anodically polarized sidewall is positioned above the bottom of the cell body and adjacent to the bath-vapor interface, such that the anodically polarized sidewall is in communication with the bath-vapor interface.

2. The electrolysis cell of claim 1, wherein the polarized sidewall portion comprises an anodically polarized sidewall portion and a cathodically polarized sidewall portion.

3. The electrolysis cell of claim 1, wherein the polarized sidewall portion comprises:

a cathodically polarized sidewall, wherein the cathodically polarized sidewall is positioned below the bath-vapor interface and adjacent to the bottom of the cell body such that the cathodically polarized sidewall is in liquid communication with the bottom of the cell body.

4. The electrolysis cell of claim 1, wherein the polarized sidewall portion comprises: at least 50% of surface of an inner sidewall.

5. The electrolysis cell of claim 1, wherein the apparatus includes: a non-polarized sidewall portion, wherein both the polarized sidewall portion and the non-polarized sidewall portion are adjacent to each other and in liquid communication with the molten electrolyte bath.

6. The electrolysis cell of claim 5, wherein the non-polarized sidewall portion is positioned above the cathodically polarized sidewall and is in communication with the bath-air interface.

7. The electrolysis cell of claim 5, wherein the non-polarized sidewall portion is selected from the group consisting of:

a thermal conductor; a stable material; a frozen ledge device, and combinations thereof.

8. The electrolysis cell of claim 5, wherein the non-polarized sidewall is configured to extend from the cell bottom to a height above a metal-to-bath interface, further wherein the non-polarized sidewall portion is configured adjacent to and in communication with the polarized sidewall portion.

9. An electrolysis cell comprising:

a cell body having a bottom and at least one sidewall, wherein the cell body is configured to retain a molten electrolyte bath, wherein the sidewall comprises:

a first sidewall portion, configured to fit onto a thermal insulation package of the sidewall and retain the electrolyte, the first sidewall portion comprising an anodically polarized sidewall portion, wherein the anodically polarized sidewall is positioned above the bottom of the cell body and adjacent to the bath-vapor interface, such that the anodically polarized sidewall is in communication with the bath-vapor interface;

a second sidewall portion configured to extend up from the bottom of the cell body, wherein the second sidewall portion overlapping a first sidewall portion and wherein the overlap is from 0% to not greater than 90% of a total height of the cell sidewall, wherein the second sidewall portion is longitudinally spaced from the first sidewall portion, such that the first sidewall portion, the second sidewall portion, and a base between the first portion and the second sidewall portion define a trough the trough having a width of 10 mm to not greater than 500 mm;

wherein the trough is configured to receive a protecting deposit and retain the protecting deposit separate from the cell bottom.

10. The electrolysis cell of claim 9, wherein the second sidewall portion comprises a cathodically polarized sidewall.

11. The electrolysis cell of claim 9, wherein the second sidewall portion comprises a non-polarized sidewall including a stable material, wherein the stable material which includes a component of the bath chemistry further wherein, via the bath chemistry and percent saturation of the non-reactive material in the bath, the sidewall is substantially non-reactive in the molten salt electrolyte.

12. The electrolysis cell of claim 9, further comprising a directing member, wherein the directing member is positioned between the anodically polarized sidewall and the second sidewall portion, further wherein the directing member is laterally spaced above the base of the trough, such that the directing member is configured to direct a feed material into the trough, to be retained therein as protecting deposit in the trough.

13. The electrolysis cell of claim 12, wherein the directing member comprises: an anodically polarized material; a stable material; a cathodically polarized material; and combinations thereof.

14. A method, comprising:

passing current from an anode through a molten electrolyte bath to a cathode in an electrolysis cell;

concomitant to the first step, maintaining the bath at a temperature not exceeding 980° C.;

feeding a feed material into the electrolysis cell at a location adjacent to a cell wall, such that the feed material is retained in a trough defined adjacent to sidewall, wherein the sidewall comprises a second sidewall portion overlapping a first sidewall portion and wherein the overlap is from 0% to not greater than 90% of a total height of the cell sidewall, and wherein the sidewall comprise an anodically polarized sidewall positioned above the bottom of the cell body and adjacent to the bath-vapor interface, such that the anodically polarized sidewall is in communication with the bath-vapor interface; and via the feeding step, maintaining the sidewall in the molten electrolyte during cell operation, wherein the sidewall is constructed of at least one component which is within about 95% of saturation in the molten electrolyte bath, wherein sidewalls of the cells are substantially free of a frozen ledge.

15. The method of claim 14, wherein the method includes:

consuming the protecting deposit such that via consumption of the protecting deposit, metal ions are supplied to the molten electrolyte bath.

16. The method of claim 14, further comprising:

producing a metal product from the at least one bath component.

* * * * *